US006689229B2

(12) United States Patent
Fujita et al.

(10) Patent No.: US 6,689,229 B2
(45) Date of Patent: Feb. 10, 2004

(54) HIGH STRENGTH COLD ROLLED STEEL SHEET AND METHOD FOR MANUFACTURING THE SAME

(75) Inventors: Takeshi Fujita, Fukuyama (JP); Fusato Kitano, Fukuyama (JP); Yoshihiro Hosoya, Fukuyama (JP); Toru Inazumi, Fukuyama (JP); Yuji Yamasaki, Fukuyama (JP); Masaya Morita, Fukuyama (JP); Yasunobu Nagataki, Fukuyama (JP); Kohei Hasegawa, Fukuyama (JP); Hiroshi Matsuda, Fukuyama (JP); Moriaki Ono, Fukuyama (JP)

(73) Assignee: NKK Corporation, Tokyo (JP)

( * ) Notice: Subject to any disclaimer, the term of this patent is extended or adjusted under 35 U.S.C. 154(b) by 0 days.

(21) Appl. No.: 10/122,860

(22) Filed: Apr. 15, 2002

(65) Prior Publication Data

US 2002/0179206 A1 Dec. 5, 2002

Related U.S. Application Data

(62) Division of application No. 09/631,600, filed on Aug. 3, 2000, now Pat. No. 6,494,969, which is a continuation of application No. PCT/JP99/06791, filed on Dec. 3, 1999.

(30) Foreign Application Priority Data

| | | |
|---|---|---|
| Dec. 7, 1998 | (JP) | 10-346974 |
| Feb. 15, 1999 | (JP) | 11-036283 |
| Feb. 15, 1999 | (JP) | 11-036284 |
| Feb. 15, 1999 | (JP) | 11-036285 |
| Feb. 15, 1999 | (JP) | 11-036286 |
| Feb. 15, 1999 | (JP) | 11-036287 |

(51) Int. Cl.[7] ..... C21D 8/02; C22C 38/04; C22C 38/12

(52) U.S. Cl. ..... 148/320; 148/330; 148/541; 148/547

(58) Field of Search ..... 148/320, 330, 148/541, 547, 603

(56) References Cited

U.S. PATENT DOCUMENTS

| | | | | |
|---|---|---|---|---|
| 4,368,084 A | * | 1/1983 | Irie et al. | 148/337 |
| 4,504,326 A | | 3/1985 | Tokunaga et al. | |
| 5,290,370 A | | 3/1994 | Okada et al. | |
| 5,360,676 A | | 11/1994 | Kuguminato et al. | |
| 5,853,659 A | | 12/1998 | Sekita et al. | |
| 5,853,903 A | * | 12/1998 | Hosoya et al. | 148/320 |

FOREIGN PATENT DOCUMENTS

| | | |
|---|---|---|
| JP | 63-243225 A | 10/1988 |
| JP | 5-78784 A | 3/1993 |
| JP | 5-195080 A | 3/1993 |
| JP | 405070836 A | 3/1993 |
| JP | 5-112845 A | 5/1993 |
| JP | 5-263184 A | 10/1993 |
| JP | 6-41683 A | 2/1994 |
| JP | 62-185834 A | 9/1994 |
| JP | 7-48649 A | 2/1995 |
| JP | 9-235650 A | 9/1997 |
| JP | 10-46289 A | 2/1998 |

* cited by examiner

*Primary Examiner*—Deborah Yee
(74) *Attorney, Agent, or Firm*—Frishauf, Holtz, Goodman & Chick, P.C.

(57) ABSTRACT

A high strength cold rolled steel sheet consists essentially of 0.0040 to 0.01% C, not more than 0.05% Si, 0.1 to 1.0% Mn, 0.01 to 0.05% P, not more than 0.02% S, 0.01 to 0.1% sol.Al, not more than 0.004% N, 0.01 to 0.14% Nb, by weight, and a balance of substantially Fe and inevitable impurities, and having an n value of not less than 0.21 calculated from two points (1% and 10%) of nominal strain determined by the uniaxial tensile test, and a method for manufacturing the cold rolled steel sheet. The high strength cold rolled steel sheet has excellent combined formability, resistance to embrittlement during secondary operation, formability at welded portions, and anti-burring performance, and has a desirable surface appearance and uniformity of material in a coil, and thus can be desirably used for automobile exterior panels.

5 Claims, 22 Drawing Sheets

X#=(Nb%x12)/(C%x93)

G. L. 75mm
λ (TENSILE STRAIN) : 1%

YBT (mm)

◎ LESS THAN 1.00

○ 1.00～1.50 (JSC270F)

● MORE THAN 1.50

HAT FORMATION HEIGHT : H (mm)

△ MORE THAN 36.0
▽ 33.0~36.0 (JSC270F)
▼ LESS THAN 33.0

LIMIT DRAWING RATIO : LDR

◎ MORE THAN 2.20
○ 2.15~2.19 (JSC270F)
● LESS THAN 2.15

X#=(Nb%x12)/(C%x93)

HAT FORMATION HEIGHT : H (mm)

- △ MORE THAN 36.0
- ▽ 33.0~36.0 (JSC270F)
- ▼ LESS THAN 33.0

LIMIT DRAWING RATIO : LDR

- ◎ MORE THAN 2.20
- ○ 2.15~2.19 (JSC270F)
- ● LESS THAN 2.15

HIGH STRENGTH COLD ROLLED STEEL SHEET AND METHOD FOR MANUFACTURING THE SAME

This is a divisional application of application Ser. No. 09/631,600 filed Aug. 3, 2000 (now U.S. Pat. No. 6,494,969), which is a continuation application of International Application PCT/JP99/06791 filed Dec. 3, 1999.

TECHNICAL FIELD

The present invention relates to a high strength cold rolled steel sheet having 340 to 440 MPa of tensile strength, which is used for automobile exterior panels such as hoods, fenders, and side panels, and to a method for manufacturing thereof.

BACKGROUND ART

Steel sheets used for automobile exterior panels such as hoods, fenders, and side panels have recently often adopted high strength cold rolled steel sheets aiming at improved safety and mileage.

That kind of high strength cold rolled steel sheets are requested to have combined formability characteristics such as further improved deep drawability, punch stretchability, resistance to surface strain (ability of not inducing nonuniform strain on a formed surface) to make the steel sheets respond to the request for reducing the number of parts and for labor saving in press stage through the integration of parts.

To answer the request, recently there have been introduced several kinds of high strenth cold rolled steel sheets which use very low carbon steels containing not more than 30 ppm of C as the base material, with the addition of carbide-forming elements such as Mn, Si, P. For example, JP-A-112845(1993) (the term "JP-A" referred to herein signifies "Unexamined Japanese Patent Publication"), discloses a steel sheet of very low carbon steel specifying a lower limit of C content and adding positively Mn. JP-A-263184(1993) discloses a steel sheet of very low carbon steel adding a large amount of Mn, and further adding Ti or Nb. JP-A-78784(1993) discloses a steel sheet of very low carbon steel with the addition of Ti, further positively adding Mn, and controlling the content of Si and P, thus providing a tensile strength of 343 to 490 MPa. JP-A-46289(1998) and JP-A-195080(1993) disclose steel sheets of very low carbon steels adjusting the C content to 30 to 100 ppm, which content is a high level for very low carbon steels, and further adding Ti.

The high strength cold rolled steel sheets prepared from these very low carbon steels, however, fail to have excellent characteristics of combined formability such as deep drawability, punch stretchability, and resistance to surface strain. Thus, these high strength cold rolled steel sheets are not satisfactory as the steel sheets for automobile exterior panels. In particular, these steel sheets are almost impossible to prevent the generation of waving caused from surface strain which interferes the image sharpness after coating on the exterior panels.

Furthermore, to the high strength cold rolled steel sheets used for automobile exterior panels, there have appeared strict requests for, adding to the excellent combined formability, excellent resistance to embrittlement during secondary operation, formability of welded portions corresponding to tailored blank, anti-burring performance under sheering, good surface appearance, uniformity of material in steel coil when the steel sheets are supplied in a form of coil, and other characteristics.

DISCLOSURE OF THE INVENTION

Following is the description of the high strength cold rolled steel sheets according to the present invention, which have excellent characteristics of: combined formability characteristics including deep drawability, punch stretchability, and resistance to surface strain; resistance to embrittlement during secondary operation; formability at welded portions; anti-burring performance; surface characteristics; and uniformity of material in a coil.

Steel sheet 1 according to the present invention is a high strength cold rolled steel sheet consisting essentially of 0.0040 to 0.010% C, 0.05% or less Si, 0.10 to 1.20% Mn, 0.01 to 0.05% P, 0.02% or less S. 0.01 to 0.1% sol.Al, 0.004% or less N, 0.003% or less O, 0.01 to 0.20% Nb, by weight; and satisfying the formulae (1), (2), (3), and (4);

$$-0.46-0.83\times\log[C]\leqq(Nb\times12)/(C\times93)\leqq-0.88-1.66\times\log[C] \quad (1)$$

$$10.8\geqq5.49\times\log[YP]-r \quad (2)$$

$$11.0\leqq r+50.0\times n \quad (3)$$

$$2.9\leqq r+5.00\times n \quad (4)$$

where, C and Nb denote the content (% by weight) of C and Nb, respectively, YP denotes the yield strength (MPa), r denotes the r value (average of r values determined at 0, 45, and 90 degrees to the rolling direction), and n denotes the n value (a value in a range of from 1 to 5% strain; average of n values determined at 0, 45, and 90 degrees to the rolling direction).

The Steel sheet 1 is manufactured by the steps of:

preparing a continuous casting slab of the steel which has the composition described above; preparing a hot rolled steel sheet by finish rolling the slab at temperatures of Ar3 transformation temperature or more; coiling the hot rolled steel sheet at temperatures not less than 540° C.; and cold rolling the coiled hot rolled steel sheet at reduction ratios of from 50 to 85%, followed by continuously annealing thereof at temperatures of from 680 to 880° C.

Steel sheet 2 according to the present invention is a high strength cold rolled steel sheet consisting essentially of 0.0040 to 0.01% C., 0.05% or less Si, 0.1 to 1.0% Mn, 0.01 to 0.05% P, 0.02% or less S, 0.01 to 0.1% sol.Al, 0.004% or less N, 0.01 to 0.14% Nb, by weight, and balance of substantially Fe and inevitable impurities; and having 0.21 or more n value which is calculated from two points of nominal strain, at 1% and 10%, observed in a uniaxial tensile test.

Steel sheet 3 according to the present invention is a high strength cold rolled steel sheet consisting essentially of 0.0040 to 0.01% C., 0.05% or less Si, 0.1 to 1.0% Mn, 0.01 to 0.05% P, 0.02% or less S, 0.01 to 0.1% sol.Al, 0.004% or less N, 0.15% or less Nb, by weight, and balance of substantially Fe and inevitable impurities; satisfying the formula (6); and having 0.21 or more n value which is calculated from two points of nominal strain, at 1% and 10%, observed in a uniaxial tensile test;

$$(12/93)\times Nb^*/C\geqq1.2 \quad (6)$$

where, $Nb^*=Nb-(93/14)\times N$, and C, N, and Nb denote the content (% by weight) of C, N, and Nb, respectively.

The Steel sheet 3 is manufactured by the steps of: preparing a continuous casting slab of a steel which has the composition described above; preparing a hot rolled steel sheet by finish rolling the slab at temperatures of Ar3 transformation temperature or more; coiling the hot rolled steel sheet at temperatures of from 500 to 700° C.; and cold rolling the coiled steel sheet, followed by annealing thereof.

Steel sheet 4 according to the present invention is a high strength cold rolled steel sheet consisting essentially of 0.0040 to 0.01% C., 0.05% or less Si, 0.1 to 1.0% Mn, 0.01 to 0.05% P, 0.02% or less S, 0.01 to 0.1% sol.Al, 0.004% or less N, 0.01 to 0.14% Nb, by weight, and balance of substantially Fe and inevitable impurities; and satisfying the formulae (6) and (7);

$$(12/93)\times Nb^*/C \geqq 1.2 \quad (6)$$

$$TS-4050\times Ceq \geqq -0.75\times TS+380 \quad (7)$$

where, Ceq=C+(1/50)×Si+(1/25)×Mn+(1/2)×P, TS denotes the tensile strength (MPa), and C, Si, Mn, P, N, and Nb denote the content (% by weight) of C, Si, Mn, P, N, and Nb, respectively.

Steel sheet 5 according to the present invention is a high strength cold rolled steel sheet consisting essentially of: 0.004 to 0.01% C., 0.05% or less P, 0.02% or less S, 0.01 to 0.1% sol.Al, 0.004% or less N, 0.03% or less Ti, by weight, and Nb as an amount satisfying the formula (8); 0.03 to 0.1% of a volumetric proportion of NbC; and 70% or more thereof being 10 to 40 nm in size;

$$1 \leqq (93/12)\times(Nb/C) \leqq 2.5 \quad (8)$$

where, C and Nb denote the content (% by weight) of C and Nb, respectively.

The Steel sheet 5 is manufactured by the steps of: preparing a continuous casting slab of a steel which has the composition described above; preparing a hot rolled steel sheet by finish rolling the slab at reduction ratios satisfying the formulae (9) through (11); and cold rolling the hot rolled sheet, followed by annealing thereof;

$$10 \leqq HR1 \quad (9)$$

$$2 \leqq HR2 \leqq 30 \quad (10)$$

$$HR1 30\ HR2-HR1\times HR2/100 \leqq 60 \quad (11)$$

where, HR1 and HR2 denote the reduction ratio (%) in the finish rolling at the pass just before the final pass and at the final pass, respectively.

Steel sheet 6 according to the present invention is a high strength cold rolled steel sheet consisting essentially of 0.0040 to 0.010% C, 0.05% or less S, 0.10 to 1.5% Mn, 0.01 to 0.05% P, 0.02% or less Si, 0.01 to 0.1% sol.Al, 0.00100 or less N, 0.036 to 0.14% Nb, by weight; satisfying the formula (12); giving 10 $\mu$m or less average grain size and 1.8 or more r value:

$$1.1 < (Nb\times 12)/(C\times 93) < 2.5 \quad (12)$$

where, C and Nb denote the content (% by weight) of C and Nb, respectively.

The Steel sheet 6 is manufactured by the steps of: preparing a continuous casting slab of a steel which has the composition described above; preparing a sheet bar by either directly rolling the slab or heating the slab to temperatures of from 1100 to 1250° C. followed by rough rolling; finish rolling the sheet bar at 10 to 40% of total reduction ratios of the pass just before the final pass and the final pass to produce a hot rolled steel sheet; coiling the hot rolled steel sheet at cooling speeds of 15° C./sec or more to temperatures below 700° C., followed by coiling at temperatures of from 620 to 670° C.; cold rolling the coiled hot rolled steel sheet at 50% or more reduction ratios, followed by heating the steel sheet at 20° C./sec or more heating speeds, then annealing the steel sheet at temperatures between 860° C. and Ac3 transformation temperature; and temper rolling the annealed steel sheet at 0.4 to 1.0% reduction ratios.

Steel sheet 7 according to the present invention is a high strength cold rolled steel sheet consisting essentially of more than 0.0050% and not more than 0.010% C, 0.05% or less Si, 0.10 to 1.5% Mn, 0.01 to 0.05% P, 0.02% or less S, 0.01 to 0.1% sol.Al, 0.004% or less N, 0.01 to 0.20% Nb, by weight; and satisfying the formulae (3), (4), (14);

$$11.0 \leqq r+50.0\times n \quad (3)$$

$$2.9 \leqq r+5.00\times n \quad (4)$$

$$1.98-66.3\times C \leqq (Nb\times 12)/(C\times 93) \leqq 3.24-80.0\times C \quad (14)$$

where, C and Nb denote the content (% by weight) of C and Nb, respectively.

The Steel sheet 7 is manufactured by the steps of: preparing a continuous casting slab of a steel which has the composition described above; preparing a coiled hot rolled steel sheet by finish rolling the slab at 60% or less total reduction ratios of the pass just before the final pass and the final pass; cold rolling the hot rolled steel sheet, followed by annealing thereof.

BEST MODE FOR CARRYING OUT THE INVENTION

Best Mode 1

Figure 1:
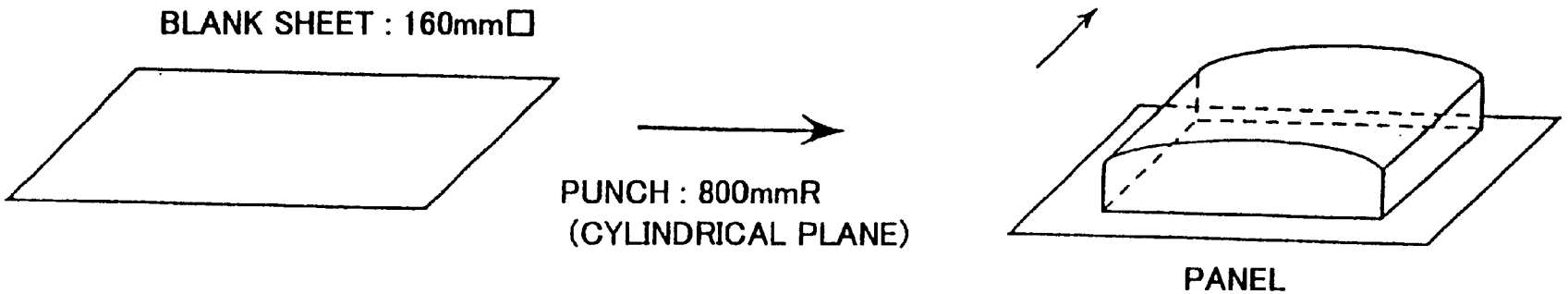
FIG. 1 shows the shape of a panel used for evaluation of the resistance to surface strain.

The above-described Steel sheet 1 according to the present invention is a steel sheet having particularly superior combined formability. The detail of Steel sheet 1 is described in the following.

Carbon: Carbon forms a fine carbide with niobium to increase the strength of the steel and to increase the n value in low strain domains, thus improves the resistance to surface strain. If the carbon content is less than 0.0040%, the effect of carbon addition becomes less. If the carbon content exceeds 0.010%, the ductility of steel degrades. Accordingly, the carbon content is specified to a range of from 0.0040 to 0.010%, preferably from 0.0050 to 0.0080%, most preferably from 0.0050 to 0.0074%.

Silicon: Excessive addition of silicon degrades the chemical treatment performance of cold rolled steel sheets and degrades the zinc plating adhesiveness on hot dip galvanized steel sheets. Therefore, the silicon content is specified to not more than 0.05%.

Manganese: Manganese precipitates sulfur in the steel as MnS to prevent the hot crack generation of slabs and to bring the steel to high strength without degrading the zinc plating adhesiveness. If the manganese content is less than 0.10%, the precipitation of sulfur does not appear. If the manganese content exceeds 1.20%, the yield strength significantly increases and the n value in low strain domains decreases. Consequently, the manganese content is specified to a range of from 0.10 to 1.20%.

Phosphorus: Phosphorus is necessary for increasing strength of the steel, to amounts of 0.01% or more. If the phosphorus content exceeds 0.05%, however, the alloying treatment performance of zinc plating degrades, and insufficient plating adhesion is generated. Accordingly, the phosphorus content is specified to a range of from 0.01 to 0.05%.

Sulfur: If sulfur content exceeds 0.02%, the ductility of steel becomes low. Therefore, the sulfur content is specified to not more than 0.02%.

sol.Al: A function of sol.Al is to precipitate nitrogen in steel as AlN for reducing the adverse effect of solid solution nitrogen. If the sol.Al content is below 0.01%, the effect is not satisfactory. If the sol.Al content exceeds 0.1%, the effect for the addition of sol.Al cannot increase anymore. Consequently, the sol.Al content is specified to a range of from 0.01 to 0.1%.

Nitrogen: Nitrogen content is preferred as small as possible. From the viewpoint of cost, the nitrogen content is specified to not more than 0.004%.

Oxygen: Oxygen forms oxide base inclusions to interfere the grain growth during annealing step, thus degrading the formability. Therefore, the oxygen content is specified to not more than 0.003%. To attain the oxygen content of not more than 0.003%, the oxygen pickup on and after the outside-furnace smelting should be minimized.

Niobium: Niobium forms fine carbide with carbon to strengthen the steel and to increase the n value in low strain domains, thus improves the resistance to surface strain. If the niobium content is less than 0.01%, the effect cannot be obtained. If the niobium content exceeds 0.20%, the yield strength significantly increases and the n value in low strain domains decreases. Therefore, the niobium content is specified to a range of from 0.01 to 0.20%, preferably from 0.035 to 0.20%, and more preferably from 0.080 to 0.140%.

Solely specifying the individual components of steel cannot lead to high strength cold rolled steel sheets having excellent combined formability characteristics such as deep drawability, punch stretchability, and resistance to surface strain. To obtain that type of high strength cold rolled steel sheets, the following-described conditions are further requested.

For evaluating the resistance to surface strain, cold rolled steel sheets consisting essentially of 0.0040 to 0.010% C, 0.01 to 0.02% Si, 0.15 to 1.0% Mn, 0.02 to 0.04% P, 0.005 to 0.015% S, 0.020 to 0.070% sol.Al, 0.0015 to 0.0035% N, 0.0015 to 0.0025% O, 0.04 to 0.17% Nb, by weight, and having a thickness of 0.8 mm were used to form panels in a shape shown in FIG. 1, then the difference of waving height ($W_{ca}$) along the wave center line before and after the forming, or $\Delta W_{ca}$, was determined.

Figure 2:
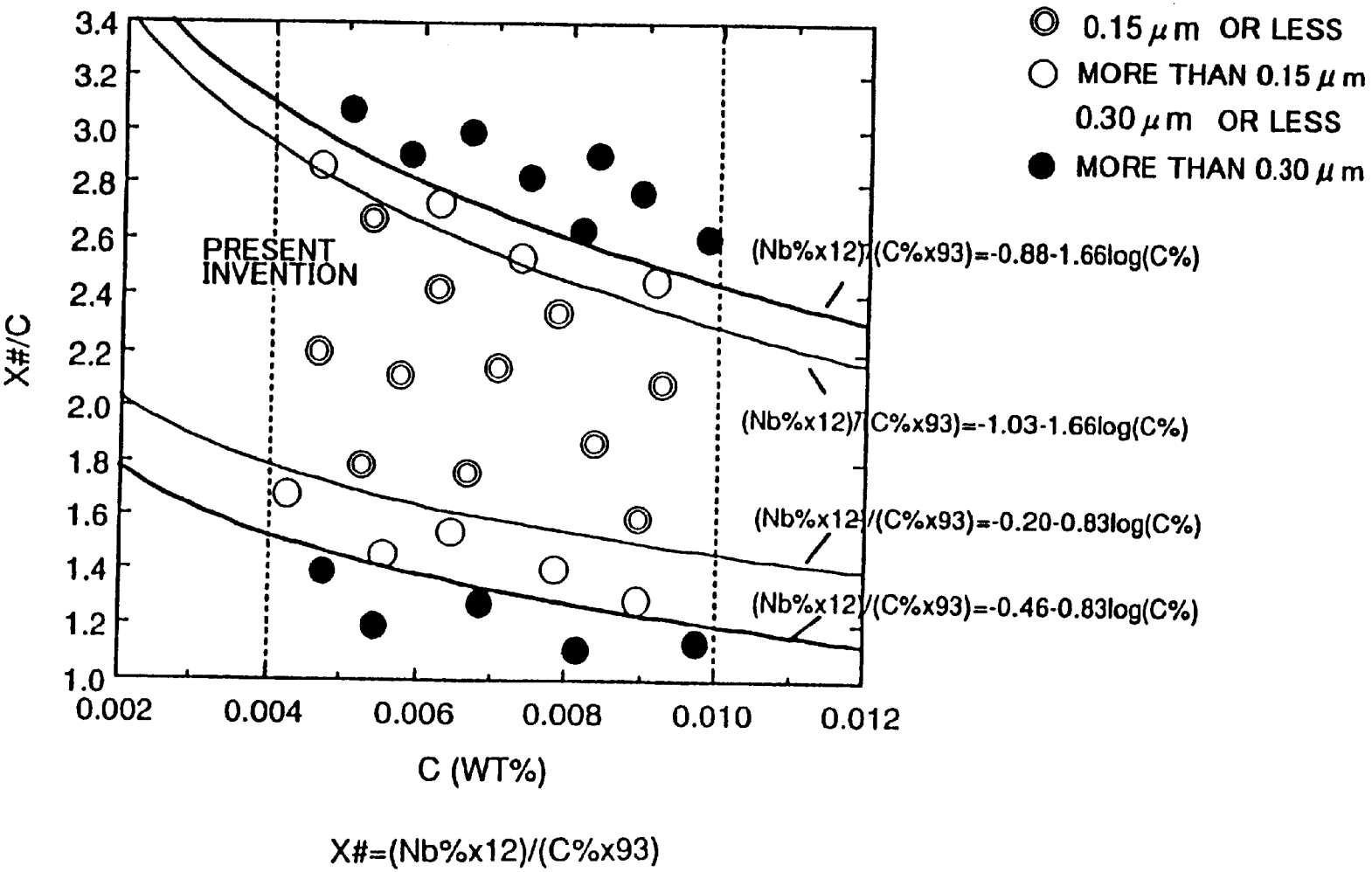
FIG. 2 shows the influence of [(Nb×12)/(C×93)] on the waving height difference ($\Delta W_{ca}$) before and after forming.

FIG. 2 shows the influence of [(Nb×12)/(C×93)] on the waving height difference ($\Delta W_{ca}$) before and after forming.

If [(Nb×12)/(C×93)] satisfies the formula (1), ($\Delta W_{ca}$) becomes 2 $\mu$m or less, and excellent resistance to surface strain appears.

$$-0.46-0.83\times\log[C]\leqq(Nb\times12)/(C\times93)\leqq-0.88-1.66\times\log[C] \quad (1)$$

For evaluating the resistance to surface strain, the investigation should be given not only to the above-described waving height but also to the plastic buckling which is likely generated in side panels or the like.

Figure 3:
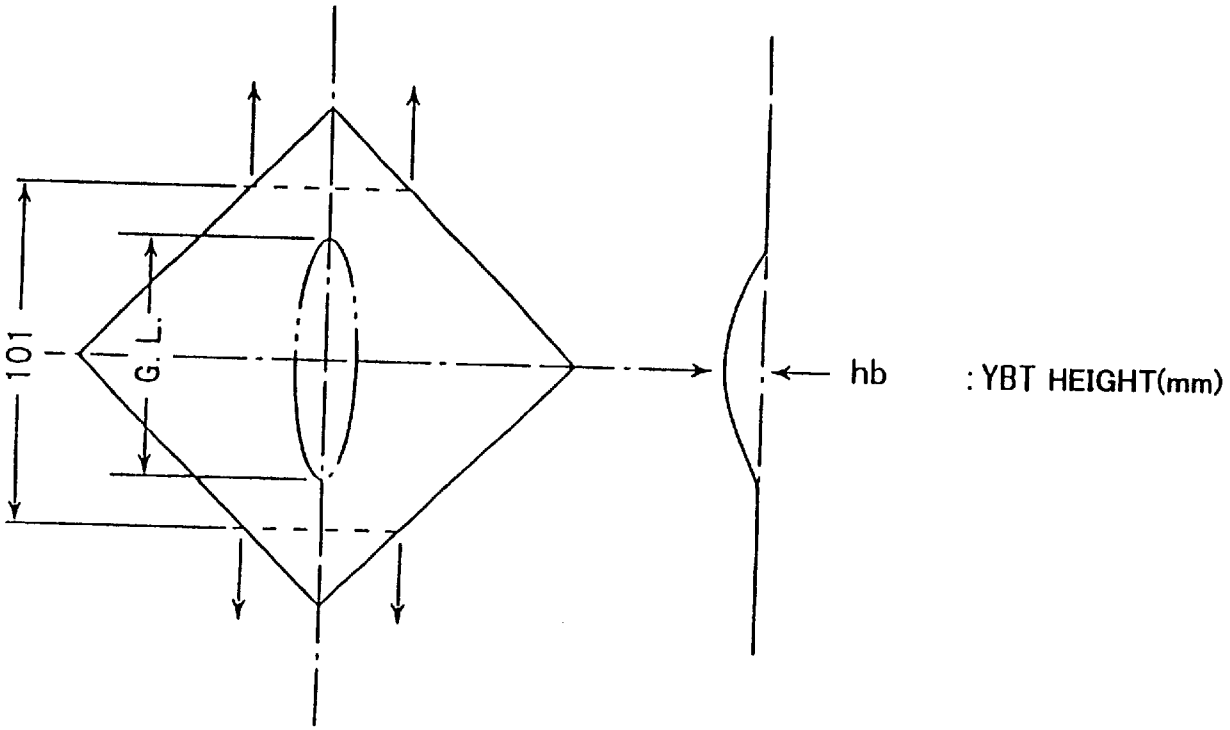
FIG. 3 shows the method of Yoshida buckling test.

In this regard, the resistance to surface strain against plastic buckling was evaluated. The above-described steel sheets were subjected to the Yoshida buckling test shown in FIG. 3. That is, a specimen was drawn in a tensile tester with a chuck distance of 101 mm to the arrow direction given in the figure to induce a specified strain ($\lambda$=1%) onto the gauge length section (GL=75 mm), then the load was removed, and the residual plastic buckling height (YBT) was determined. The measurement was given in the lateral direction to the tensile direction using a curvature meter having 50 mm span.

Figure 4:
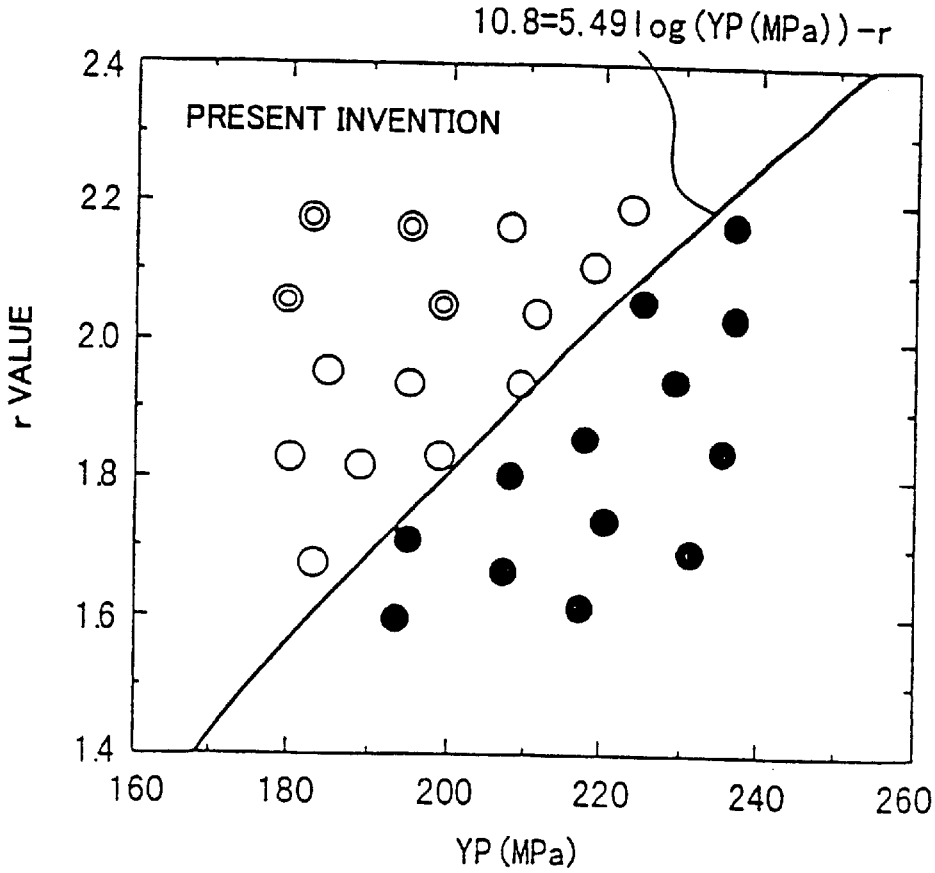
FIG. 4 shows the influence of YP and r values on the plastic buckling height (YBT).

FIG. 4 shows the influence of YP and r values on the plastic buckling height (YBT).

In the case that the relation between YP and r values satisfied the formula (2), the plastic buckling height (YBT) became 1.5 mm or less, which is equivalent to or more than that of JSC270F, showing excellent resistance to surface strain also to the plastic buckling.

$$10.8\geqq5.49\times\log[YP]-r \quad (2)$$

Figure 5:
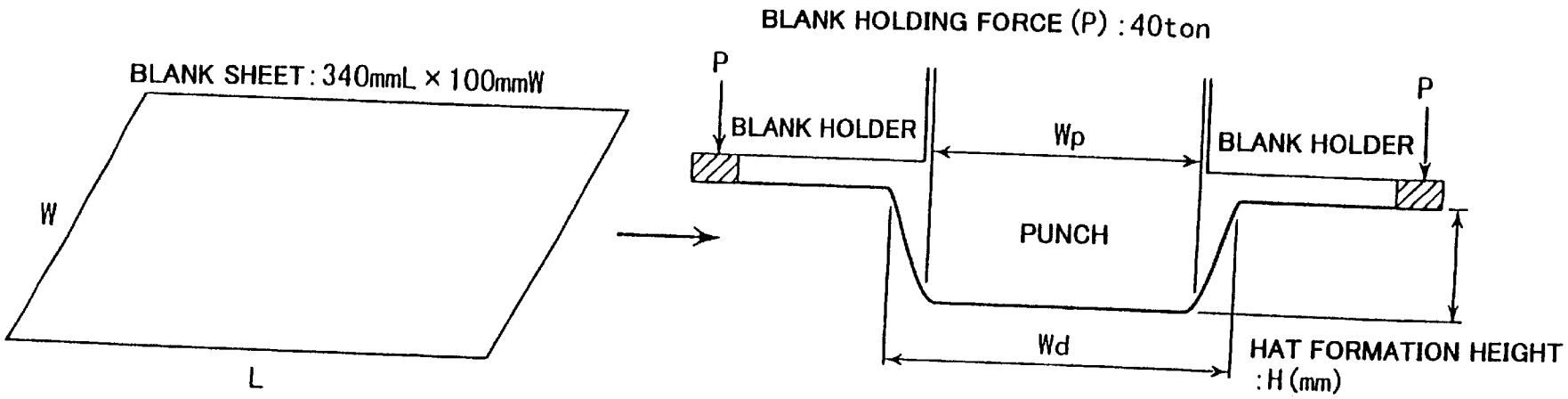
FIG. 5 shows the method of Hat type forming test.

Then, the above-described cold rolled steel sheets were used for evaluating the deep drawability based on the limit drawing ratio (LDR) in cylinder forming at 50 mm diameter, and evaluating the punch stretchability based on the hat formation height after the hat type forming test shown in FIG. 5. The hat forming test was conducted under the conditions of: blank sheet having a size of 340 mm L×100 mm W; 100 mm of punch width ($W_p$); 103 mm of die width ($W_d$); and 40 ton of blank holding force (P).

Figure 6:
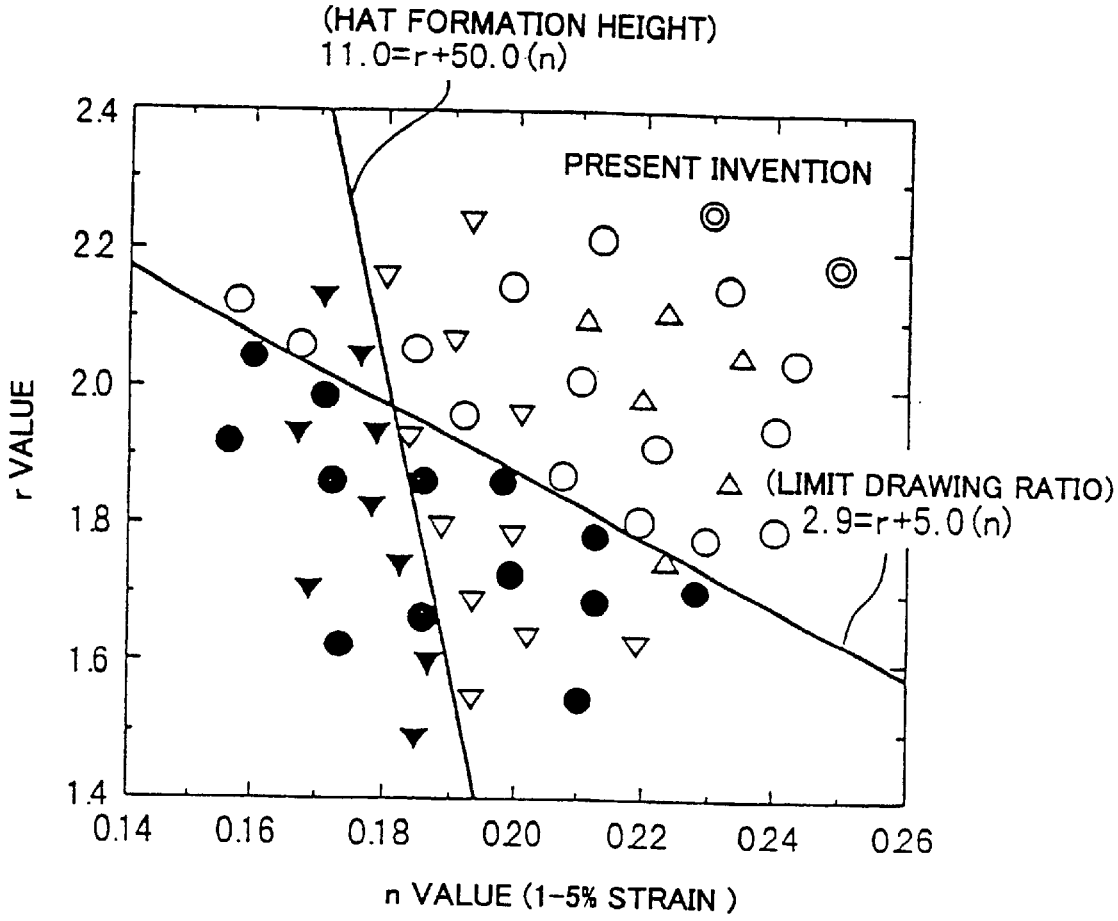
FIG. 6 shows the influence of r values and n values on the deep drawability and the punch stretchability.

FIG. 6 shows the influence of r values and n values on the deep drawability and the punch stretchability, where, n value is determined from low strain 1 to 5% domain based on the reason described below. FIG. 8 shows an example of equivalent strain distribution in the vicinity of a possible fracture section on the formed model of front fender given in FIG. 7. The strain generated at bottom section of punch is 1 to 5%. To avoid concentration of strain to portions possible of fracturing, for example, on side wall sections, the plastic flow at the punch bottom section with low strain should be enhanced.

As shown in FIG. 6, when the relation between r value and n value satisfies the formulae (3) and (4), there obtained limit drawing ratio (LDR) and hat formation height, equivalent to or higher than those of JSC270F, thus providing excellent deep drawability and punch stretchability.

$$11.0 \leqq r + 50.0 \times n \quad (3)$$

$$2.9 \leqq r + 5.00 \times n \quad (4)$$

To Steel sheet 1 according to the present invention, titanium may be added for improving the resistance to surface strain. If the titanium content exceeds 0.05%, the surface appearance after hot dip galvanizing significantly degrades. Therefore, the titanium content is specified to not more than 0.05%, preferably from 0.005 to 0.02%. In that case, the formula (5) should be used instead of the formula (1).

$$-0.46-0.83\times\log[C] \leqq (Nb\times12)/(C\times93)+(Ti^*\times12)/(C\times48) \leqq -0.88-1.66\times\log[C] \quad (5)$$

Furthermore, addition of boron is effective to improve the resistance to embrittlement during secondary operation. If the boron content exceeds 0.002%, the deep drawability and the punch stretchability degrade. Accordingly, the boron content is specified to not more than 0.002%, preferably from 0.0001 to 0.001%.

The Steel sheet 1 according to the present invention has characteristics of, adding to the excellent combined formability, excellent resistance to embrittlement during secondary operation, formability at welded portions, anti-burring performance during shearing, good surface appearance, uniformity of material in a coil, which characteristics are applicable grades to the automobile exterior panels.

The Steel sheet 1 according to the present invention can be manufactured by the steps of: preparing a continuous casting slab of a steel having the composition adjusted as described above, including the addition of titanium and boron; preparing a hot rolled steel sheet by finish rolling the slab at temperatures of Ar3 transformation temperature or more; coiling the hot rolled steel sheet at temperatures not less than 540° C.; and cold rolling the coiled hot rolled steel sheet at reduction ratios of from 50 to 85%, followed by continuously annealing thereof at temperatures of from 680 to 880° C.

The finish rolling is necessary to be conducted at temperatures not less than the Ar3 transformation temperature. If the finish rolling is done at temperatures below the Ar3 transformation temperature, the r value and the elongation significantly reduce. For attaining further elongation, the finish rolling is preferably conducted at temperatures of 900° C. or more. In the case that a continuous casting slab is hot rolled, the slab may be directly rolled or rolled after reheated.

The coiling is necessary to be conducted at temperatures of 540° C. or more, preferably 600° C. or more, to enhance the formation of precipitates and to improve the r value and the n value. From the viewpoint of descaling property by pickling and of stability of material, it is preferred to conduct the coiling at temperatures of 700° C. or less, more preferably 680° C. or less. In the case to let the carbide grow to some extent not to give bad influence to the formation of recrystallization texture, followed by continuously annealing, the coiling is preferably done at temperatures of 600° C. or more.

The reduction ratios during cold rolling are from 50 to 85% to obtain high r values and n values.

The annealing is necessary to be conducted at temperatures of from 680 to 880° C. to enhance the growth of ferritic grains to give high r value, and to form less dense precipitates zones (PZF) at grain boundaries than inside of grains to attain high n value. In the case of box annealing, temperatures of from 680 to 850° C. are preferred. In the case of continuous annealing, temperatures of from 780 to 880° C. are preferred.

The Steel sheet 1 according to the present invention may further be treated, at need, by zinc base plating treatment such as electroplating and hot dip plating, and by organic coating treatment after the plating.

EXAMPLE 1

Molten steels of Steel Nos. 1 through 29 shown in Table 1 were prepared. The melts were then continuously cast to form slabs having 220 mm of thickness. After heating the slabs to 1200° C., hot rolled steel sheets having 2.8 mm of thickness were prepared from the slabs under the condition of 880 to 910° C. of finish temperatures, and 540 to 560° C. of coiling temperatures for box annealing and 600 to 680° C. for continuous annealing or for continuous annealing followed by hot dip galvanization. The hot rolled sheets were then cold rolled to 0.80 mm of thickness. The cold rolled sheets were treated either by continuous annealing (CAL) at temperatures of from 840 to 860° C., or by box annealing (BAF) at temperatures of from 680 to 720° C., or by continuous annealing at temperatures of from 850 to 860° C. followed by hot dip galvanization (CGL), which were then temper-rolled to 0.7% of reduction ratio.

In the case of continuous annealing followed by hot dip galvanization, the hot dip galvanization after the annealing was given at 460° C., and, immediately after the hot dip galvanization, an alloying treatment of plating layer was given at 500° C. in an in-line alloying furnace. The coating weight was 45 g/m$^2$ per side.

Thus obtained steel sheets were tested to determine mechanical characteristics (along the rolling direction; with JIS Class 5 specimens; and n values being computed in a 1 to 5% strain domain), surface strain ($\Delta W_{ca}$, YBT), limit drawing ratio (LDR), and hat forming height (H).

The test results are shown in Tables 3 and 4.

Examples 1 through 24 which satisfy the above-given formulae (1) through (4) or (5) revealed that they are high strength cold rolled steel sheets having around 350 MPa of tensile strength, and providing excellent combined forming characteristics and zinc plating performance.

On the other hand, Comparative Examples 25 through 44 have no superior combined formability characteristics, and, in the case that silicon, phosphorus, and titanium are outside of the range according to the present invention, the zinc plating performance also degrades.

EXAMPLE 2

Molten steel of Steel No. 1 shown in Table 1 was prepared. The melt was then continuously cast to form slabs having 220 mm of thickness. After heating the slabs to 1200°

C., hot rolled steel sheets having 1.3 to 6.0 mm of thicknesses were prepared from the slabs under the condition of 800 to 950° C. of finish temperatures, and 500 to 680° C. of coiling temperatures. The hot rolled sheets were then cold rolled to 0.8 mm of thickness at 46 to 87% of reduction ratios. The cold rolled sheets were treated either by continuous annealing at temperatures of from 750 to 900° C., or by continuous annealing followed by hot dip galvanization, which was then temper-rolled to 0.7% of reduction ratio.

In the case of continuous annealing followed by hot dip galvanization, the plating was conducted under similar condition with that of Example 1.

Thus prepared steel sheets were tested by similar procedure with that of Example 1.

The test results are shown in Table 5.

Examples 1A through 1D which satisfy the manufacturing conditions according to the present invention or the above-given formulae (1) through (4) or (5) revealed that they are high strength cold rolled steel sheets having around 350 MPa of tensile strength, and providing excellent combined forming characteristics.

TABLE 1

| Steel No. | C | Si | Mn | P | S | sol.Al | N | Nb | Ti | B | O | X/C# | Remarks |
|---|---|---|---|---|---|---|---|---|---|---|---|---|---|
| 1 | 0.0059 | 0.01 | 0.34 | 0.019 | 0.011 | 0.050 | 0.0021 | 0.082 | tr | tr | 0.0020 | 1.8 | Example Steel |
| 2 | 0.0096 | 0.02 | 0.15 | 0.020 | 0.009 | 0.055 | 0.0020 | 0.112 | tr | tr | 0.0022 | 1.5 | Example Steel |
| 3 | 0.0042 | 0.02 | 0.30 | 0.040 | 0.007 | 0.060 | 0.0018 | 0.068 | tr | tr | 0.0019 | 2.1 | Example Steel |
| 4 | 0.0070 | 0.04 | 0.21 | 0.025 | 0.010 | 0.058 | 0.0021 | 0.109 | tr | tr | 0.0017 | 2.0 | Example Steel |
| 5 | 0.0056 | 0.01 | 0.67 | 0.018 | 0.012 | 0.052 | 0.0008 | 0.082 | tr | tr | 0.0025 | 1.9 | Example Steel |
| 6 | 0.0061 | 0.02 | 0.12 | 0.033 | 0.009 | 0.048 | 0.0022 | 0.080 | tr | tr | 0.0017 | 1.7 | Example Steel |
| 7 | 0.0074 | 0.01 | 0.23 | 0.044 | 0.010 | 0.040 | 0.0018 | 0.081 | tr | tr | 0.0023 | 1.4 | Example Steel |
| 8 | 0.0068 | 0.01 | 0.20 | 0.012 | 0.012 | 0.066 | 0.0033 | 0.095 | tr | tr | 0.0025 | 1.8 | Example Steel |
| 9 | 0.0081 | 0.02 | 0.17 | 0.022 | 0.018 | 0.058 | 0.0028 | 0.100 | tr | tr | 0.0021 | 1.6 | Example Steel |
| 10 | 0.0056 | 0.02 | 0.28 | 0.031 | 0.008 | 0.090 | 0.0038 | 0.082 | tr | tr | 0.0020 | 1.9 | Example Steel |
| 11 | 0.0063 | 0.01 | 0.17 | 0.025 | 0.009 | 0.015 | 0.0017 | 0.098 | tr | tr | 0.0018 | 2.0 | Example Steel |
| 12 | 0.0080 | 0.01 | 0.20 | 0.023 | 0.012 | 0.054 | 0.0025 | 0.160 | tr | tr | 0.0024 | 2.6 | Example Steel |
| 13 | 0.0059 | 0.02 | 0.20 | 0.024 | 0.010 | 0.058 | 0.0019 | 0.082 | tr | tr | 0.0028 | 1.8 | Example Steel |
| 14 | 0.0078 | 0.01 | 0.21 | 0.028 | 0.009 | 0.058 | 0.0018 | 0.079 | tr | tr | 0.0020 | 1.3 | Example Steel |
| 15 | 0.0065 | 0.01 | 0.20 | 0.032 | 0.009 | 0.034 | 0.0020 | 0.091 | 0.011 | tr | 0.0018 | 1.8* | Example Steel |
| 16 | 0.0081 | 0.01 | 0.42 | 0.020 | 0.007 | 0.041 | 0.0017 | 0.092 | 0.024 | 0.0006 | 0.0020 | 1.7* | Example Steel |

X/C#: (Nb % × 12)/(C % × 93)
*(Nb % × 12)/(C % × 93) + (Ti* % × 12)/(C % × 48), Ti* % = Ti − (48/14)N % − (48/32)S %

TABLE 2

| Steel No. | C | Si | Mn | P | S | sol.Al | N | Nb | Ti | B | O | X/C# | Remarks |
|---|---|---|---|---|---|---|---|---|---|---|---|---|---|
| 17 | 0.0110 | 0.02 | 0.20 | 0.025 | 0.009 | 0.060 | 0.0021 | 0.128 | tr | tr | 0.0019 | 1.5 | Comparative Steel |
| 18 | 0.0035 | 0.02 | 0.32 | 0.030 | 0.010 | 0.054 | 0.0020 | 0.046 | tr | tr | 0.0018 | 1.7 | Comparative Steel |
| 19 | 0.0063 | 0.10 | 0.16 | 0.030 | 0.011 | 0.057 | 0.0019 | 0.088 | tr | tr | 0.0020 | 1.8 | Comparative Steel |
| 20 | 0.0065 | 0.01 | 1.50 | 0.020 | 0.008 | 0.045 | 0.0022 | 0.091 | tr | tr | 0.0019 | 1.8 | Comparative Steel |
| 21 | 0.0059 | 0.02 | 0.20 | 0.067 | 0.010 | 0.050 | 0.0021 | 0.087 | tr | tr | 0.0021 | 1.9 | Comparative Steel |
| 22 | 0.0062 | 0.02 | 0.23 | 0.024 | 0.003 | 0.061 | 0.0018 | 0.077 | tr | tr | 0.0018 | 1.6 | Comparative Steel |
| 23 | 0.0058 | 0.02 | 0.18 | 0.023 | 0.008 | 0.005 | 0.0019 | 0.076 | tr | tr | 0.0021 | 1.7 | Comparative Steel |
| 24 | 0.0060 | 0.01 | 0.22 | 0.030 | 0.011 | 0.058 | 0.0052 | 0.088 | tr | tr | 0.0023 | 1.9 | Comparative Steel |

TABLE 2-continued

| Steel No. | C | Si | Mn | P | S | sol.Al | N | Nb | Ti | B | O | X/C# | Remarks |
|---|---|---|---|---|---|---|---|---|---|---|---|---|---|
| 25 | 0.0090 | 0.02 | 0.21 | 0.032 | 0.010 | 0.055 | 0.0021 | 0.220 | tr | tr | 0.0018 | 3.2 | Comparative Steel |
| 26 | 0.0063 | 0.01 | 0.23 | 0.032 | 0.011 | 0.029 | 0.0021 | 0.093 | tr | tr | 0.0052 | 1.9 | Comparative Steel |
| 27 | 0.0074 | 0.01 | 0.22 | 0.030 | 0.009 | 0.056 | 0.0019 | 0.164 | tr | tr | 0.0021 | 2.9 | Comparative Steel |
| 28 | 0.0077 | 0.01 | 0.21 | 0.028 | 0.010 | 0.057 | 0.0020 | 0.072 | tr | tr | 0.0017 | 1.2 | Comparative Steel |
| 29 | 0.0090 | 0.01 | 0.62 | 0.050 | 0.015 | 0.035 | 0.0036 | 0.126 | tr | tr | 0.0026 | 1.8 | Comparative Steel |

X/C#: (Nb % × 12)/(C % × 93)

TABLE 3

| | | | Characteristics of steel sheet | | | | | | | | Panel shape after pressed | | | Formability of steel sheet | | |
|---|---|---|---|---|---|---|---|---|---|---|---|---|---|---|---|---|
| No. | Steel No. | Annealing condition | YP (MPa) | TS (MPa) | El (%) | n value | r value | Y** | Z*** | V**** | Surface strain | ΔWca (μm) | YBT (mm) | H (mm) | LDR | Remarks |
| 1 | 1 | CAL | 202 | 351 | 45 | 0.197 | 2.02 | 10.64 | 11.9 | 3.0 | None | 0.24 | 1.25 | 34.4 | 2.16 | Example |
| 2 | 1 | BAF | 194 | 348 | 46 | 0.204 | 2.20 | 10.36 | 12.4 | 3.2 | None | 0.18 | 0.88 | 35.3 | 2.18 | Example |
| 3 | 1 | CGL | 205 | 354 | 44 | 0.194 | 2.02 | 10.67 | 11.7 | 3.0 | None | 0.20 | 1.31 | 34.2 | 2.16 | Example |
| 4 | 2 | CAL | 211 | 364 | 42 | 0.192 | 1.98 | 10.78 | 11.6 | 2.9 | None | 0.26 | 1.41 | 34.0 | 2.15 | Example |
| 5 | 2 | CGL | 213 | 368 | 42 | 0.189 | 1.98 | 10.80 | 11.4 | 2.9 | Within allowable range | 0.27 | 1.41 | 33.6 | 2.15 | Example |
| 6 | 3 | CAL | 195 | 340 | 45 | 0.195 | 2.00 | 10.57 | 11.8 | 3.0 | Within allowable range | 0.27 | 1.25 | 34.3 | 2.16 | Example |
| 7 | 3 | CGL | 191 | 346 | 44 | 0.192 | 1.97 | 10.55 | 11.6 | 2.9 | Within allowable range | 0.26 | 1.22 | 34.0 | 2.15 | Example |
| 8 | 4 | CAL | 200 | 357 | 45 | 0.198 | 2.05 | 10.58 | 12.0 | 3.0 | None | 0.23 | 1.23 | 34.6 | 2.16 | Example |
| 9 | 5 | CGL | 218 | 368 | 43 | 0.190 | 2.11 | 10.73 | 11.6 | 3.1 | None | 0.20 | 1.38 | 34.0 | 2.17 | Example |
| 10 | 6 | CGL | 188 | 342 | 46 | 0.216 | 2.15 | 10.34 | 13.0 | 3.2 | None | 0.16 | 0.80 | 36.0 | 2.18 | Example |
| 11 | 7 | CAL | 214 | 366 | 44 | 0.193 | 2.20 | 10.59 | 11.9 | 3.2 | None | 0.25 | 1.20 | 34.4 | 2.18 | Example |
| 12 | 7 | CGL | 218 | 369 | 44 | 0.188 | 2.17 | 10.67 | 11.6 | 3.1 | None | 0.22 | 1.30 | 34.0 | 2.17 | Example |
| 13 | 8 | CGL | 186 | 340 | 43 | 0.218 | 1.98 | 10.48 | 12.9 | 3.1 | None | 0.16 | 1.02 | 35.8 | 2.17 | Example |
| 14 | 9 | CAL | 198 | 354 | 42 | 0.195 | 2.01 | 10.60 | 11.8 | 3.0 | None | 0.20 | 1.21 | 34.3 | 2.16 | Example |
| 15 | 10 | CGL | 195 | 358 | 45 | 0.204 | 2.13 | 10.44 | 12.3 | 3.2 | None | 0.21 | 0.98 | 35.0 | 2.18 | Example |
| 16 | 11 | CGL | 204 | 358 | 43 | 0.193 | 1.96 | 10.72 | 11.6 | 2.9 | None | 0.20 | 1.38 | 34.0 | 2.15 | Example |
| 17 | 12 | CAL | 211 | 362 | 42 | 0.194 | 2.00 | 10.76 | 11.7 | 3.0 | Within allowable range | 0.28 | 1.41 | 34.2 | 2.16 | Example |
| 18 | 12 | BAF | 208 | 351 | 43 | 0.204 | 2.12 | 10.61 | 12.3 | 3.1 | Within allowable range | 0.27 | 1.22 | 35.3 | 2.17 | Example |
| 19 | 12 | CGL | 211 | 358 | 42 | 0.192 | 1.97 | 10.79 | 11.6 | 2.9 | Within allowable range | 0.29 | 1.48 | 34.0 | 2.15 | Example |
| 20 | 13 | CAL | 218 | 353 | 44 | 0.196 | 2.05 | 10.79 | 11.9 | 3.0 | None | 0.21 | 1.48 | 34.4 | 2.16 | Example |
| 21 | 14 | CAL | 207 | 353 | 43 | 0.189 | 1.97 | 10.74 | 11.4 | 2.9 | Within allowable range | 0.28 | 1.40 | 33.6 | 2.15 | Example |
| 22 | 14 | BAF | 200 | 349 | 44 | 0.200 | 2.05 | 10.58 | 12.1 | 3.1 | Within allowable range | 0.27 | 1.17 | 34.8 | 2.17 | Example |
| 23 | 15 | CGL | 197 | 356 | 45 | 0.203 | 2.12 | 10.48 | 12.3 | 3.1 | None | 0.19 | 1.02 | 35.3 | 2.17 | Example |
| 24 | 16 | CAL | 208 | 358 | 42 | 0.192 | 1.97 | 10.76 | 11.6 | 2.9 | Within allowable range | 0.29 | 1.41 | 34.0 | 2.15 | Example |

Y** = 5.49log (YP(MPa)) − r
Z*** = r + 50.0 (n)
V*** = r + 5.0 (n)
# caused from plating properties

TABLE 4

| No. | Steel No. | Annealing condition | Characteristics of steel sheet: YP (MPa) | TS (MPa) | El (%) | n value | r value | Y** | Z*** | V**** | Panel shape after pressed: Surface strain | ΔWca (μm) | YBT (mm) | Formability of steel sheet: H (mm) | LDR | Remarks |
|---|---|---|---|---|---|---|---|---|---|---|---|---|---|---|---|---|
| 25 | 17 | CAL | 206 | 359 | 34 | 0.196 | 1.64 | 11.06 | 11.4 | 2.6 | None | 0.23 | 1.87 | 33.6 | 2.04 | Comparative Example |
| 26 | 17 | CGL | 209 | 360 | 32 | 0.193 | 1.62 | 11.12 | 11.3 | 2.6 | None | 0.21 | 1.96 | 33.5 | 2.04 | Comparative Example |
| 27 | 18 | CAL | 186 | 319 | 43 | 0.166 | 2.00 | 10.46 | 10.3 | 2.8 | None | 0.42 | 1.01 | 25.5 | 2.07 | Comparative Example |
| 28 | 18 | CGL | 182 | 314 | 44 | 0.169 | 1.98 | 10.43 | 10.4 | 2.8 | None | 0.39 | 0.96 | 26.2 | 2.07 | Comparative Example |
| 29 | 19 | CAL | 203 | 348 | 45 | 0.197 | 2.01 | 10.66 | 11.9 | 3.0 | Exists # | 0.58#2 | 1.30 | 34.4 | 2.16 | Comparative Example |
| 30 | 20 | CGL | 238 | 371 | 39 | 0.156 | 1.84 | 11.21 | 9.6 | 2.6 | Exists | 0.66 | 2.10 | 22.5 | 2.04 | Comparative Example |
| 31 | 21 | CGL | 246 | 384 | 36 | 0.149 | 1.98 | 11.15 | 9.4 | 2.7 | Exists # | 0.74#2 | 2.00 | 21.8 | 2.05 | Comparative Example |
| 32 | 22 | CGL | 207 | 358 | 34 | 0.175 | 1.67 | 11.04 | 10.4 | 2.5 | Within allowable range | 0.46 | 1.83 | 26.2 | 2.03 | Comparative Example |
| 33 | 23 | CAL | 233 | 357 | 31 | 0.138 | 1.38 | 11.62 | 8.3 | 2.1 | Exists | 0.83 | 2.71 | 20.3 | 1.99 | Comparative Example |
| 34 | 24 | CAL | 242 | 350 | 33 | 0.134 | 1.42 | 11.67 | 8.1 | 2.1 | Exists | 0.79 | 2.79 | 20.1 | 1.99 | Comparative Example |
| 35 | 25 | CAL | 238 | 367 | 32 | 0.142 | 1.87 | 11.18 | 9.0 | 2.6 | Exists | 0.56 | 2.06 | 21.0 | 2.04 | Comparative Example |
| 36 | 26 | BAF | 226 | 361 | 34 | 0.153 | 1.91 | 11.01 | 9.6 | 2.7 | Exists | 0.45 | 1.80 | 22.5 | 2.05 | Comparative Example |
| 37 | 26 | CGL | 234 | 355 | 36 | 0.148 | 1.46 | 11.55 | 8.9 | 2.2 | Exists | 0.72 | 2.60 | 20.9 | 2.00 | Comparative Example |
| 38 | 27 | CAL | 208 | 354 | 27 | 0.168 | 1.86 | 10.87 | 10.3 | 2.7 | Within allowable range | 0.42 | 1.62 | 25.5 | 2.05 | Comparative Example |
| 39 | 27 | BAF | 201 | 351 | 29 | 0.201 | 1.95 | 10.69 | 12.0 | 3.0 | None | 0.40 | 1.34 | 34.6 | 2.16 | Comparative Example |
| 40 | 27 | CGL | 218 | 357 | 25 | 0.159 | 1.77 | 11.07 | 9.7 | 2.6 | Exists | 0.45 | 1.81 | 22.7 | 2.04 | Comparative Example |
| 41 | 28 | CAL | 210 | 353 | 26 | 0.167 | 1.79 | 10.96 | 10.1 | 2.6 | Within allowable range | 0.51 | 1.72 | 24.0 | 2.04 | Comparative Example |
| 42 | 28 | BAF | 203 | 351 | 27 | 0.171 | 1.99 | 10.68 | 10.5 | 2.8 | None | 0.46 | 1.32 | 27.0 | 2.07 | Comparative Example |
| 43 | 28 | CGL | 215 | 356 | 23 | 0.161 | 1.74 | 11.07 | 9.8 | 2.5 | Exists | 0.58 | 1.80 | 22.9 | 2.03 | Comparative Example |
| 44 | 29 | CAL | 231 | 371 | 32 | 0.164 | 2.02 | 10.96 | 10.2 | 2.8 | Exists | 0.36 | 1.72 | 24.8 | 2.07 | Comparative Example |

Y** = 5.49log (YP(MPa)) − r
Z*** = r + 50.0 (n)
V*** = r + 5.0 (n)
# caused from plating properties

TABLE 5

| No. | Steel No. | Annealing condition | Manufacturing condition: Finish temperature (° C.) | Coiling temperature (° C.) | Cold rolling reduction ratio (%) | Annealing temperature (° C.) | Characteristics of steel sheet: YP (MPa) | TS (MPa) | El (%) | n value | r value | Y** | Z*** | V**** |
|---|---|---|---|---|---|---|---|---|---|---|---|---|---|---|
| 1 | 1A | CAL | 900 | 640 | 71 | 850 | 202 | 351 | 45 | 0.197 | 2.02 | 10.6 | 11.9 | 3.0 |
| | 1B | CGL | 870 | 580 | 75 | 830 | 208 | 355 | 44 | 0.193 | 1.97 | 10.8 | 11.6 | 2.4 |
| | 1C | CGL | 890 | 680 | 68 | 810 | 210 | 360 | 43 | 0.191 | 1.95 | 10.8 | 11.5 | 2.3 |
| | 1D | CAL | 950 | 650 | 83 | 850 | 194 | 347 | 48 | 0.204 | 2.21 | 10.4 | 12.4 | 2.6 |
| | 1E | CAL | 800# | 640 | 71 | 840 | 227 | 366 | 27 | 0.148 | 1.58 | 11.4 | 9.0 | 1.9 |
| | 1F | CGL | 900 | 500 | 75 | 830 | 222 | 363 | 38 | 0.151 | 1.68 | 11.2 | 9.2 | 2.0 |
| | 1G | CGL | 890 | 640 | 46 | 860 | 206 | 344 | 44 | 0.187 | 1.57 | 11.1 | 10.9 | 1.9 |
| | 1H | CAL | 910 | 630 | 87 | 830 | 231 | 367 | 42 | 0.164 | 2.18 | 10.8 | 10.4 | 2.5 |
| | 1I | CAL | 900 | 640 | 71 | 750 | 222 | 362 | 42 | 0.171 | 1.62 | 11.3 | 10.2 | 2.0 |
| | 1J | CGL | 900 | 650 | 73 | 900 | 242 | 375 | 33 | 0.147 | 1.60 | 11.5 | 9.0 | 1.9 |
| | 1K | CGL | 870 | 560 | 68 | 790 | 212 | 346 | 39 | 0.182 | 1.82 | 11.0 | 10.9 | 2.2 |

TABLE 5-continued

| No. | Steel No. | Panel shape after pressed: Surface strain | ΔWca (μm) | YBT (mm) | Formability of steel sheet: H (mm) | LDR | Remarks |
|---|---|---|---|---|---|---|---|
| 1 | 1A | None | 0.24 | 1.25 | 34.4 | 2.16 | Example |
| | 1B | None | 0.25 | 1.42 | 34.0 | 2.02 | Example |
| | 1C | Within allowable range | 0.28 | 1.50 | 33.8 | 2.01 | Example |
| | 1D | None | 0.21 | 0.84 | 35.3 | 2.04 | Example |
| | 1E | Exists | 0.57 | 2.30 | 21.0 | 1.97 | Comparative Example |
| | 1F | Exists | 0.44 | 2.09 | 21.4 | 1.98 | Comparative Example |
| | 1G | Exists | 0.38 | 1.98 | 29.4 | 1.97 | Comparative Example |
| | 1H | Exists | 0.42 | 1.50 | 26.2 | 2.03 | Comparative Example |
| | 1I | Exists | 0.40 | 2.18 | 24.8 | 1.98 | Comparative Example |
| | 1J | Exists | 0.76 | 2.53 | 21.0 | 1.97 | Comparative Example |
| | 1K | Exists | 0.37 | 1.72 | 29.4 | 2.00 | Comparative Example |

Y** = 5.49log (YP(MPa)) − r
Z*** = r + 50.0 (n)
V*** = r + 5.0 (n)
800#: less than Ar3

Best Mode 2

The above-described Steel sheet 2 according to the present invention is a steel sheet having particularly superior punch stretchability. The detail of the Steel sheet 2 is described in the following.

Carbon: Carbon forms a fine carbide with niobium to increase the strength of the steel and to increase the n value in low strain domains, thus improves the resistance to surface strain. If the carbon content is less than 0.0040%, the effect of carbon addition becomes less. If the carbon content exceeds 0.01%, the ductility of steel degrades. Accordingly, the carbon content is specified to a range of from 0.0040 to 0.01%, preferably from 0.0050 to 0.0080%, most preferably from 0.0050 to 0.0074%.

Silicon: Excessive addition of silicon degrades the chemical surface treatment performance of cold rolled steel sheets and degrades the zinc plating adhesiveness on hot dip galvanized steel sheets. Therefore, the silicon content is specified to not more than 0.05%.

Manganese: Manganese precipitates sulfur in the steel as MnS to prevent the hot crack generation of slabs and to bring the steel to high strength without degrading the zinc plating adhesiveness. If the manganese content is less than 0.1%, the effect of precipitation of sulfur does not appear. If the manganese content exceeds 1.0%, the yield strength significantly increases and the n value in low strain domains decreases. Consequently, the manganese content is specified to a range of from 0.1 to 1.0%.

Phosphorus: Phosphorus is necessary for increasing strength of the steel, to amounts of 0.01% or more. If the phosphorus content exceeds 0.05%, however, the alloying treatment performance of zinc plating degrades, and insufficient plating adhesion is generated. Accordingly, the phosphorus content is specified to a range of from 0.01 to 0.05%.

Sulfur: If sulfur content exceeds 0.02%, the ductility of steel becomes low. Therefore, the sulfur content is specified to not more than 0.02%.

sol.Al: A function of sol.Al is to precipitate nitrogen in steel as AlN for reducing the adverse effect of solid solution nitrogen. If the sol.Al content is below 0.01%, the effect is not satisfactory. If the sol.Al content exceeds 0.1%, solid solution aluminum induces degradation of ductility. Consequently, the sol.Al content is specified to a range of from 0.01 to 0.1%.

Nitrogen: Nitrogen is necessary to be precipitated as AlN. The nitrogen content is specified to not more than 0.004% to let all the nitrogen precipitate as AlN even at a lower limit of sol.Al.

Niobium: Niobium forms fine carbide with carbon to strengthen the steel and to increase the n value in low strain domains, thus improves the resistance to surface strain. If the niobium content is less than 0.01%, the effect cannot be obtained. If the niobium content exceeds 0.14%, the yield strength significantly increases and the n value in low strain domains decreases. Therefore, the niobium content is specified to a range of from 0.01 to 0.14%, preferably from 0.035 to 0.14%, and more preferably from 0.080 to 0.14%.

The reason that Nb lowers the n values in low strain domains is not fully analyzed. However, a detail observation of the steel texture under an electron microscope revealed that, when the contents of niobium and carbon are adequately selected, lots of NbC are precipitated within grains, and less dense precipitates zones (PFZs) are formed at the near grain boundaries, which PFZs will be able to give plastic deformation under lower stress than that inside of grains.

Solely specifying the individual components of steel cannot lead to high strength cold rolled steel sheets having excellent punch stretchability. To obtain that type of high strength cold rolled steel sheets, the following-described conditions are further requested.

Figure 7:
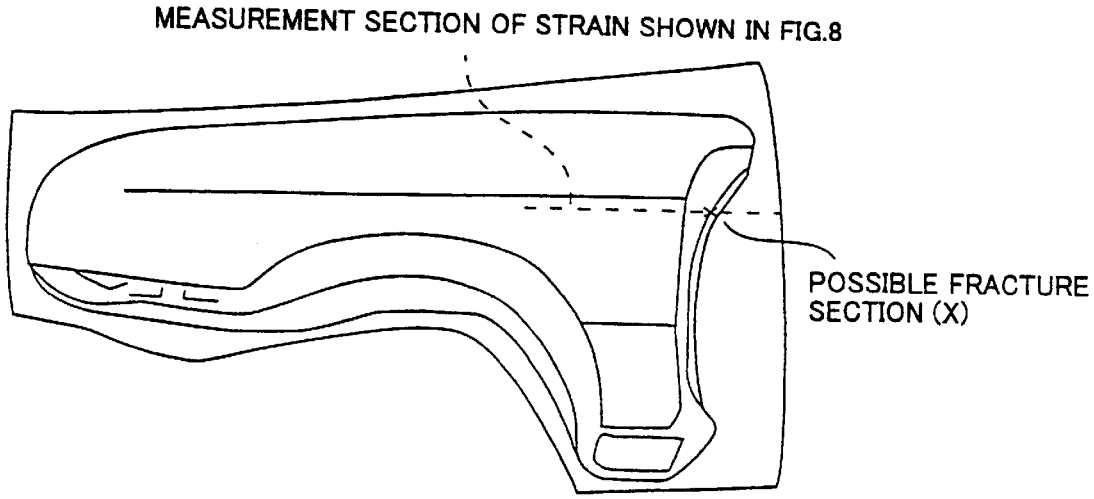
FIG. 7 shows a formed model of front fender.
Figure 8:
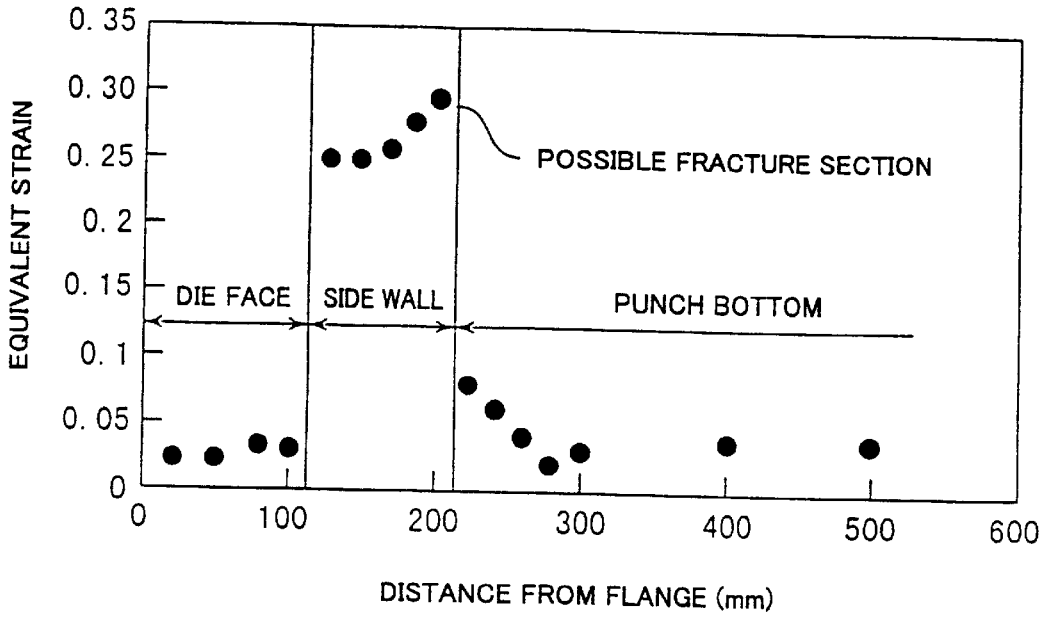
FIG. 8 shows an example of equivalent strain distribution in the vicinity of a possible fracture section on the formed model of front fender given in FIG. 7.

FIG. 8 shows an example of equivalent strain distribution in the vicinity of a possible fracture section on the formed model of front fender given in FIG. 7. The generated strains at bottom section of the punch are from 1 to 10%, and to avoid strain concentration at portions possible of fracture, such as side walls being subjected to punch stretch forming, it is necessary to enhance the plastic flow at the low strain punch bottom section. To do this, the n value which is derived from two nominal strains, 1% and 10%, in uniaxial tensile test should be selected to not less than 0.21.

For the Steel sheet 2 according to the present invention to make the texture of the hot rolled steel sheets more fine one, thus to further improve n values, the addition of titanium is effective. If the titanium content exceeds 0.05%, however, the precipitates of titanium become coarse, and the effect of titanium addition cannot be attained. Therefore, the titanium content is specified to not more than 0.05%, preferably from 0.005 to 0.02%.

For further improvement in resistance to embrittlement during secondary operation, the addition of boron is effective. If the boron content exceeds 0.002%, however, the deep drawability and the punch stretchability degrade. Accordingly, the boron content is specified to not more than 0.002%, preferably from 0.0001 to 0.001%.

The Steel sheet 2 according to the present invention has characteristics of, adding to the excellent punch stretchability, excellent deep drawability, resistance to surface strain, resistance to embrittlement during secondary operation, formability at welded portions, anti-burring performance during shearing, good surface appearance, uniformity of material in a coil, which characteristics are applicable grades to the automobile exterior panels.

The Steel sheet 2 according to the present invention can be manufactured by the steps of: preparing a continuous casting slab of a steel having the composition adjusted as described above, including the addition of titanium and boron; followed by hot rolling, pickling, cold rolling, and annealing.

The slab may be hot rolled directly or after reheated thereof. The finish temperature is preferably not less than the Ar3 transformation temperature to assure the excellent surface appearance and the uniformity of material.

Preferable temperature of coiling after hot rolled is not less than 540° C. for box annealing, and not less than 600° C. for continuous annealing. From the viewpoint of descaling by pickling, the coiling temperature is preferably not more than 680° C.

Preferable reduction ratio during cold rolling is not less than 50% for improving the deep drawability.

Preferable annealing temperature is in a range of from 680 to 750° C. for box annealing, and from 780 to 880° C. for continuous annealing.

The Steel sheet 2 according to the present invention may further be processed, at need, by zinc base plating treatment such as electroplating and hot dip plating, and by organic coating treatment after the plating.

EXAMPLE 1

Molten steels of Steel Nos. 1 through 10 shown in Table 6 were prepared. The melts were then continuously cast to form slabs having 220 mm of thickness. After heating the slabs to 1200° C., hot rolled steel sheets having 2.8 mm of thickness were prepared from the slabs under the condition of 880 to 940° C. of finish temperatures, and 540 to 560° C. of coiling temperatures for box annealing and 600 to 660° C. for continuous annealing or for continuous annealing followed by hot dip galvanization. The hot rolled sheets were then pickled and cold rolled to 50 to 85% of reduction ratios. The cold rolled sheets were treated either by continuous annealing (CAL) at temperatures of from 800 to 860° C., or by box annealing (BAF) at temperatures of from 680 to 740° C., or by continuous annealing at temperatures of from 800 to 860° C. followed by hot dip galvanization (CGL), which were then temper-rolled to 0.7% of reduction ratio.

In the case of continuous annealing followed by hot dip galvanization, the hot dip galvanization after the annealing was given at 460° C., and, immediately after the hot dip galvanization, an alloying treatment of plating layer was given at 500° C. in an in-line alloying furnace. The coating weight was 45 g/m$^2$ per side.

Thus obtained steel sheets were tested to determine mechanical characteristics (along the rolling direction; with JIS Class 5 specimens; and n values being computed in a 1 to 5% strain domain). Furthermore, the steel sheets were formed into front fenders shown in FIG. 7, which were then tested to determine the cushion force at fracture limit.

The test results are shown in Table 7.

Example Steels Nos. 1 through 8 gave 65 ton or more of cushion force at fracture limit, which proves that they are superior in punch stretchability.

On the other hand, Comparative Steels Nos. 9 through 12 fractured at 50 ton or less of cushion force because of low n values in low strain domains.

Comparative Steels Nos. 10 and 11 gave poor surface appearance after galvanized owing to excessive addition of silicon and titanium.

TABLE 6

| Steel No. | C | Si | Mn | P | S | sol.Al | N | Nb | Ti | B | Remarks |
|---|---|---|---|---|---|---|---|---|---|---|---|
| 1 | 0.0059 | 0.01 | 0.34 | 0.019 | 0.011 | 0.060 | 0.0021 | 0.089 | tr. | tr. | Example |
| 2 | 0.0068 | 0.01 | 0.78 | 0.040 | 0.012 | 0.076 | 0.0033 | 0.095 | tr. | tr. | Example |
| 3 | 0.0081 | 0.02 | 0.17 | 0.022 | 0.018 | 0.068 | 0.0028 | 0.113 | tr. | tr. | Example |
| 4 | 0.0079 | 0.02 | 0.43 | 0.018 | 0.010 | 0.062 | 0.0019 | 0.083 | 0.011 | 0.0004 | Example |
| 5 | 0.0065 | 0.02 | 0.38 | 0.021 | 0.011 | 0.061 | 0.0024 | 0.089 | 0.014 | tr. | Example |
| 6 | 0.0076 | 0.02 | 0.34 | 0.019 | 0.010 | 0.070 | 0.0023 | 0.092 | tr. | 0.0008 | Example |
| 7 | 0.0025* | 0.02 | 0.20 | 0.025 | 0.009 | 0.070 | 0.0021 | 0.024 | 0.022* | tr. | Comparative Example |
| 8 | 0.0023* | 0.02 | 0.32 | 0.030 | 0.010 | 0.064 | 0.0020 | tr.* | 0.055* | 0.00014 | Comparative Example |
| 9 | 0.0063 | 0.10* | 0.16 | 0.030 | 0.011 | 0.067 | 0.0019 | 0.029 | tr. | tr. | Comparative Example |
| 10 | 0.0090 | 0.02 | 0.21 | 0.032 | 0.010 | 0.065 | 0.0021 | 0.178* | tr. | tr. | Comparative Example |

Values marked with * are not included in this invention.

TABLE 7

| No. | Steel No. | Annealing condition | Characteristics of Steel Sheet YP (MPa) | TS (MPa) | El (%) | n value | r value | Cushion force at fracture limit (TON) | Remarks |
|---|---|---|---|---|---|---|---|---|---|
| 1 | 1 | CAL | 204 | 351 | 45 | 0.243 | 2.10 | 70 | Example |
| 2 | 1 | BAF | 201 | 348 | 46 | 0.252 | 2.22 | 75 | Example |
| 3 | 1 | CGL | 205 | 354 | 44 | 0.240 | 2.02 | 70 | Example |
| 4 | 2 | CGL | 222 | 382 | 41 | 0.256 | 2.09 | 70 | Example |
| 5 | 3 | CAL | 207 | 354 | 43 | 0.235 | 2.01 | 70 | Example |
| 6 | 4 | CGL | 209 | 361 | 40 | 0.218 | 1.92 | 65 | Example |
| 7 | 5 | CGL | 205 | 356 | 43 | 0.225 | 2.09 | 70 | Example |
| 8 | 6 | CGL | 200 | 349 | 40 | 0.219 | 1.90 | 65 | Example |
| 9 | 7 | CAL | 225 | 368 | 36 | 0.179 | 1.91 | 40 | Comparative Example |
| 10 | 8 | CGL | 188 | 304 | 39 | 0.183 | 1.81 | 45 | Comparative Example |
| 11 | 9 | CGL | 221 | 354 | 39 | 0.176 | 1.82 | 45 | Comparative Example |
| 12 | 10 | BAF | 219 | 352 | 33 | 0.143 | 1.73 | 40 | Comparative Example |

EXAMPLE 2

Example Steel No. 3 and Comparative Steel No. 10, given in Table 7, were formed in front fenders shown in FIG. 7 under 40 ton of cushion force, and the front fenders were tested to determine the strain distribution.

Figure 9:
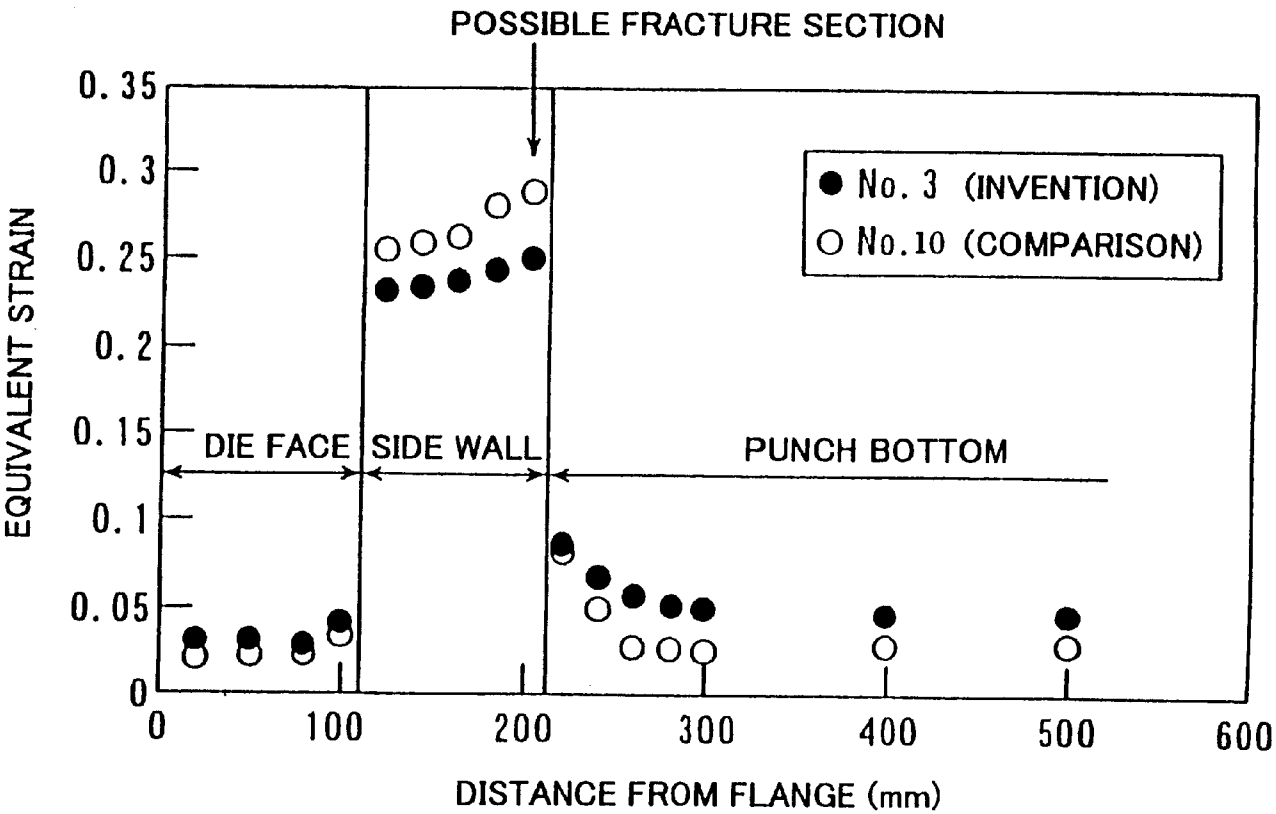
FIG. 9 shows an equivalent strain distribution in the vicinity of a possible fracture section of each of an example steel sheet and a comparative steel sheet formed into the front fender given in FIG. 7.

FIG. 9 shows an equivalent strain distribution in the vicinity of a possible fracture section of each of an example steel sheet and a comparative steel sheet formed into the front fender given in FIG. 7.

In Example Steel No. 3, the strain was large at the bottom section of punch, and the generation of strain at side walls was suppressed, which proved that the Example Steel No. 3 is superior in fracture to the Comparative Steel No. 10.

Best Mode 3

The above-described Steel sheet 3 according to the present invention is a steel sheet having particularly superior resistance to embrittlement during secondary operation. The detail of Steel sheet 3 is described in the following.

Carbon: Carbon forms a fine carbide with niobium to increase the strength of the steel. If the carbon content is less than 0.0040%, the effect of carbon addition becomes less. If the carbon content exceeds 0.01%, carbide begins to precipitate at grain boundaries, which degrades the resistance to embrittlement during secondary operation. Accordingly, the carbon content is specified to a range of from 0.0040 to 0.01%, preferably from 0.0050 to 0.0080%, most preferably from 0.0050 to 0.0074%.

Silicon: Excessive addition of silicon degrades the adhesiveness of zinc plating. Therefore, the silicon content is specified to not more than 0.05%.

Manganese: Manganese precipitates sulfur in the steel as MnS to prevent the hot crack generation of slabs and to bring the steel to high strength without degrading the zinc plating adhesiveness. If the manganese content is less than 0.1%, the effect of precipitation of sulfur does not appear. If the manganese content exceeds 1.0%, the yield strength significantly increases and the ductility decreases. Consequently, the manganese content is specified to a range of from 0.1 to 1.0%.

Phosphorus: Phosphorus is necessary for increasing strength of the steel, to amounts of 0.01% or more. If the phosphorus content exceeds 0.05%, however, insufficient adhesion of zinc plating is generated. Accordingly, the phosphorus content is specified to a range of from 0.01 to 0.05%.

Sulfur: If sulfur content exceeds 0.02%, the hot workability and the ductility of steel degrade. Therefore, the sulfur content is specified to not more than 0.02%.

sol.Al: A function of sol.Al is to precipitate nitrogen in steel as AlN for reducing the adverse effect of solid solution nitrogen. If the sol.Al content is below 0.01%, the effect is not satisfactory. If the sol.Al content exceeds 0.1%, solid solution aluminum induces degradation of ductility. Consequently, the sol.Al content is specified to a range of from 0.01 to 0.1%.

Nitrogen: The nitrogen content is specified to not more than 0.004% to let all the nitrogen precipitate as AlN even at a lower limit of sol.Al.

Niobium: Niobium precipitates solid solution carbon to improve the resistance to embrittlement during secondary operation and the combined formability characteristics. Excess amount of niobium, however, lowers the ductility. Therefore, the niobium content is specified to not more than 0.15%, preferably from 0.035 to 0.15%, and more preferably from 0.080 to 0.14%.

Solely specifying the individual components of steel cannot lead to high strength cold rolled steel sheets having high resistance to embrittlement during secondary operation. To obtain that type of high strength cold rolled steel sheets, the following-described conditions are further requested.

With cold rolled steel sheets having 0.8 mm of thickness consisting essentially of 0.0040 to 0.01% C, 0.01 to 0.05% Si, 0.1 to 1.0% Mn, 0.01 to 0.05% P, 0.002 to 0.02% S, 0.020 to 0.070% sol.Al, 0.0015 to 0.0035% N, 0.01 to 0.15% Nb, by weight, the temperature of embrittlement during secondary operation was determined. The term "temperature of embrittlement during secondary operation" means a temperature observed at which ductile fracture shifts to brittle fracture in a procedure of: draw-forming a blank with 105 mm in diameter punched from a target steel sheet into a cup shape; immersing the cup in various kinds of coolants (for example, ethylalcohol) to vary the cup temperature; expanding the diameter of cup edge portion using a conical punch to bring the cup fracture; then determining the transition temperature by observing the fractured surface.

Figure 10:
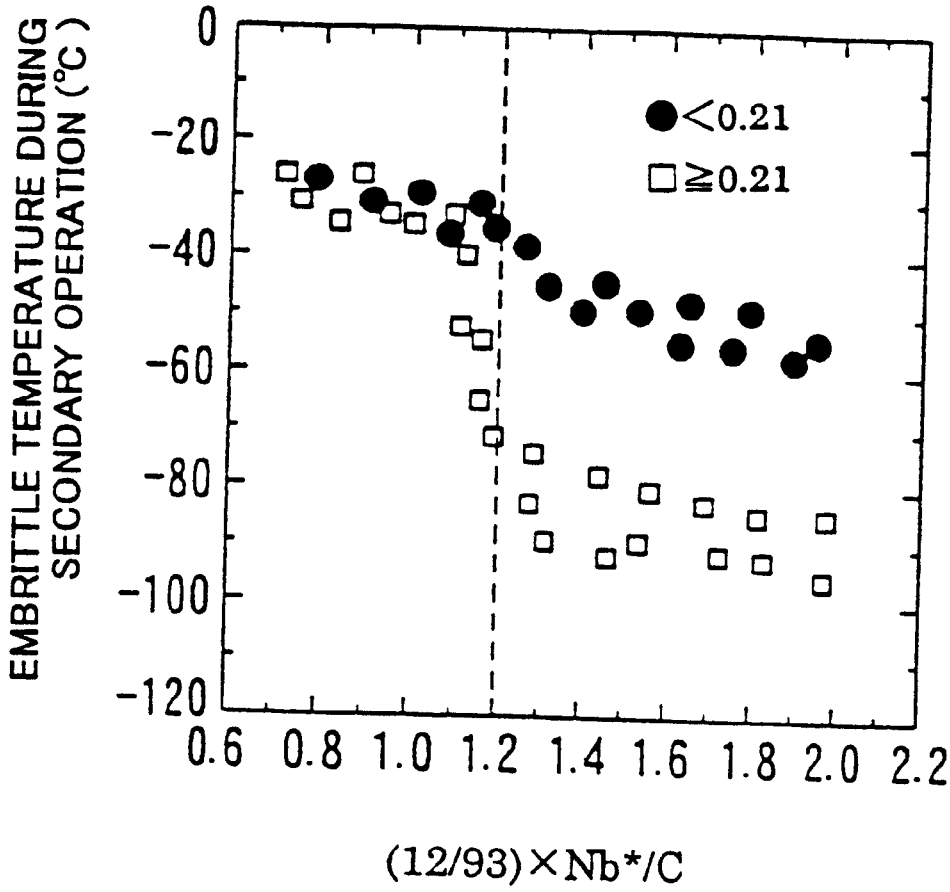
FIG. 10 shows the influence of [(12/93)×Nb*/C] on the embrittle temperature during secondary operation.

FIG. 10 shows the influence of [(12/93)×Nb*/C] on the embrittle temperature during secondary operation.

For the steel sheets having 0.21 or more of n values which were calculated from two nominal strains, 1% and 10%, determined by a uniaxial tensile test, if the formula (6) is satisfied, the temperature of embrittlement during secondary operation significantly reduces, thus providing excellent resistance to embrittlement during secondary operation.

$$(12/93)\times Nb^*/C \geqq 1.2 \quad (6)$$

Although the mechanism of the phenomenon is not fully analyzed, presumably the following-described three phenomena give a synergy effect.

i) Increased n value in the 1 to 10% low strain domains increases the strain at the bottom section contacting the punch during draw-forming step, thus reducing the inflow of material during the draw-forming step to reduce the degree of compression forming in the shrink-flange deformation.

ii) In the case that the formula (6) is satisfied, the size and dispersion profile of carbide are optimized. As a result, even under the compression forming in shrink-flange deformation, microscopic strains are uniformly dispersed, not to concentrating to specific grain boundaries, thus preventing the occurrence of embrittlement at grain boundaries.

iii) Grains become fine owing to NbC, thus the toughness is improved.

Figure 11:
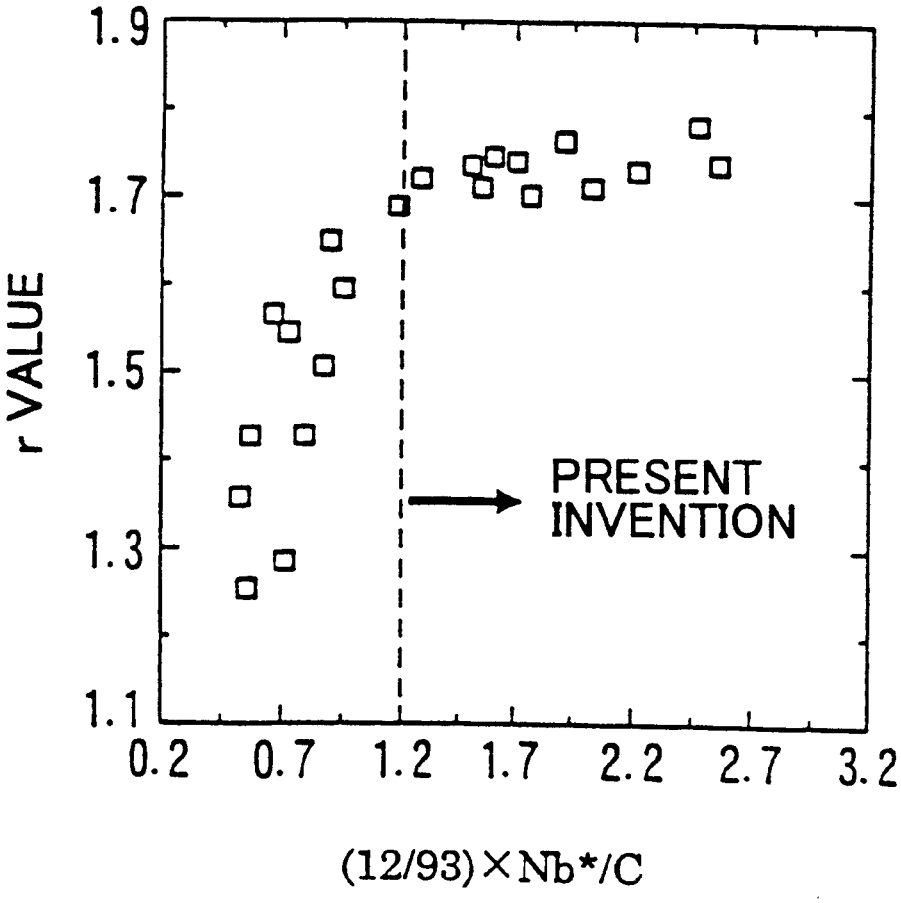
FIG. 11 shows the influence of [(12/93)×Nb*/C] on the r values.
Figure 12:
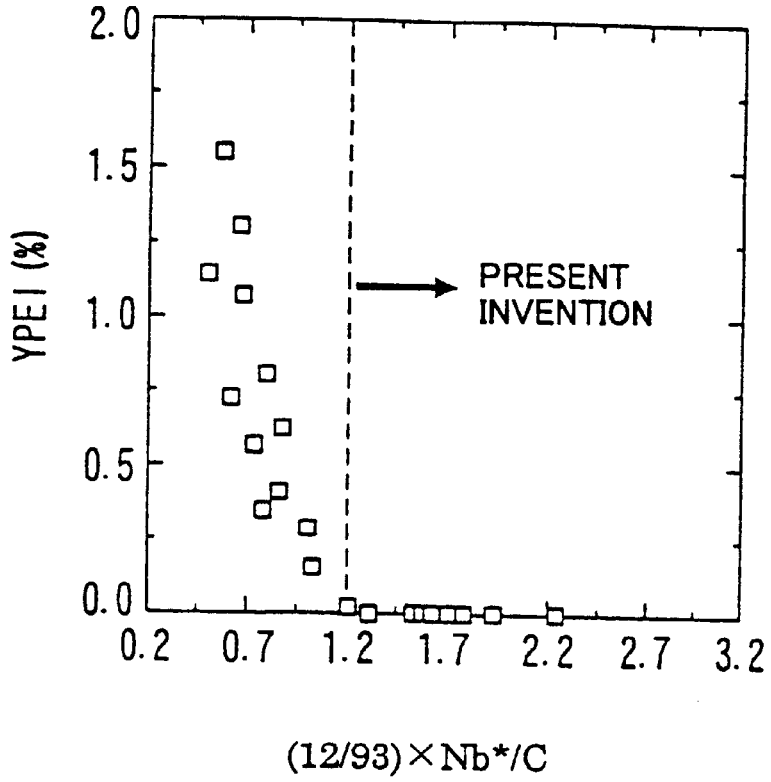
FIG. 12 shows the influence of [(12/93)×Nb*/C] on YPEl.

The Steel sheet 3 according to the present invention provides high r values and excellent deep drawability, as shown in FIG. 11, and shows superior resistance to aging giving 0% of YPEl at 30° C. after a period of three months, as shown in FIG. 12.

For the Steel sheet 3 according to the present invention, the addition of titanium is effective to enhance the formation of fine grains. If the titanium content exceeds 0.05%, however, the surface appearance significantly degrades on applying hot dip galvanization. Therefore, the titanium content is specified to not more than 0.05%, preferably from 0.005 to 0.02%.

For further improvement in resistance to embrittlement during secondary operation, the addition of boron is effective. If the boron content exceeds 0.002%, however, the deep drawability and the punch stretchability degrade. Accordingly, the boron content is specified to not more than 0.002%, preferably from 0.0001 to 0.001%.

The Steel sheet 3 according to the present invention has characteristics of, adding to the excellent resistance to embrittlement during secondary operation, excellent combined formability, formability at welded portions, anti-burring performance during shearing, good surface appearance, uniformity of material in a coil, which characteristics are applicable grades to the automobile exterior panels.

The Steel sheet 3 according to the present invention can be manufactured by the steps of: preparing a continuous casting slab of a steel having the composition adjusted as described above, including the addition of titanium and boron; preparing a hot rolled steel sheet by finish rolling the slab at temperatures of Ar3 transformation temperature or more; coiling the hot rolled steel sheet at temperatures of from 500 to 700° C.; and cold rolling the coiled hot rolled steel sheet followed by annealing, under normal conditions.

The finish rolling is necessary to be conducted at temperatures not less than the Ar3 transformation temperature. If the finish rolling is done at temperatures below the Ar3 transformation temperature, the n value in the 1 to 10% low strain domains reduces to degrade the resistance to embrittlement in secondary operation. In the case that a continuous casting slab is hot rolled, the slab may be directly rolled or rolled after reheated.

The coiling is necessary to be conducted at temperatures of 500° C. or more to enhance the formation of precipitates of NbC, and to be conducted at temperatures of 700° C. or less from the viewpoint of descaling by pickling.

The Steel sheet 3 according to the present invention may further be processed, at need, by zinc base plating treatment such as electroplating and hot dip plating, and by organic coating treatment after the plating.

EXAMPLE

Molten steels of Steel Nos. 1 through 23 shown in Table 8 were prepared. The melts were then continuously cast to form slabs having 250 mm of thickness. After heating the slabs to 1200° C., hot rolled steel sheets having 2.8 mm of thickness were prepared from the slabs under the condition of 890 to 940° C. of finish temperatures, and 600 to 650° C. of coiling temperatures. The hot rolled sheets were then cold rolled to a thickness of 0.7 mm. The cold rolled sheets were treated by continuous annealing at temperatures of from 800 to 860° C., followed by hot dip galvanization, which were then temper-rolled to 0.7% of reduction ratio.

In the continuous annealing followed by hot dip galvanization, the hot dip galvanization after the annealing was given at 460° C., and, immediately after the hot dip galvanization, an alloying treatment of plating layer was given at 500° C. in an in-line alloying furnace.

Thus obtained steels were tested to determine tensile characteristics (along the rolling direction; with JIS Class 5 specimens), r values, above-described embrittle temperature during secondary operation, YPEl at 30° C. after three months, and visual observation of surface.

The test results are shown in Table 9. Example Steels Nos. 1 through 15 showed very high resistance to embrittlement during secondary operation giving −85° C. or below of the temperature of embrittle during secondary operation, gave high r values, and showed non-aging property, further suggested to have excellent surface appearance.

On the other hand, Comparative Steels Nos. 16 and 21 failed to obtain satisfactory strength because the carbon and phosphorus contents were outside of the specified range of the present invention. Comparative Steels Nos. 19 and 20 were in poor surface appearance because the silicon and phosphorus contents were outside of the specified range of the present invention. Comparative Steels Nos. 18 and 22 were in poor resistance to embrittlement during secondary operation because the value of [Nb*/C] was outside of the specified range of the present invention.

TABLE 8

| Steel No. | C | Si | Mn | P | S | N | Nb | Ti | B | (12/93 × Nb*/C) | Remarks |
|---|---|---|---|---|---|---|---|---|---|---|---|
| 1 | 0.0052 | 0.01 | 0.41 | 0.019 | 0.012 | 0.0033 | 0.08 | — | — | 1.44 | Example Steel |
| 2 | 0.0053 | 0.05 | 0.33 | 0.020 | 0.007 | 0.0020 | 0.09 | — | — | 1.87 | Example Steel |
| 3 | 0.0062 | 0.02 | 0.16 | 0.042 | 0.009 | 0.0026 | 0.08 | — | — | 1.31 | Example Steel |
| 4 | 0.0065 | 0.04 | 0.31 | 0.025 | 0.010 | 0.0030 | 0.10 | — | — | 1.59 | Example Steel |
| 5 | 0.0065 | 0.01 | 0.20 | 0.040 | 0.012 | 0.0018 | 0.12 | — | — | 2.14 | Example Steel |
| 6 | 0.0068 | 0.03 | 0.68 | 0.015 | 0.010 | 0.0035 | 0.12 | — | — | 1.84 | Example Steel |
| 7 | 0.0066 | 0.02 | 0.78 | 0.040 | 0.009 | 0.0022 | 0.12 | — | — | 2.06 | Example Steel |
| 8 | 0.0072 | 0.03 | 0.84 | 0.038 | 0.010 | 0.0030 | 0.12 | — | — | 1.79 | Example Steel |
| 9 | 0.0067 | 0.01 | 0.13 | 0.035 | 0.008 | 0.0022 | 0.10 | — | — | 1.64 | Example Steel |
| 10 | 0.0075 | 0.01 | 0.24 | 0.030 | 0.016 | 0.0021 | 0.11 | — | — | 1.65 | Example Steel |
| 11 | 0.0077 | 0.03 | 0.21 | 0.028 | 0.007 | 0.0019 | 0.10 | — | — | 1.46 | Example Steel |
| 12 | 0.0093 | 0.01 | 0.18 | 0.034 | 0.009 | 0.0022 | 0.13 | — | — | 1.60 | Example Steel |
| 13 | 0.0065 | 0.03 | 0.35 | 0.022 | 0.011 | 0.0023 | 0.09 | 0.016 | — | 1.48 | Example Steel |
| 14 | 0.0063 | 0.02 | 0.32 | 0.025 | 0.010 | 0.0029 | 0.10 | — | 0.0009 | 1.65 | Example Steel |
| 15 | 0.0068 | 0.01 | 0.33 | 0.028 | 0.009 | 0.0026 | 0.09 | 0.011 | 0.0004 | 1.38 | Example Steel |
| 16 | 0.0034 | 0.01 | 0.27 | 0.022 | 0.012 | 0.0019 | 0.05 | — | — | 1.42 | Comparative Steel |
| 17 | 0.0041 | 0.02 | 0.21 | 0.030 | 0.010 | 0.0022 | 0.06 | — | — | 1.43 | Comparative Steel |
| 18 | 0.0043 | 0.01 | 0.24 | 0.029 | 0.011 | 0.0025 | 0.03 | — | — | 0.40 | Comparative Steel |
| 19 | 0.0058 | 0.12 | 0.23 | 0.040 | 0.008 | 0.0025 | 0.09 | — | — | 1.63 | Comparative Steel |
| 20 | 0.0063 | 0.01 | 0.26 | 0.065 | 0.008 | 0.0024 | 0.08 | — | — | 1.31 | Comparative Steel |
| 21 | 0.0062 | 0.02 | 0.10 | 0.003 | 0.013 | 0.0024 | 0.10 | — | — | 1.75 | Comparative Steel |
| 22 | 0.0072 | 0.01 | 0.33 | 0.021 | 0.012 | 0.0030 | 0.07 | — | — | 0.90 | Comparative Steel |
| 23 | 0.0130 | 0.01 | 0.17 | 0.017 | 0.009 | 0.0038 | 0.18 | — | — | 1.54 | Comparative Steel |

TABLE 9

| Steel No. | Finish temperature (° C.) | n value (1%–10%) | TS (MPa) | r value | Tc** (° C.) | Yield elongation | Surface appearance | Remarks |
|---|---|---|---|---|---|---|---|---|
| 1 | 905 | 0.223 | 355 | 1.84 | −95 | 0 | ○ | Example Steel |
| 2 | 913 | 0.233 | 352 | 2.05 | −90 | 0 | ○ | Example Steel |
| 3 | 895 | 0.218 | 348 | 1.84 | −90 | 0 | ○ | Example Steel |
| 4 | 900 | 0.227 | 344 | 1.95 | −85 | 0 | ○ | Example Steel |
| 5 | 940 | 0.243 | 362 | 2.01 | −95 | 0 | ○ | Example Steel |
| 6 | 915 | 0.237 | 363 | 2.02 | −90 | 0 | ○ | Example Steel |
| 7 | 890 | 0.233 | 380 | 1.92 | −95 | 0 | ○ | Example Steel |
| 8 | 905 | 0.228 | 383 | 1.88 | −85 | 0 | ○ | Example Steel |
| 9 | 911 | 0.225 | 351 | 1.89 | −90 | 0 | ○ | Example Steel |
| 10 | 915 | 0.219 | 352 | 1.97 | −95 | 0 | ○ | Example Steel |
| 11 | 926 | 0.231 | 360 | 1.89 | −90 | 0 | ○ | Example Steel |
| 12 | 908 | 0.218 | 359 | 1.87 | −90 | 0 | ○ | Example Steel |
| 13 | 911 | 0.225 | 345 | 1.94 | −85 | 0 | ○ | Example Steel |
| 14 | 902 | 0.217 | 347 | 1.83 | −95 | 0 | ○ | Example Steel |
| 15 | 915 | 0.218 | 344 | 1.82 | −95 | 0 | ○ | Example Steel |
| 16 | 947 | 0.215 | 327 | 1.80 | −70 | 0 | ○ | Comparative Steel |
| 17 | 870 | 0.195 | 341 | 1.57 | −25 | 0 | ○ | Comparative Steel |
| 18 | 921 | 0.188 | 340 | 1.51 | −20 | 1.1 | ○ | Comparative Steel |
| 19 | 928 | 0.211 | 356 | 1.80 | −20 | 0 | X | Comparative Steel |
| 20 | 920 | 0.218 | 362 | 1.84 | −20 | 0 | X | Comparative Steel |

TABLE 9-continued

| Steel No. | Finish temperature (° C.) | n value (1%–10%) | TS (MPa) | r value | Tc** (° C.) | Yield elongation | Surface appearance | Remarks |
|---|---|---|---|---|---|---|---|---|
| 21 | 915 | 0.208 | 331 | 1.75 | −40 | 0 | ○ | Comparative Steel |
| 22 | 905 | 0.185 | 345 | 1.49 | −25 | 0.2 | ○ | Comparative Steel |
| 23 | 926 | 0.189 | 364 | 1.73 | −10 | 0 | ○ | Comparative Steel |

**Tc: Embrittle temperature in secondary operation

Best Mode 4

The above-described Steel sheet 4 according to the present invention is a steel sheet having particularly superior formability at welded portions. The detail of Steel sheet 4 is described in the following.

Carbon: Carbon forms a fine carbide with niobium to increase the strength of the steel, to increase the n values in low strain domains, and to suppress the formation of coarse grains at heat-affecting zones of welded portions. If the carbon content is less than 0.0040%, the effect of carbon addition becomes less. If the carbon content exceeds 0.01%, the formability degrades not only of the main material but also of the welded portions. Accordingly, the carbon content is specified to a range of from 0.0040 to 0.01%, preferably from 0.0050 to 0.0080%, most preferably from 0.0050 to 0.0074%.

Silicon: Excessive addition of silicon degrades the formability at welded portion and degrades the adhesiveness of zinc plating. Therefore, the silicon content is specified to not more than 0.05%.

Manganese: Manganese precipitates sulfur in the steel as MnS to prevent the hot crack generation of slabs and to bring the steel to high strength without degrading the zinc plating adhesiveness. If the manganese content is less than 0.1%, the effect of precipitation of sulfur does not appear. If the manganese content exceeds 1.0%, the strength significantly increases and the ductility decreases. Consequently, the manganese content is specified to a range of from 0.1 to 1.0%.

Phosphorus: Phosphorus is necessary for increasing strength of the steel, to amounts of 0.01% or more. If the phosphorus content exceeds 0.05%, however, degradation of toughness at welded portions and insufficient adhesion of zinc plaint are generated. Accordingly, the phosphorus content is specified to a range of from 0.01 to 0.05%.

Sulfur: If sulfur content exceeds 0.02%, the ductility degrades. Therefore, the sulfur content is specified to not more than 0.02%.

sol.Al: A function of sol.Al is to precipitate nitrogen in steel as AlN for reducing the adverse effect of solid solution nitrogen. If the sol.Al content is below 0.01%, the effect is not satisfactory. If the sol.Al content exceeds 0.1%, solid solution aluminum induces degradation of ductility. Consequently, the sol.Al content is specified to a range of from 0.01 to 0.1%.

Nitrogen: The nitrogen content is specified to not more than 0.004% to let all the nitrogen precipitate as AlN even at a lower limit of sol.Al.

Niobium: Niobium forms fine carbide with carbon, and suppresses the formation of coarse grains at heat-affected zones of welded portions. In addition, niobium increases the strength of steel, and increases the n values in low strain domains. If, however, the niobium content is less than 0.01%, the effect of the niobium addition cannot be attained. If the niobium content exceeds 0.14%, the yield strength increases and the ductility degrades. Therefore, the niobium content is specified to a range of from 0.01 to 0.14%, preferably from 0.035 to 0.14%, and more preferably from 0.080 to 0.14%.

Solely specifying the individual components of steel cannot necessarily lead to high formability of welded portions applicable to tailored blank. In this respect, cold rolled steel sheets with 0.7 mm of thickness and having the composition within a range described above were welded by laser welding (3 kW of laser output; 5 m/min of welding speed). With the welded steel sheets, the punch stretchabiilty at the heat-affected zones was determined by the spherical head punch stretching test, the elongation flange-forming performance was determined by the hole expanding test, and the deep drawability was determined by the rectangular cylinder drawing test.

Figure 13:
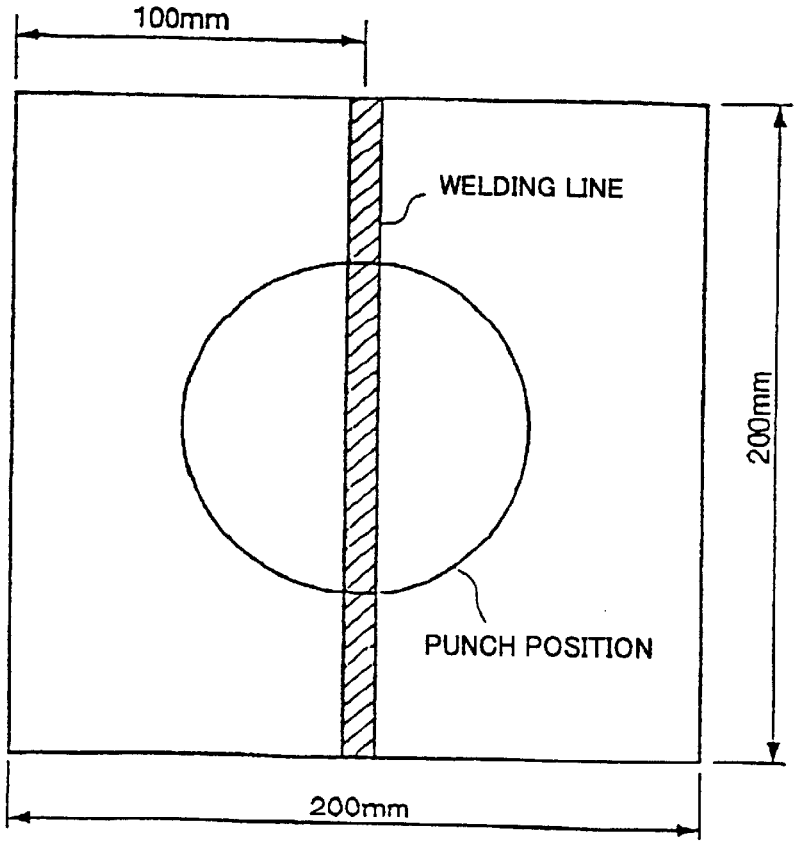
FIG. 13 shows a specimen for the spherical head punch stretch forming test.
Figure 14:
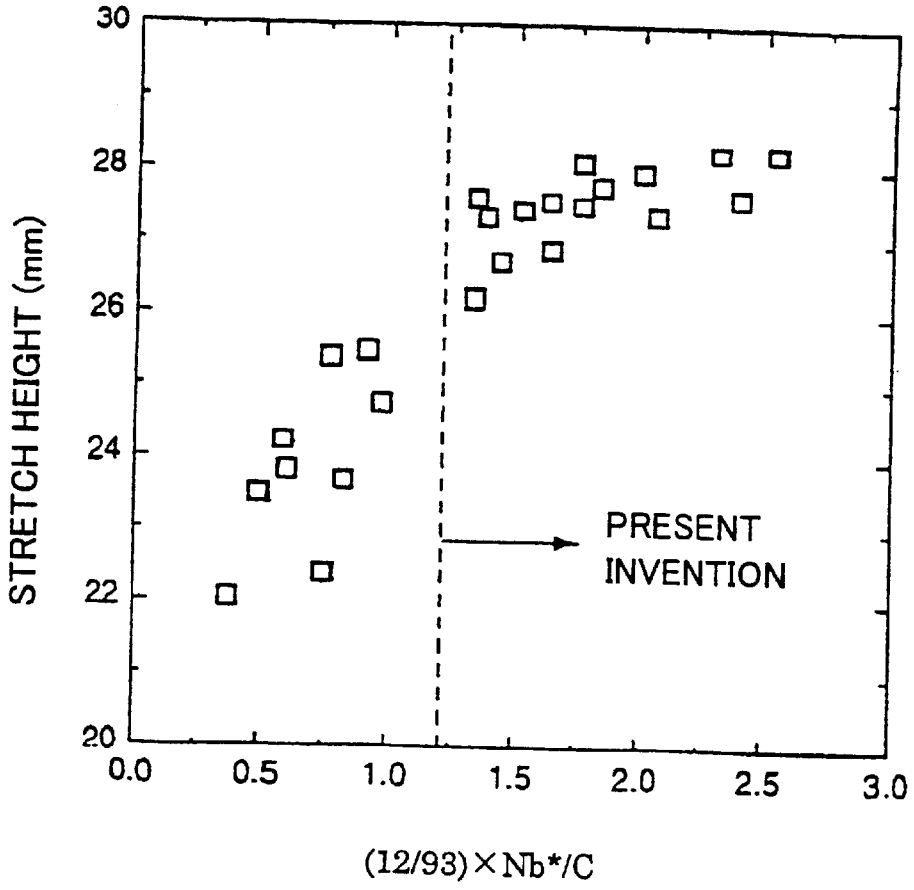
FIG. 14 shows the influence of [(12/93)×Nb*/C] on the spherical head stretch height at a welded portion.

FIG. 14 shows the influence of [(12×Nb*)/(93×C)] on the punch stretch height at welded portions in the spherical head stretch test using the specimens shown in FIG. 13 under the condition given in Table 10.

It was found that, when niobium and carbon contents satisfy the formula (6), the punch stretch height becomes 26 mm or more, which proves the excellent punch stretchability. If the value of [(12×Nb*)/(93×C)] is less than 1.2, crack occurs from a heat-affected zone to significantly reduce the punch stretch height.

$$(12/93)\times Nb^*/C \geqq 1.2 \quad (6)$$

Figure 15:
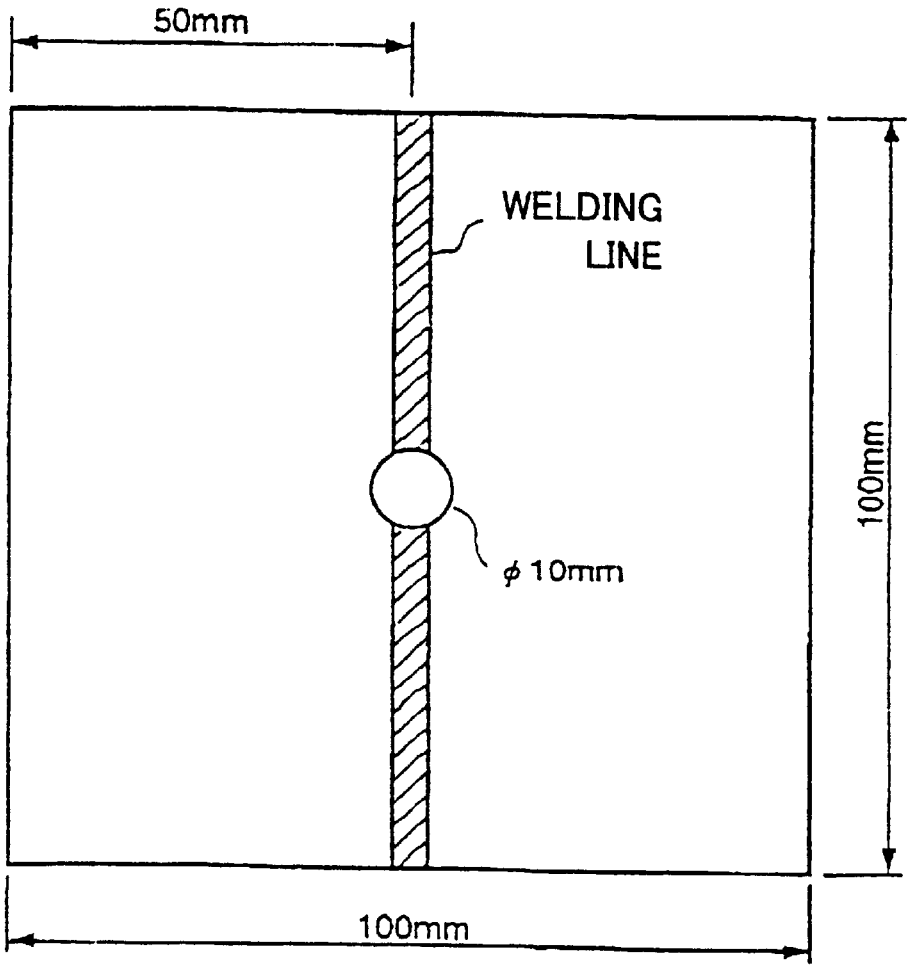
FIG. 15 shows a specimen for the hole expansion test.
Figure 16:
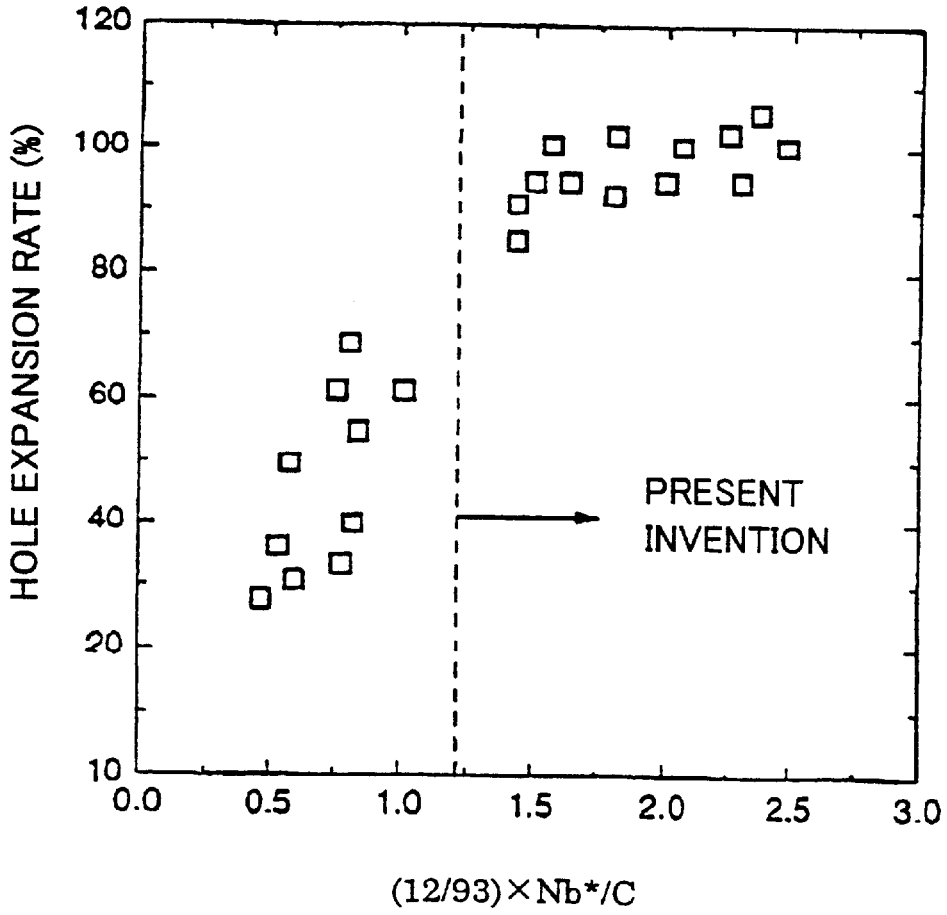
FIG. 16 shows the influence of [(12/93)×Nb*/C] on the hole expansion rate at a welded portion.

FIG. 16 shows the influence of [(12×Nb*)/(93×C)] on the hole expansion rate at a welded portion using the specimens shown in FIG. 15 under the condition given in Table 11.

It was found that, when niobium and carbon contents satisfy the formula (6), the hole expansion rate becomes 80% or more, which proves the excellent elongation flange-forming performance. If the value of [(12/93)×Nb*/C] is less than 1.2, crack occurs from a heat-affected zone to propagate along the heat-affected zone. The result suggests that the softening of material caused from the coarse grain formation at heat-affected zone results in degraded elongation flange-forming performance.

Within a range of niobium and carbon contents according to the present invention, all of NbC become solid solution at temperatures of not less than 1100° C., from the standpoint of equilibrium. At heat-affected zones subjected to rapid heating and cooling during welding, however, the reactions proceed under a non-equilibrium condition, so that the un-melted NbC presumably enhances effectively the formation of fine grains.

To obtain further excellent punch stretchability and elongation flange-forming performance at the heat-affected zones, it is preferred to limit the value of [(12×Nb*)(93×C)] within a range of from 1.3 to 2.2.

Figure 17:
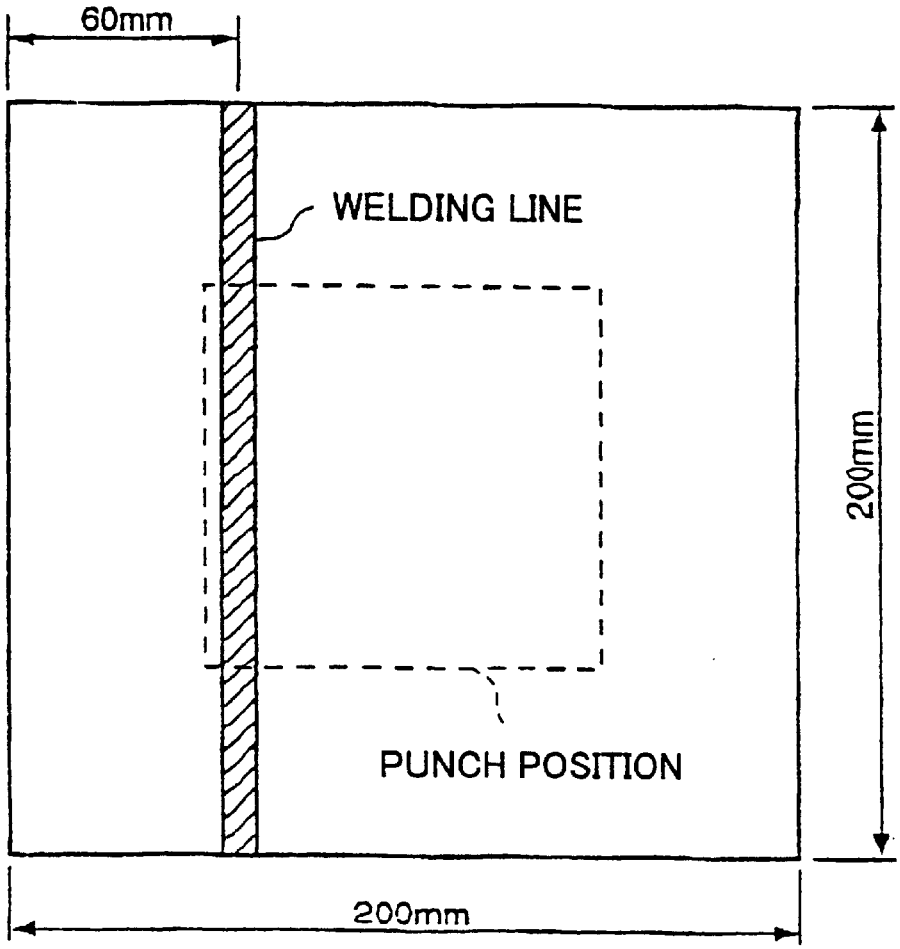
FIG. 17 shows a specimen for the rectangular cylinder drawing test.
Figure 18:
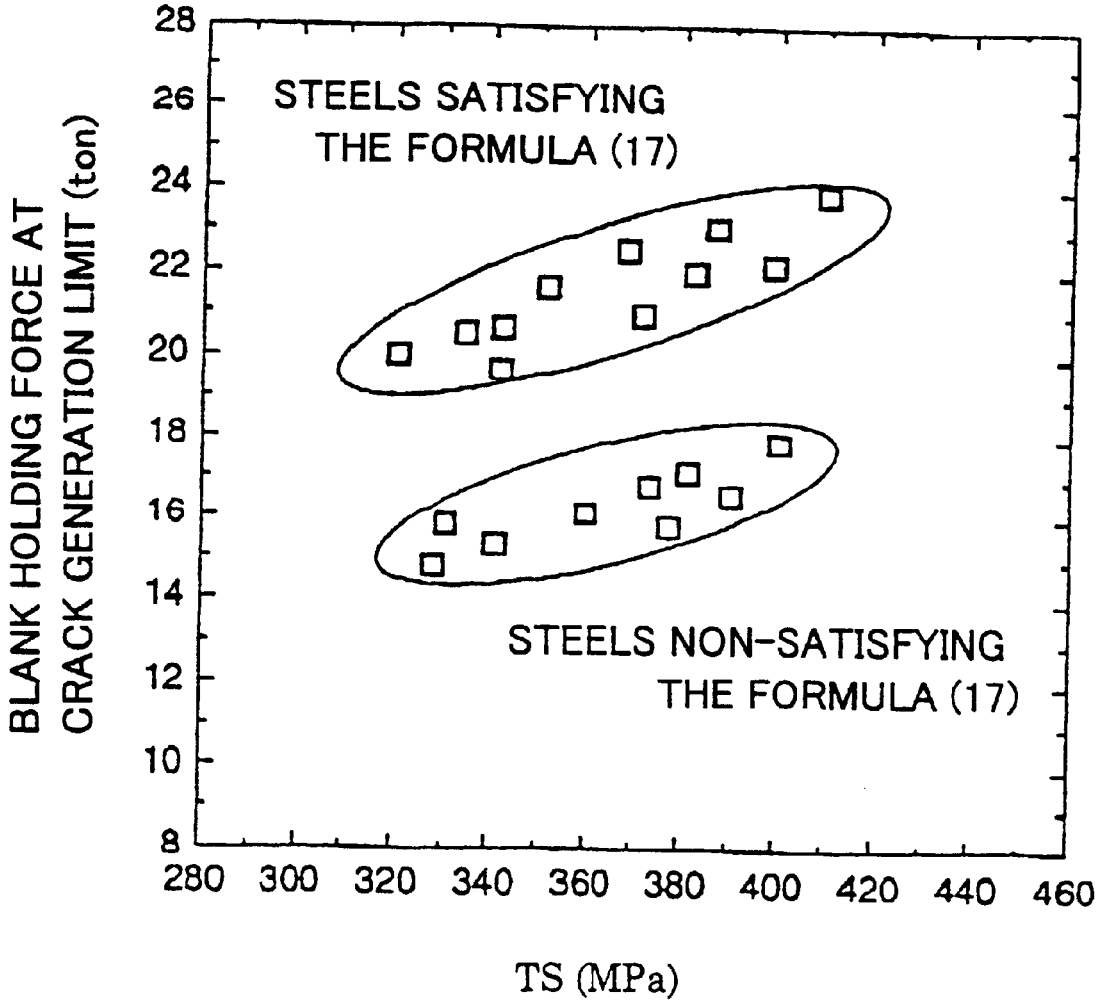
FIG. 18 shows the influence of TS on the blank holding force at crack generation limit on a welded portion.

FIG. 18 shows the influence of TS on the blank holding force at crack generation limit on a welded portion in the rectangular cylinder drawing test using the specimens shown in FIG. 17 under the condition given in Table 12.

With the steels satisfying the formula (7), the blank holding forces at crack generation limit were 20 tons or more, which proves the excellent deep drawability.

$$TS-4050\times Ceq \geqq -0.75\times TS+380 \quad (7)$$

The presumable reason of attaining the result is the following. In accordance with the relation expressed by the formula (7), the enhanced precipitation of NbC and the enhanced formation of fine grains are used to design the composition with reduced amount of silicon, manganese, and phosphorus which are solid solution strengthening elements. Thus, the relative strength difference between the welded portions and the main material is reduced.

TABLE 10

| Spherical head punch stretcing test condition | |
|---|---|
| Punch | ϕ 100 mm-Rp 50 mm |
| Die | ϕ 106 mm-Rd 6.5 mm<br>with triangle bead (bead position: ϕ 133 mm) |
| Blank holding force | 60 ton (fixed) |
| Lubrication | Polyethylene film + High viscosity press oil |

TABLE 11

| Hole expansion test condition | |
|---|---|
| Punch | ϕ 150 mm-Rp 8 mm |
| Die | ϕ 56 mm-Rd 5 mm<br>with triangle bead (bead position: ϕ 80 mm) |
| Blank holding force | 8 ton (fixed) |
| Lubrication | Rust-preventive oil |

TABLE 12

| Rectangular cylinder drawing test condition | |
|---|---|
| Punch | 100 mm × 100 mm-Rp 5 mm<br>Corner R: 15 mm |
| Die | 106 mm × 106 mm-Rd 5 mm<br>Corner R: 18 mm |
| Lubrication | Rust-preventive oil |

For the Steel sheet 4 according to the present invention to enhance the formation of fine grains, the addition of titanium is effective. If the titanium content exceeds 0.05%, however, the surface condition significantly degrades on applying hot dip galvanization. Therefore, the titanium content is specified to not more than 0.05%, preferably from 0.005 to 0.02%.

For further improvement in resistance to embrittlement during secondary operation, the addition of boron is effective. If the boron content exceeds 0.002%, however, the deep drawability and the punch stretchability degrade. Accordingly, the boron content is specified to not more than 0.002%, preferably from 0.0001 to 0.001%.

The Steel sheet 4 according to the present invention has characteristics of, adding to the excellent formability at welded portions, excellent combined formability, resistance to embrittlement during secondary operation, anti-burring performance during shearing, good surface appearance, uniformity of material in a coil, which characteristics are applicable grades to the automobile exterior panels.

The Steel sheet 4 according to the present invention can be manufactured by the steps of: preparing a continuous casting slab of a steel having the composition adjusted as described above, including the addition of titanium and boron; followed by hot rolling, pickling, cold rolling, and annealing.

The slab may be hot rolled directly or after reheated thereof. The finish temperature is preferably not less than the Ar3 transformation temperature to assure the excellent surface appearance and the uniformity of material.

Preferable temperature of coiling after hot rolled is not less than 540° C. for box annealing, and not less than 600° C. for continuous annealing. From the viewpoint of descaling by pickling, the coiling temperature is preferably not more than 680° C.

Preferable reduction ratio during cold rolling is not less than 50% for improving the deep drawability.

Preferable annealing temperature is in a range of from 680 to 750° C. for box annealing, and from 780 to 880° C. for continuous annealing.

The Steel sheet 4 according to the present invention may further be processed, at need, by zinc base plating treatment such as electroplating and hot dip plating, and by organic coating treatment after the plating.

EXAMPLE

Molten steels of Steel Nos. 1 through 20 shown in Table 13 were prepared. The melts were then continuously cast to form slabs having 250 mm of thickness. After heating the slabs to 1200° C., hot rolled steel sheets having 2.8 mm of thickness were prepared from the slabs under the condition of 880 to 940° C. of finish temperatures, and 540 to 560° C. of coiling temperatures for box annealing and 600 to 680° C. for continuous annealing or for continuous annealing followed by galvanization. The hot rolled sheets were then cold rolled to a thickness of 0.7 mm. The cold rolled sheets were treated by box annealing (BAF) at temperatures of from 680 to 740° C., by continuous annealing (CAL) at temperatures of from 800 to 860° C., or by continuous annealing (CAL) at temperatures of from 800 to 860° C. followed by hot dip galvanization (CGL), which were then temper-rolled to 0.7% of reduction ratio.

In the case of continuous annealing followed by hot dip galvanization, the hot dip galvanization after the annealing was given at 460° C., and, immediately after the hot dip galvanization, an alloying treatment of plating layer was given at 500° C. in an in-line alloying furnace.

Thus obtained steel sheets were tested to determine tensile characteristics (along the rolling direction; with JIS Class 5 specimens) and r values for the main material. In addition, with the same procedure described above, the spherical head punch stretchability test, the hole expansion test, and the rectangular cylinder drawing test were given to the heat-affected zones of welded portions.

The test results are shown in Table 14.

Example Steels Nos. 1 through 10 showed superior mechanical characteristics of main material, and furthermore, the heat affected zones of welded portions provided excellent punch stretchability, hole expansion ratio, and blank holding force at fracture limit.

On the other hand, Comparative Steels Nos. 11 and 20 were inferior in formability of welded portions.

TABLE 13

| No. | Annealing condition | C | Si | Mn | P | S | Sol.Al | N | Nb | Ti | B | (12 × Nb*)/(93 × C) | Remarks |
|---|---|---|---|---|---|---|---|---|---|---|---|---|---|
| 1 | CAL | 0.0045 | 0.01 | 0.14 | 0.011 | 0.007 | 0.039 | 0.0021 | 0.061 | — | — | 1.35 | Example |
| 2 | BAF | 0.0042 | 0.01 | 0.12 | 0.010 | 0.006 | 0.042 | 0.0022 | 0.068 | — | — | 1.64 | Example |
| 3 | CGL | 0.0058 | 0.01 | 0.33 | 0.021 | 0.008 | 0.049 | 0.0020 | 0.069 | — | — | 1.24 | Example |
| 4 | BAF | 0.0062 | 0.01 | 0.51 | 0.012 | 0.009 | 0.052 | 0.0024 | 0.085 | — | — | 1.44 | Example |
| 5 | CGL | 0.0061 | 0.01 | 0.42 | 0.017 | 0.006 | 0.044 | 0.0021 | 0.099 | — | — | 1.80 | Example |
| 6 | CGL | 0.0065 | 0.01 | 0.92 | 0.037 | 0.006 | 0.049 | 0.0024 | 0.079 | — | — | 1.25 | Example |
| 7 | CGL | 0.0063 | 0.01 | 0.73 | 0.046 | 0.008 | 0.051 | 0.0025 | 0.111 | 0.014 | — | 1.93 | Example |
| 8 | CAL | 0.0073 | 0.01 | 0.95 | 0.045 | 0.007 | 0.041 | 0.0024 | 0.090 | — | 0.0009 | 1.31 | Example |
| 9 | CGL | 0.0105 | 0.02 | 0.94 | 0.047 | 0.006 | 0.042 | 0.0026 | 0.129 | — | — | 1.37 | Example |
| 10 | CAL | 0.0121 | 0.05 | 0.76 | 0.036 | 0.007 | 0.039 | 0.0022 | 0.135 | 0.011 | 0.0004 | 1.28 | Example |
| 11 | CAL | 0.0029 | 0.02 | 0.19 | 0.016 | 0.006 | 0.045 | 0.0027 | 0.059 | — | — | 1.83 | Comparative Example |
| 12 | BAF | 0.0024 | 0.01 | 0.64 | 0.052 | 0.008 | 0.044 | 0.0023 | 0.019 | 0.029 | — | 0.20 | Comparative Example |
| 13 | CGL | 0.0059 | 0.01 | 0.32 | 0.024 | 0.007 | 0.049 | 0.0021 | 0.039 | — | — | 0.55 | Comparative Example |
| 14 | CGL | 0.0061 | 0.01 | 0.35 | 0.023 | 0.006 | 0.048 | 0.0024 | 0.079 | 0.067 | — | 1.33 | Comparative Example |
| 15 | CGL | 0.0063 | 0.01 | 0.33 | 0.021 | 0.009 | 0.051 | 0.0021 | 0.081 | — | 0.0026 | 1.37 | Comparative Example |
| 16 | CGL | 0.0023 | 0.01 | 0.95 | 0.075 | 0.007 | 0.047 | 0.0023 | 0.027 | 0.014 | 0.0004 | 0.66 | Comparative Example |
| 17 | BAF | 0.0072 | 0.03 | 0.71 | 0.044 | 0.006 | 0.044 | 0.0021 | — | 0.075 | — | — | Comparative Example |
| 18 | CGL | 0.0068 | 0.01 | 0.68 | 0.039 | 0.007 | 0.042 | 0.0024 | — | 0.055 | 0.0008 | — | Comparative Example |
| 19 | CGL | 0.0103 | 0.68 | 0.74 | 0.046 | 0.006 | 0.046 | 0.0025 | 0.119 | — | — | 1.28 | Comparative Example |
| 20 | CAL | 0.0160 | 0.02 | 0.35 | 0.035 | 0.008 | 0.055 | 0.0021 | 0.196 | — | — | 1.47 | Comparative Example |

TABLE 14

| No. | YP (MPa) | TS (MPa) | El (%) | r value | BH (MPa) | TS-4050 × Ceq | −0.75 × TS + 380 | Stretch height (mm) | Hole expansion rate (%) | Blank holding force at crack generation limit (ton) | Remarks |
|---|---|---|---|---|---|---|---|---|---|---|---|
| 1 | 197 | 325 | 43.5 | 1.79 | 0 | 261 | 136 | 28.0 | 105 | 20.5 | Example |
| 2 | 193 | 323 | 43.2 | 1.80 | 0 | 265 | 138 | 27.6 | 95 | 20.5 | Example |
| 3 | 207 | 344 | 41.8 | 1.72 | 0 | 224 | 122 | 27.5 | 100 | 20.0 | Example |
| 4 | 209 | 345 | 41.0 | 1.69 | 0 | 212 | 121 | 28.0 | 105 | 21.0 | Example |
| 5 | 210 | 348 | 42.0 | 1.70 | 0 | 220 | 119 | 27.4 | 95 | 22.5 | Example |
| 6 | 227 | 375 | 40.8 | 1.85 | 0 | 124 | 99 | 27.6 | 95 | 21.5 | Example |
| 7 | 229 | 378 | 40.5 | 1.86 | 0 | 140 | 97 | 27.4 | 100 | 22.0 | Example |
| 8 | 234 | 385 | 39.9 | 1.76 | 0 | 110 | 91 | 27.5 | 95 | 23.0 | Example |
| 9 | 241 | 398 | 39.5 | 1.71 | 0 | 106 | 82 | 26.7 | 85 | 24.5 | Example |
| 10 | 239 | 394 | 39.3 | 1.70 | 0 | 145 | 85 | 26.5 | 85 | 25.0 | Example |
| 11 | 215 | 325 | 41.5 | 1.69 | 0 | 248 | 136 | 23.2 | 55 | 16.5 | Comparative Example |
| 12 | 222 | 340 | 40.5 | 1.65 | 19.5 | 120 | 125 | 25.1 | 55 | 16.0 | Comparative Example |
| 13 | 228 | 342 | 40.2 | 1.63 | 11.5 | 217 | 124 | 22.5 | 40 | 17.0 | Comparative Example |
| 14 | 229 | 341 | 39.8 | 1.59 | 0 | 212 | 124 | 25.9 | 70 | 19.0 | Comparative Example |
| 15 | 234 | 346 | 37.9 | 1.56 | 0 | 224 | 121 | 22.5 | 40 | 16.0 | Comparative Example |
| 16 | 248 | 374 | 38.5 | 1.71 | 2.5 | 58 | 100 | 23.7 | 40 | 18.0 | Comparative Example |
| 17 | 255 | 369 | 38.1 | 1.72 | 0 | 133 | 103 | 22.8 | 45 | 16.5 | Comparative Example |
| 18 | 256 | 379 | 38.9 | 1.69 | 0 | 162 | 96 | 21.0 | 40 | 16.0 | Comparative Example |
| 19 | 266 | 391 | 37.4 | 1.59 | 0 | 81 | 87 | 26.0 | 65 | 17.0 | Comparative Example |
| 20 | 264 | 395 | 37.1 | 1.62 | 0 | 201 | 84 | 21.5 | 25 | 16.5 | Comparative Example |

Best Mode 5

The above-described Steel sheet 5 according to the present invention is a steel sheet having particularly superior anti-burring performance (giving small burr height during shearing). The detail of Steel sheet 5 is described in the following.

Carbon: Carbon forms a fine carbide with niobium to give influence to anti-burring performance. If the carbon content is less than 0.004%, the volumetric proportion of NbC is not sufficient, and the burr height cannot be lowered. If the carbon content exceeds 0.01%, the nonuniformity of the grain size distribution of NbC increases to increase the fluctuation of burr height. Accordingly, the carbon content is specified to a range of from 0.004 to 0.01%.

Phosphorus and silicon: Phosphorus and silicon are distributed in steel as relatively coarse inclusions as sulfides and phosphides, and act as the origin or propagation route of cracks during punching working, thus giving an effect of reducing the burr height. Excess addition of phosphorus and silicon enhances the fluctuation of burr height. Accordingly, the phosphorus content is specified to not more than 0.05%, and the sulfur content is specified to not more than 0.02%.

sol.Al: To remove oxygen from steel, sol.Al is added. If the sol.Al content is below 0.01%, a large amount of coarse oxides such as those of manganese and silicon distribute in the steel, and, similar to the excessive addition of phosphorus and silicon, the fluctuation of burr height becomes significant. If the sol.Al content exceeds 0.1%, coarse $Al_2O_3$ is formed to enhance the fluctuation of burr height. Consequently, the sol.Al content is specified to a range of from 0.01 to 0.1%.

Nitrogen: Excessive addition of nitrogen results in coarse nitrides of niobium and aluminum, and results in likely inducing nonuniform crack generation on shearing, which then induces large fluctuation of burr height. Therefore, the nitrogen content is specified to not more than 0.004%.

Titanium: Titanium is an element effective to improve the formability and other characteristics. If, however, titanium is added with niobium, bad influence to the distribution profile of NbC appears. Consequently, the titanium content is specified to not more than 0.03%.

Niobium: As described above, niobium forms carbide, NbC, with carbon, and gives influence to anti-burring performance. To obtain a volumetric proportion and a grain size distribution of NbC, which give excellent anti-burring performance as described below, the niobium content is necessary to be controlled to satisfy the formula (8).

$$1 \leqq (93/12) \times (Nb/C) \leqq 2.5 \quad (8)$$

Figure 19:
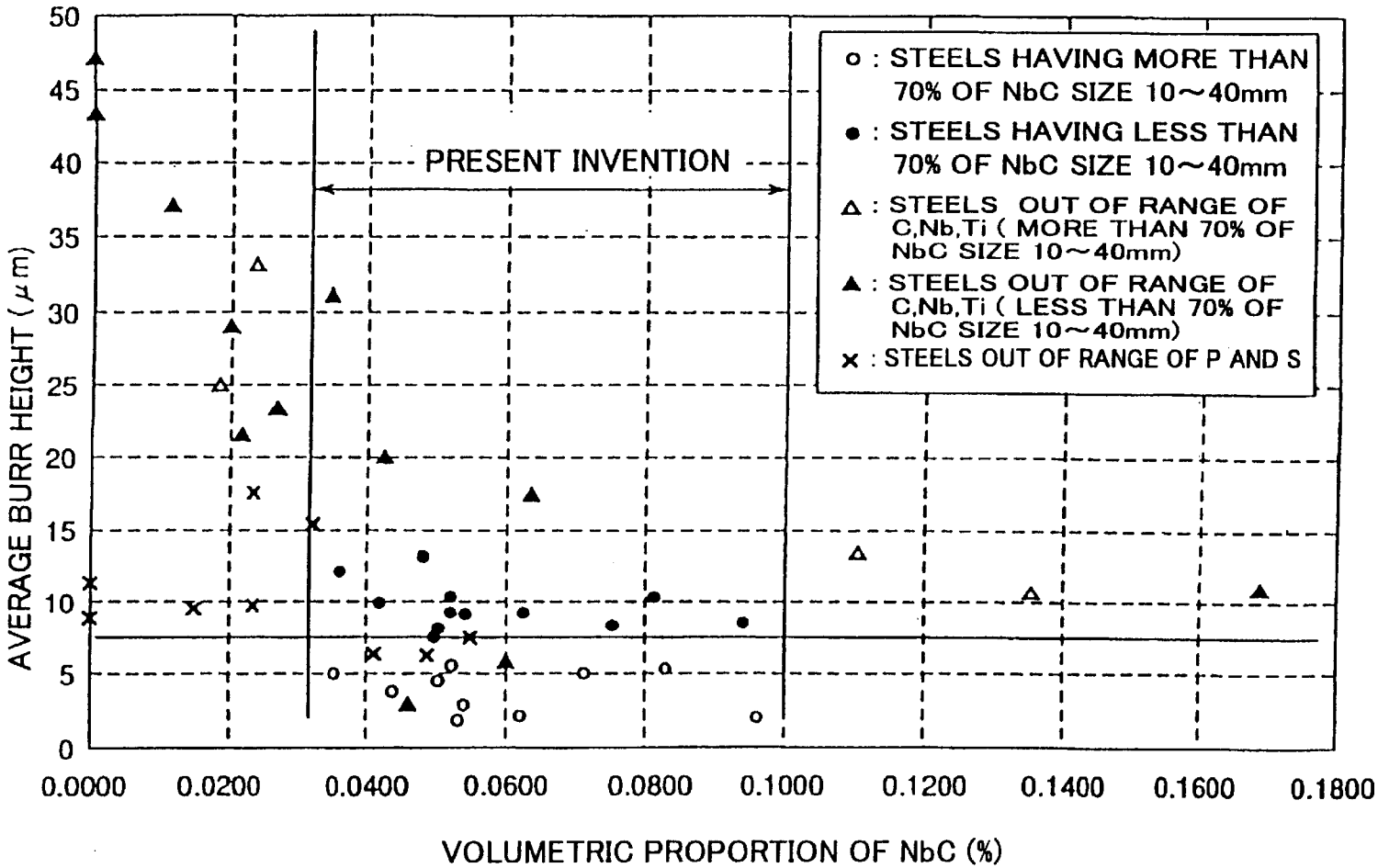
FIG. 19 shows the influence of distribution profile of precipitates on the average burr height.
Figure 20:
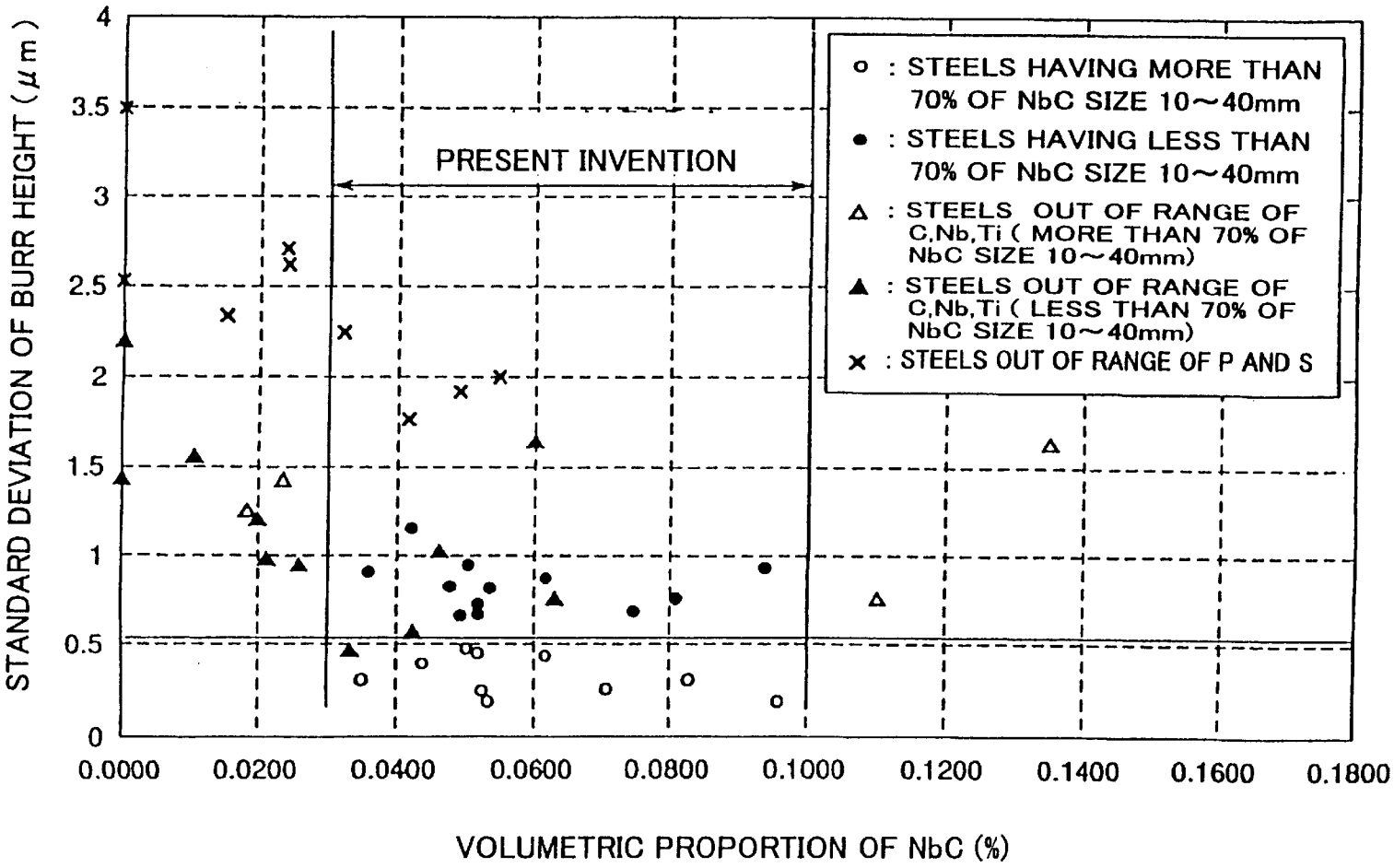
FIG. 20 shows the influence of distribution profile of precipitates on the standard deviation of burr height.

The influence of volumetric proportion and grain size distribution of NbC to the anti-burring performance was investigated on high strength cold rolled steel sheets having various compositions. It was found that, as shown in FIG. 19 and FIG. 20, when the volumetric proportion of NbC is in a range of from 0.03 to 0.1%, and, when 70% or more of the NbC have particle sizes of from 10 to 40 nm, the average burr height is 6 $\mu$m or less, and the standard deviation is as small as 0.5 $\mu$m, thus giving very high anti-burring performance.

Detail mechanism of obtaining excellent anti-burring performance by that type of NbC distribution profile is not fully analyzed. The presumable mechanism is as follows. In the case that the precipitates are distributed in very uniformly and finely in local deformation domains such as shearing line of punching working, many cracks are generated simultaneously from near the precipitates existed in the steel, and these cracks bind together to result in fracture at almost the same time, thus, not only the average value of burr height but also the fluctuation of burr height become very small.

The inventors of the present invention also conducted an investigation on titanium and vanadium, and found no that kind of effect in the case of NbC. The reason is presumably nonuniform size and distribution of these carbides compared with NbC.

Since silicon and manganese did not give bad influence to the characteristics which were investigated in the present invention, the content of these elements is not specifically limited. Therefore, silicon and manganese may be added to a level not degrading other characteristics such as strength and formability.

Boron, vanadium, chromium, and molybdenum may be added at an adequate amount to a range of not more than 10 ppm, not more than 0.2%, not more than 0.5%, and not more than 0.5%, respectively, because these ranges do not harm the effect of the present invention.

The Steel sheet 5 according to the present invention has characteristics of, adding to the excellent anti-burring performance, excellent combined formability, resistance to embrittlement during secondary operation, good surface appearance, uniformity of material in a coil, which characteristics are applicable grades to the automobile exterior panels.

The Steel sheet 5 according to the present invention can be manufactured by the steps of: preparing a continuous casting slab of a steel having the composition adjusted as described above; finish rolling the slab to reduction ratios of HR1 and HR2, at the pass just before the final pass and the final pass, while satisfying the formulae (9) through (11), to prepare hot rolled steel sheet; and cold rolling the hot rolled steel sheet followed by annealing thereof.

$$10 \leqq HR1 \quad (9)$$

$$2 \leqq HR2 \leqq 30 \quad (10)$$

$$HR1 + HR2 - HR1 \times HR2/100 \leqq 60 \quad (11)$$

Since the effect of the present invention is attained unless the run-out cooling after the hot rolled or the cooling after annealed is carried out at cooling speeds of over 200° C./sec, there is no specific limitation on the manufacturing conditions except for the reduction ratios of the pass just before the final pass and the final pass.

The Steel sheet 5 according to the present invention may further be processed, at need, by zinc base plating treatment such as electroplating and hot dip plating, and by organic coating treatment after the plating.

EXAMPLE

Molten steels of Steel Nos. 1 through 35 shown in Tables 15 and 16 were prepared. The melts were then continuously cast to form slabs having 250 mm of thickness. After heating the slabs to 1200° C., hot rolled steel sheets having 2.8 mm of thickness were prepared from the slabs under the condition of 890 to 960° C. of finish temperatures, and 500 to 700° C. of coiling temperatures. The hot rolled sheets were then cold rolled to a thickness of 0.7 mm. The cold rolled sheets were treated by continuous annealing (CAL) at temperatures of from 750 to 900° C., or by continuous annealing followed by hot dip galvanization (CGL), which were then temper-rolled to 0.7% of reduction ratio.

In the case of continuous annealing followed by hot dip galvanization, the hot dip galvanization after the annealing was given at 460° C., and, immediately after the hot dip galvanization, an alloying treatment of plating layer was given at 500° C. in an in-line alloying furnace.

From each of thus obtained steels sheets, 50 pieces of disks each having 50 mm of diameter were punched for testing for measuring the burr height at edges, and the average burr height and the standard deviation of burr height were determined.

The results are shown in Tables 17 through 19.

The steel sheets which have the compositions within specified range of the present invention and which were hot rolled under the conditions within the specified range of the present invention give optimum NbC distribution profile, and give not more than 6 $\mu$m of average burr height with not more than 0.5 $\mu$m of standard deviation of the burr height, which proves the excellent anti-burring performance.

TABLE 15

| Steel No. | C | Si | Mn | P | S | Sol.Al | N | Nb | Ti | B | (93/12) × (Nb/C) | Remarks |
|---|---|---|---|---|---|---|---|---|---|---|---|---|
| 1 | 0.0025* | 0.11 | 0.14 | 0.015 | 0.015 | 0.050 | 0.0015 | 0.033 | — | — | 1.70 | Comparative Steel |
| 2 | 0.0031* | 0.02 | 0.35 | 0.047 | 0.010 | 0.017 | 0.0033 | 0.029 | 0.016 | 0.0008 | 1.21 | Comparative Steel |
| 3 | 0.0022* | 0.10 | 0.12 | 0.011 | 0.014 | 0.046 | 0.0025 | 0.010 | 0.045* | — | 0.59* | Comparative Steel |
| 4 | 0.0038* | 0.17 | 0.23 | 0.052* | 0.013 | 0.026 | 0.0022 | 0.044 | — | — | 1.49 | Comparative Steel |
| 5 | 0.0028* | 0.10 | 0.11 | 0.032 | 0.033* | 0.030 | 0.0018 | 0.040 | — | — | 1.84 | Comparative Steel |
| 6 | 0.0024* | 0.15 | 0.11 | 0.021 | 0.019 | 0.028 | 0.0013 | 0.028 | 0.062* | — | 1.51 | Comparative Steel |
| 7 | 0.0018* | 0.02 | 0.55 | 0.075* | 0.045* | 0.019 | 0.0020 | 0.029 | — | — | 2.08 | Comparative Steel |
| 8 | 0.0022* | 0.06 | 0.11 | 0.022 | 0.018 | 0.020 | 0.0031 | 0.052 | — | — | 3.05* | Comparative Steel |
| 9 | 0.0028* | 0.02 | 0.22 | 0.030 | 0.010 | 0.017 | 0.0017 | 0.085 | — | — | 3.92* | Comparative Steel |
| 10 | 0.0062 | 0.05 | 0.35 | 0.022 | 0.017 | 0.025 | 0.0026 | 0* | — | — | 0* | Comparative Steel |
| 11 | 0.0049 | 0.01 | 0.20 | 0.015 | 0.016 | 0.020 | 0.0015 | 0* | 0.075* | — | 0* | Comparative Steel |
| 12 | 0.0069 | 0.15 | 0.42 | 0.018 | 0.018 | 0.021 | 0.0020 | 0.031 | — | — | 0.58* | Comparative Steel |
| 13 | 0.0056 | 0.20 | 0.45 | 0.020 | 0.014 | 0.029 | 0.0019 | 0.039 | — | — | 0.90* | Comparative Steel |
| 14 | 0.0045 | 0.02 | 0.75 | 0.016 | 0.066* | 0.019 | 0.0019 | 0.022 | — | — | 0.63* | Comparative Steel |
| 15 | 0.0062 | 0.10 | 0.50 | 0.022 | 0.015 | 0.025 | 0.0025 | 0.050 | — | — | 1.04 | Example Steel |
| 16 | 0.0042 | 0.04 | 0.94 | 0.042 | 0.007 | 0.039 | 0.0031 | 0.045 | — | — | 1.38 | Example Steel |
| 17 | 0.0081 | 0.44 | 1.26 | 0.026 | 0.011 | 0.031 | 0.0026 | 0.069 | 0.015 | 0.0003 | 1.10 | Example Steel |
| 18 | 0.0075 | 0.31 | 0.12 | 0.012 | 0.010 | 0.045 | 0.0017 | 0.094 | — | — | 1.62 | Example Steel |

Units in Wt %
Values marked with * are not included in this invention.

TABLE 16

| Steel No. | C | Si | Mn | P | S | Sol.Al | N | Nb | Ti | B | (93/12) × (Nb/C) | Remarks |
|---|---|---|---|---|---|---|---|---|---|---|---|---|
| 19 | 0.0060 | 0.01 | 0.25 | 0.025 | 0.008 | 0.033 | 0.0017 | 0.075 | 0.027 | — | 1.61 | Example Steel |
| 20 | 0.0070 | 0.22 | 0.36 | 0.025 | 0.015 | 0.033 | 0.0029 | 0.130 | — | — | 2.40 | Example Steel |
| 21 | 0.0041 | 0.03 | 0.45 | 0.031 | 0.004 | 0.056 | 0.0020 | 0.060 | — | — | 1.89 | Example Steel |
| 22 | 0.0059 | 0.02 | 0.20 | 0.020 | 0.019 | 0.060 | 0.0025 | 0.100 | — | — | 2.19 | Example Steel |
| 23 | 0.0095 | 0.16 | 0.78 | 0.017 | 0.011 | 0.018 | 0.0021 | 0.150 | — | 0.0007 | 2.04 | Example Steel |
| 24 | 0.0064 | 0.76 | 1.86 | 0.020 | 0.013 | 0.021 | 0.0015 | 0.063 | — | — | 1.27 | Example Steel |
| 25 | 0.0065 | 0.22 | 0.33 | 0.069* | 0.015 | 0.048 | 0.0020 | 0.074 | 0.020 | — | 1.47 | Comparative Steel |
| 26 | 0.0049 | 0.18 | 0.50 | 0.031 | 0.028* | 0.017 | 0.0029 | 0.060 | — | — | 1.58 | Comparative Steel |
| 27 | 0.0075 | 0.03 | 0.42 | 0.018 | 0.011 | 0.015 | 0.0023 | 0.080 | 0.045* | — | 1.38 | Comparative Steel |

TABLE 16-continued

| Steel No. | C | Si | Mn | P | S | Sol.Al | N | Nb | Ti | B | (93/12) × (Nb/C) | Remarks |
|---|---|---|---|---|---|---|---|---|---|---|---|---|
| 28 | 0.0058 | 0.15 | 0.41 | 0.021 | 0.056* | 0.020 | 0.0018 | 0.055 | — | — | 1.22 | Comparative Steel |
| 29 | 0.0048 | 0.05 | 0.22 | 0.033 | 0.062* | 0.022 | 0.0025 | 0* | — | — | 0 | Comparative Steel |
| 30 | 0.0084 | 0.11 | 0.33 | 0.063* | 0.018 | 0.018 | 0.0031 | 0* | — | — | 0 | Comparative Steel |
| 31 | 0.0120* | 0.12 | 0.25 | 0.015 | 0.018 | 0.062 | 0.0014 | 0.130 | — | — | 1.40 | Comparative Steel |
| 32 | 0.0160* | 0.44 | 0.50 | 0.014 | 0.012 | 0.033 | 0.0020 | 0.210 | — | — | 1.69 | Comparative Steel |
| 33 | 0.0200* | 0.20 | 0.85 | 0.032 | 0.015 | 0.025 | 0.0022 | 0.320 | — | — | 2.06 | Comparative Steel |
| 34 | 0.0055 | 0.10 | 0.15 | 0.010 | 0.015 | 0.024 | 0.0019 | 0.110 | — | — | 2.58* | Comparative Steel |
| 35 | 0.0071 | 0.09 | 0.10 | 0.023 | 0.016 | 0.031 | 0.0015 | 0.190 | — | — | 3.45* | Comparative Steel |

Units in Wt %

Values marked with * are not included in this invention.

TABLE 17

| Steel No. | Sheet No. | Sheet thickness (mm) | Hot rolling condition HR2 (%) | HR1 (%) | HR + HR2 (%) | Type | TS (MPa) | Volumetric proportion of NbC (%) | Proportion of particles of sizes between 10 and 40 nm (%) | Average burr height (μm) | Standard deviation (μm) | Remarks |
|---|---|---|---|---|---|---|---|---|---|---|---|---|
| 1 | 1 | 0.7 | 25 | 15 | 36.3 | CAL | 309 | 0.021* | 10* | 21.5 | 0.98 | Comparative Example |
| 2 | 2 | 0.7 | 25 | 15 | 36.3 | CAL | 341 | 0.026* | 13* | 23.4 | 0.95 | Comparative Example |
| 3 | 3 | 0.7 | 25 | 15 | 36.3 | CAL | 304 | 0.011* | 5* | 37.1 | 1.56 | Comparative Example |
| 4 | 4 | 0.7 | 25 | 15 | 36.3 | CAL | 355 | 0.032* | 42* | 15.4 | 2.25 | Comparative Example |
| 5 | 5 | 0.7 | 25 | 15 | 36.3 | CAL | 325 | 0.024* | 26* | 17.6 | 2.70 | Comparative Example |
| 6 | 6 | 0.7 | 25 | 15 | 36.3 | CAL | 318 | 0.020* | 31* | 29.1 | 1.21 | Comparative Example |
| 7 | 7 | 0.7 | 25 | 15 | 36.3 | CAL | 376 | 0.015* | 15* | 9.6 | 2.33 | Comparative Example |
| 8 | 8 | 0.7 | 25 | 15 | 36.3 | CAL | 311 | 0.018* | 76 | 25.0 | 1.26 | Comparative Example |
| 9 | 9 | 0.7 | 25 | 15 | 36.3 | CAL | 320 | 0.024* | 79 | 33.1 | 1.43 | Comparative Example |
| 10 | 10 | 0.7 | 25 | 15 | 36.3 | CAL | 321 | 0* | 0* | 46.8 | 2.19 | Comparative Example |
| 11 | 11 | 0.7 | 25 | 15 | 36.3 | CAL | 304 | 0* | 23* | 43.3 | 1.44 | Comparative Example |
| 12 | 12 | 0.7 | 25 | 15 | 36.3 | CAL | 328 | 0.034* | 35* | 31.1 | 0.48 | Comparative Example |
| 13 | 13 | 0.7 | 25 | 15 | 36.3 | CAL | 335 | 0.042 | 32* | 20.0 | 0.55 | Comparative Example |
| 14 | 14 | 0.7 | 25 | 15 | 36.3 | CAL | 325 | 0.024* | 22* | 9.8 | 2.62 | Comparative Example |
| 15 | 15A | 0.7 | 40 | 10 | 46.0 | CAL | 330 | 0.052 | 73 | 5.5 | 0.45 | Example |
| 15 | 15B | 0.7 | 40 | 10 | 46.0 | CGL | 335 | 0.053 | 75 | 5.1 | 0.47 | Example |
| 15 | 15D | 0.7 | 5 | 10 | 14.5 | CAL | 330 | 0.052 | 59 | 9.2 | 0.66 | Comparative Example |
| 16 | 16A | 0.7 | 25 | 15 | 36.3 | CAL | 359 | 0.035 | 78 | 5.0 | 0.31 | Example |
| 16 | 16B | 0.7 | 25 | 15 | 36.3 | CGL | 342 | 0.034 | 73 | 4.8 | 0.29 | Example |
| 16 | 16D | 0.7 | 40 | 1 | 40.6 | CAL | 340 | 0.036 | 47* | 12.0 | 0.90 | Comparative Example |

Values marked with * are not included in this invention.

TABLE 18

| Steel No. | Sheet No. | Sheet thickness (mm) | Hot rolling condition HR2 (%) | HR1 (%) | HR + HR2 (%) | Type | TS (MPa) | Volumetric proportion of NbC (%) | Proportion of particles of sizes between 10 and 40 nm (%) | Average burr height (μm) | Standard deviation (μm) | Remarks |
|---|---|---|---|---|---|---|---|---|---|---|---|---|
| 17 | 17A | 0.7 | 55 | 3 | 56.4 | CAL | 391 | 0.083 | 89 | 5.3 | 0.30 | Example |
| 17 | 17B | 0.7 | 55 | 3 | 56.4 | CGL | 386 | 0.085 | 84 | 5.1 | 0.33 | Example |
| 17 | 17C | 0.7 | 50 | 22 | 61.0 | CAL | 383 | 0.081 | 60* | 10.2 | 0.75 | Comparative Example |
| 18 | 18A | 0.7 | 12 | 12 | 22.6 | CAL | 325 | 0.071 | 77 | 4.9 | 0.25 | Example |
| 18 | 18B | 0.7 | 20 | 35 | 48.0 | CAL | 328 | 0.075 | 53* | 8.0 | 0.67 | Comparative Example |
| 19 | 19A | 0.7 | 40 | 18 | 50.8 | CAL | 316 | 0.050 | 92 | 4.5 | 0.47 | Example |
| 19 | 19B | 0.7 | 45 | 30 | 61.5 | CAL | 318 | 0.050 | 66* | 8.0 | 0.95 | Comparative Example |
| 19 | 19C | 0.7 | 10 | 32 | 38.8 | CAL | 315 | 0.048 | 47* | 13.1 | 0.81 | Comparative Example |
| 20 | 20A | 0.7 | 15 | 2 | 16.7 | CAL | 339 | 0.062 | 80 | 2.1 | 0.44 | Example |
| 20 | 20C | 0.7 | 8 | 20 | 26.4 | CAL | 333 | 0.062 | 56* | 9.1 | 0.86 | Comparative Example |
| 21 | 21A | 0.7 | 30 | 5 | 33.5 | CAL | 330 | 0.044 | 71 | 3.8 | 0.39 | Example |
| 21 | 21C | 0.7 | 65 | 5 | 66.8 | CAL | 326 | 0.042 | 40* | 9.8 | 1.15 | Comparative Example |
| 22 | 22A | 0.7 | 20 | 28 | 42.4 | CAL | 311 | 0.053 | 88 | 1.9 | 0.24 | Example |
| 22 | 22B | 0.7 | 0 | 40 | 40.0 | CAL | 310 | 0.050 | 32* | 7.5 | 0.65 | Comparative Example |
| 22 | 22C | 0.7 | 40 | 40 | 64.0 | CAL | 315 | 0.052 | 49* | 10.3 | 0.72 | Comparative Example |
| 23 | 23A | 0.7 | 35 | 24 | 50.6 | CGL | 342 | 0.096 | 92 | 2.1 | 0.20 | Example |
| 23 | 23B | 0.7 | 35 | 24 | 50.6 | CAL | 340 | 0.091 | 83 | 1.8 | 0.22 | Example |
| 23 | 23C | 0.7 | 8 | 2 | 9.8 | CAL | 343 | 0.094 | 26* | 8.5 | 0.93 | Comparative Example |
| 24 | 24A | 0.7 | 20 | 20 | 36.0 | CAL | 432 | 0.054 | 81 | 2.9 | 0.19 | Example |
| 24 | 24C | 0.7 | 55 | 15 | 61.8 | CAL | 428 | 0.054 | 60* | 9.0 | 0.81 | Comparative Example |

Values marked with * are not included in this invention.

TABLE 19

| Steel No. | Sheet No. | Sheet thickness (mm) | Hot rolling condition HR2 (%) | HR1 (%) | HR + HR2 (%) | Type | TS (MPa) | Volumetric proportion of NbC (%) | Proportion of particles of sizes between 10 and 40 nm (%) | Average burr height (μm) | Standard deviation (μm) | Remarks |
|---|---|---|---|---|---|---|---|---|---|---|---|---|
| 25 | 25 | 0.7 | 25 | 15 | 36.3 | CAL | 372 | 0.055 | 78 | 7.4 | 2.01 | Comparative Example |
| 26 | 26 | 0.7 | 25 | 15 | 36.3 | CAL | 345 | 0.041 | 80 | 6.3 | 1.77 | Comparative Example |
| 27 | 27 | 0.7 | 25 | 15 | 36.3 | CAL | 318 | 0.063 | 53* | 17.7 | 0.76 | Comparative Example |
| 28 | 28 | 0.7 | 25 | 15 | 36.3 | CAL | 330 | 0.049 | 75 | 6.1 | 1.93 | Comparative Example |
| 29 | 29 | 0.7 | 25 | 15 | 36.3 | CAL | 326 | 0* | 0* | 8.5 | 2.52 | Comparative Example |
| 30 | 30 | 0.7 | 25 | 15 | 36.3 | CAL | 367 | 0* | 0* | 11.1 | 3.51 | Comparative Example |
| 31 | 31 | 0.7 | 25 | 15 | 36.3 | CAL | 319 | 0.110* | 80 | 13.2 | 0.77 | Comparative Example |
| 32 | 32 | 0.7 | 25 | 15 | 36.3 | CAL | 356 | 0.135* | 72 | 10.5 | 1.65 | Comparative Example |
| 33 | 33 | 0.7 | 25 | 15 | 36.3 | CAL | 368 | 0.168* | 51* | 11.0 | 2.80 | Comparative Example |
| 34 | 34 | 0.7 | 25 | 15 | 36.3 | CAL | 305 | 0.046* | 27* | 3.3 | 1.03 | Comparative Example |
| 35 | 35 | 0.7 | 25 | 15 | 36.3 | CAL | 317 | 0.060* | 15* | 6.1 | 1.65 | Comparative Example |

Values marked with * are not included in this invention.

Best Mode 6

The above-described Steel sheet 6 according to the present invention is a steel sheet having particularly superior surface condition. The detail of Steel sheet 6 is described-in the following.

Carbon: Carbon forms a fine carbide with niobium to increase the strength of the steel, and to increase the r values by reducing the size of grains after annealed. Since the precipitation of strengthening owing to the fine carbide is utilized, excellent surface appearance is attained without need of addition of large amount of silicon, manganese, and phosphorus. If the carbon content is less than 0.0040%, the effect of carbon addition becomes less. If the carbon content exceeds 0.010%, the ductility degrades. Accordingly, the carbon content is specified to a range of from 0.0040 to 0.010%, preferably from 0.0050 to 0.0080%, most preferably from 0.0050 to 0.0074%.

Silicon: Excessive addition of silicon degrades the adhesiveness of zinc plating. Therefore, the silicon content is specified to not more than 0.05%.

Manganese: Manganese precipitates sulfur in the steel as MnS to prevent the hot crack generation of slabs and to bring the steel to high strength without degrading the zinc plating adhesiveness. If the manganese content is less than 0.1%, the effect of precipitation of sulfur does not appear. If the manganese content exceeds 1.5%, the strength significantly increases and the ductility reduces. Consequently, the manganese content is specified to a range of from 0.1 to 1.5%.

Phosphorus: Phosphorus is necessary for increasing strength of the steel, to amounts of 0.01% or more. If the phosphorus content exceeds 0.05%, however, degradation of toughness at welded portions and insufficient adhesion of zinc plaint are generated. Accordingly, the phosphorus content is specified to a range of from 0.01 to 0.05%.

Sulfur: If sulfur content exceeds 0.02%, the ductility degrades. Therefore, the sulfur content is specified to not more than 0.02%.

sol.Al: To remove oxygen from steel, sol.Al is added. If the sol.Al content is below 0.01%, the effect of addition is not satisfactory. If the sol.Al content exceeds 0.1%, solid solution aluminum induces degradation of ductility. Consequently, the sol.Al content is specified to a range of from 0.01 to 0.1%.

Nitrogen: The nitrogen forms solid solution in steel to cause surface defects such as stretcher-strain. Therefore, the nitrogen content is specified to not more than 0.0100%.

Niobium: Niobium forms fine carbide with carbon to increase the strength of steel, and improves the surface condition and the combined formability characteristics by reducing the grain sizes. If, however, the niobium content is less than 0.036%, the effect of the niobium addition cannot be attained. If the niobium content exceeds 0.14%, the yield strength increases and the ductility degrades. Therefore, the niobium content is specified to a range of from 0.036 to 0.14%, preferably from 0.080 to 0.14%.

Solely specifying the individual components of steel cannot necessarily lead to excellent surface appearance and combined formability characteristics. It is necessary for the steel sheets further to satisfy the formula (12), and to limit the average grain size to not more than 10 $\mu$m and the r value to not less than 1.8.

$$1.1<(Nb\times12)/(C\times93)<2.5 \quad (12)$$

The value of [(Nb×12)/(C×93)] is specified to more than 1.5, preferably not less than 1.7, to make the role of NbC more effective.

To the Steel sheet 6 according to the present invention, the addition of titanium is effective to enhance the reduction of grain sizes, at amounts of not more than 0.019%, preferably from 0.005 to 0.019%, while satisfying the formula (13).

$$Ti\leqq(48/14)\times N+(48/32)\times S \quad (13)$$

To improve the resistance to embrittlement during secondary operation, it is effective to add boron to not more than 0.0015%.

The Steel sheet 6 according to the present invention has characteristics of, adding to the excellent surface appearance, excellent combined formability, resistance to embrittlement during secondary operation, anti-burring performance, uniformity of material in a coil, which characteristics are applicable grades to the automobile exterior panels.

The steel sheet 6 is manufactured by the steps of: preparing a continuous casting slab of a steel which has the composition described above, including the addition of titanium and boron; preparing a sheet bar by either direct rolling or heating the slab to temperatures of from 1100 to 1250° C. followed by rough rolling; finish rolling the sheet bar to 10 to 40% of total reduction ratios of the pass just before the final pass and the final pass to produce a hot rolled steel sheet; coiling the hot rolled steel sheet at cooling speeds of 15° C./sec or more to temperatures below 700° C., followed by coiling at temperatures of from 620 to 670° C.; cold rolling the coiled hot rolled steel sheet at 50% or more reduction ratios, followed by heating the steel sheet at 20° C./sec or more of heating speeds, then annealing the steel sheet at temperatures between 860° C. and Ar3 transformation temperature; and temper rolling the annealed steel sheet at 0.4 to 1.0% reduction ratios.

For reheating the slab, temperatures of less than 1100° C. results in significantly high deformation resistance during hot rolling, and temperatures of more than 1250° C. induces generation of excessive amount of scale to possibly degrade the surface appearance. Accordingly, the slab reheating is necessary to be conducted at temperatures of from 1100 to 1250° C.

In the finish rolling, the total reduction ratios of the pass just before the final pass and the final pass is necessary to limit to not less than 10% for reducing the grain sizes after annealed, and not more than 40% for preventing the generation of nonuniform rolling texture. The sheet thickness after rolled is preferably in a range of from 2.0 to 4.5 mm to secure required reduction ratio in succeeding cold rolling.

After the hot rolling, the steel sheet is required to be cooled to temperatures of not more than 700° C. at cooling speeds of not less than 15° C./sec to prevent generation of coarse grains.

The coiling is necessary to be carried out at temperatures of from 620 to 670° C in view of enhancing the precipitation of AlN and of descaling by pickling.

The reduction ratio during the cold rolling is necessary to be 50% or more for obtaining high r values.

The annealing is required to be conducted at temperatures of from 860° C. and Ac3 transformation temperature with the heating speeds of 20° C./sec or more for preventing the degradation of surface appearance resulted from coarse grain formation and for attaining large r values.

The temper rolling is requested to be done at reduction ratios of from 0.4 to 1.0% for suppressing aging and for preventing increase in yield strength.

The Steel sheet 6 according to the present invention may further be processed, at need, by zinc base plating treatment such as electroplating and hot dip plating, and by organic coating treatment after the plating.

EXAMPLE 1

Molten steels of Steel Nos. 1 through 13 shown in Table 20 were prepared. The melts were then continuously cast to form slabs having 250 mm of thickness. After heating the slabs to 1200° C., hot rolled steel sheets having 2.8 mm of thickness were prepared from the slabs under the condition of 880 to 910° C. of finish temperatures, at 20° C./sec of average cooling speed, and 640° C. of coiling temperature. The hot rolled sheets were then cold rolled to a thickness of 0.7 mm. The cold rolled sheets were heated at about 30° C./sec of heating speed, then treated by continuous annealing at a temperature of 865° C. for 60 seconds, followed by hot dip galvanization, which were then temper-rolled to 0.7% of reduction ratio.

Thus obtained steel sheets were tested to determine mechanical characteristics (along the rolling direction; with JIS Class 5 specimens), r values, surface appearance, and resistance to surface roughness.

The test results are shown in Table 21.

Example Steels Nos. 1 through 9 which have the composition within a range of the present invention and which were manufactured under the conditions specified by the present invention have not more than 10 $\mu$m of average grain sizes, and not less than 1.8 of r values, and they are superior in surface appearance and resistance to surface roughness.

On the other hand, Comparative Steel No. 10 is inferior in resistance to surface roughness because the carbon content is less than 0.0040% resulting in coarse grains. Comparative Steel No. 11 is inferior in r values because the carbon content exceeds 0.0010%, resulting in excessive precipitation of NbC. Comparative Steel No. 12 is inferior in elongation and r values because the value of [(Nb×12)/(C×93)] is not more than 1.1 so that the solid solution carbon is left in the steel. Comparative Steel No. 13 is inferior in elongation and r values because the value of [(Nb×12)/(C×93)] is not less than 2.5.

EXAMPLE 2

With the slabs of Steel Nos. 1 through 5 fshown in Table 20, hot dip galvanized steel sheets were prepared under the appearance of hot rolling and annealing given in Table 22.

The similar investigation with Example 1 was conducted.

The results are shown in Table 22.

Example Steel sheets A, C, and E, which were prepared under the condition within the range of the present invention give not more than 10 $\mu$m of average grain sizes and not less than 1.8 of r values, thus proving the excellent surface appearance and resistance to surface roughness.

On the other hand, Comparative Steel sheets B and F give low r values and poor formability.

TABLE 20

| Steel No. | C | Si | Mn | P | S | Sol.Al | N | Nb | Ti | B | (93/12) × (Nb/C) | Remarks |
|---|---|---|---|---|---|---|---|---|---|---|---|---|
| 1 | 0.0060 | 0.01 | 0.35 | 0.018 | 0.008 | 0.056 | 0.0021 | 0.081 | — | — | 1.74 | Example Steel |
| 2 | 0.0050 | 0.01 | 0.69 | 0.042 | 0.008 | 0.062 | 0.0020 | 0.082 | — | — | 2.12 | Example Steel |
| 3 | 0.0090 | 0.01 | 0.38 | 0.027 | 0.008 | 0.022 | 0.0019 | 0.081 | — | — | 1.16 | Example Steel |
| 4 | 0.0060 | 0.01 | 0.51 | 0.017 | 0.008 | 0.042 | 0.0023 | 0.055 | — | — | 1.18 | Example Steel |
| 5 | 0.0060 | 0.01 | 0.31 | 0.041 | 0.008 | 0.058 | 0.0018 | 0.115 | — | — | 2.47 | Example Steel |
| 6 | 0.0055 | 0.01 | 0.45 | 0.045 | 0.008 | 0.043 | 0.0049 | 0.060 | — | — | 1.41 | Example Steel |
| 7 | 0.0045 | 0.01 | 0.55 | 0.035 | 0.009 | 0.060 | 0.0083 | 0.042 | — | — | 1.20 | Example Steel |
| 8 | 0.0060 | 0.01 | 0.31 | 0.036 | 0.008 | 0.040 | 0.0019 | 0.083 | 0.008 | — | 1.78 | Example Steel |
| 9 | 0.0060 | 0.01 | 0.53 | 0.047 | 0.008 | 0.046 | 0.0022 | 0.081 | 0.015 | 0.0010 | 1.74 | Example Steel |
| 10 | 0.0025* | 0.01 | 0.38 | 0.033 | 0.010 | 0.026 | 0.0021 | 0.020* | 0.020 | — | 1.03* | Comparative Steel |
| 11 | 0.0105* | 0.01 | 0.70 | 0.039 | 0.008 | 0.024 | 0.0024 | 0.100 | — | — | 1.23 | Comparative Steel |
| 12 | 0.0065 | 0.01 | 0.80 | 0.018 | 0.008 | 0.049 | 0.0018 | 0.050 | — | — | 0.99* | Comparative Steel |
| 13 | 0.0065 | 0.01 | 0.61 | 0.020 | 0.008 | 0.034 | 0.0022 | 0.130 | — | — | 2.58* | Comparative Steel |

Units in Wt %
Values marked with * are not included in this invention.

TABLE 21

| Steel No. | TS (MPa) | El (%) | r value | Average particle size ($\mu$m) | Surface appearance | Resistance to surface roughness | Remarks |
|---|---|---|---|---|---|---|---|
| 1 | 350 | 42.9 | 2.14 | 8.6 | A | ○ | Example |
| 2 | 385 | 40.5 | 2.03 | 8.1 | A | ○ | Example |
| 3 | 360 | 41.7 | 1.97 | 7.8 | A | ○ | Example |
| 4 | 354 | 42.4 | 1.99 | 9.3 | A | ○ | Example |

TABLE 21-continued

| Steel No. | TS (MPa) | El (%) | r value | Average particle size (μm) | Surface appearance | Resistance to surface roughness | Remarks |
|---|---|---|---|---|---|---|---|
| 5 | 371 | 40.4 | 2.02 | 8.1 | A | ○ | Example |
| 6 | 380 | 39.5 | 1.91 | 9.2 | A | ○ | Example |
| 7 | 373 | 40.2 | 1.96 | 9.5 | A | ○ | Example |
| 8 | 376 | 39.9 | 1.90 | 7.3 | B | ○ | Example |
| 9 | 385 | 38.9 | 1.95 | 9.9 | B | ○ | Example |
| 10 | 345 | 43.5 | 2.17 | 19.0 | C | X | Comparative Example |
| 11 | 392 | 34.5 | 1.78 | 6.9 | A | ○ | Comparative Example |
| 12 | 375 | 37.5 | 1.65 | 8.1 | B | ○ | Comparative Example |
| 13 | 370 | 36.5 | 1.58 | 6.4 | A | ○ | Comparative Example |

TABLE 22

| Symbol | Steel No. | Heating temperature (° C.) | Total reduction ratio of the pass just before the final pass and the final pass (%) | Finish temperature (° C.) | Annealing temperature (° C.) | TS (MPa) | El (%) | r value | Average particle size (μm) | Surface appearance | Resistance to surface roughness | Remarks |
|---|---|---|---|---|---|---|---|---|---|---|---|---|
| A | 1 | 1120 | 15 | 900 | 860 | 348 | 43.2 | 2.15 | 8.9 | A | ○ | Example |
| B | 4 | 1180 | 43 | 910 | 860 | 354 | 42.4 | 1.65 | 8.5 | A | ○ | Comparative Example |
| C | 5 | 1200 | 15 | 890 | 865 | 371 | 40.4 | 2.02 | 8.1 | A | ○ | Example |
| D | 1 | 1230 | 18 | 930 | 860 | 350 | 42.9 | 1.88 | 8.6 | A | ○ | Example |
| E | 2 | 1200 | 25 | 890 | 840 | 390 | 38.9 | 1.85 | 7.5 | A | ○ | Example |
| F | 3 | 1210 | 30 | 900 | 820 | 365 | 41.7 | 1.70 | 7.2 | A | ○ | Comparative Example |

Best Mode 7

The above-described Steel sheet 7 according to the present invention is a steel sheet having particularly superior uniformity of material in a coil. The detail of Steel sheet 7 is described in the following.

Carbon: Carbon forms a fine carbide with niobium to increase the strength of the steel, and to increase the n values in the low strain domains, thus improving the resistance to surface strain. If the carbon content is less than 0.0050%, the effect of carbon addition becomes less. If the carbon content exceeds 0.010%, the ductility degrades. Accordingly, the carbon content is specified to a range of from 0.0050 to 0.010%, preferably from 0.0050 to 0.0080%, most preferably from 0.0050 to 0.0074%.

Silicon: Excessive addition of silicon degrades the chemical surface treatment performance of cold rolled steels, and degrades the adhesiveness of plating to hot dip galvanized steel sheets. Therefore, the silicon content is specified to not more than 0.05%.

Manganese: Manganese precipitates sulfur in the steel as MnS to prevent the hot crack generation of slabs and to bring the steel to high strength without degrading the zinc plating adhesiveness. If the manganese content is less than 0.10%, the effect of precipitation of sulfur does not appear. If the manganese content exceeds 1.5%, the strength significantly increases, and reduces the n values in low stress domains. Consequently, the manganese content is specified to a range of from 0.10 to 1.5%.

Phosphorus: Phosphorus is necessary for increasing strength of the steel, to amounts of 0.01% or more. If the phosphorus content exceeds 0.05%, however, the alloying treatment performance of zinc plating degrades, thus inducing insufficient adhesion of plating. Accordingly, the phosphorus content is specified to a range of from 0.01 to 0.05%.

Sulfur: If sulfur content exceeds 0.02%, the ductility degrades. Therefore, the sulfur content is specified to not more than 0.02%.

sol.Al: A function of sol.Al is to reduce the harm of solid solution nitrogen by precipitating the nitrogen in the steel as AlN. If the sol.Al content is below 0.01%, the effect of addition is not satisfactory. If the sol.Al content exceeds 0.1%, the effect is not so improved for the added amount of sol.Al. Consequently, the sol.Al content is specified to a range of from 0.01 to 0.1%.

Nitrogen: As small amount of nitrogen as possible is preferred. In view of cost, the nitrogen content is specified to not more than 0.004%.

Niobium: Niobium forms fine carbide with carbon to increase the strength of steel, and increases the n values in low strain domains, thus improving the resistance to surface strain. If, however, the niobium content is less then 0.01%, the effect of the niobium addition cannot be attained. If the niobium content exceeds 0.20%, the yield strength significantly increases and the n values in low strain domains decreases. Therefore, the niobium content is specified to a range of from 0.01 to 0.20%, preferably from 0.035 to 0.20%, and most preferably from 0.080 to 0.140%.

Solely specifying the individual components of steel cannot necessarily lead to a high strength cold rolled sheet having excellent uniformity of material in a coil, deep drawability, and punch stretchability. It is necessary for the steel sheet further to satisfy the condition given below.

A slab consisting essentially of 0.0061% C, 0.01% Si, 0.30% Mn, 0.02% P, 0.005% S, 0.050% sol.Al., 0.0024% N, 0.040 to 0.170% Nb, by weight, was finish rolled at 900° C. of finish temperature and 40% of total reduction ratio of the pass just before the final pass and the final pass. The rolled sheet was coiled at temperatures of from 580 to 680° C., followed by cold rolled to obtain a sheet having 0.8 mm of thickness. The cold rolled sheet was then continuously annealed at 850° C., and was temper rolled to 0.7% of reduction ratio. Thus prepared steel sheet was tested to determine the uniformity of material in a coil.

Figure 21:
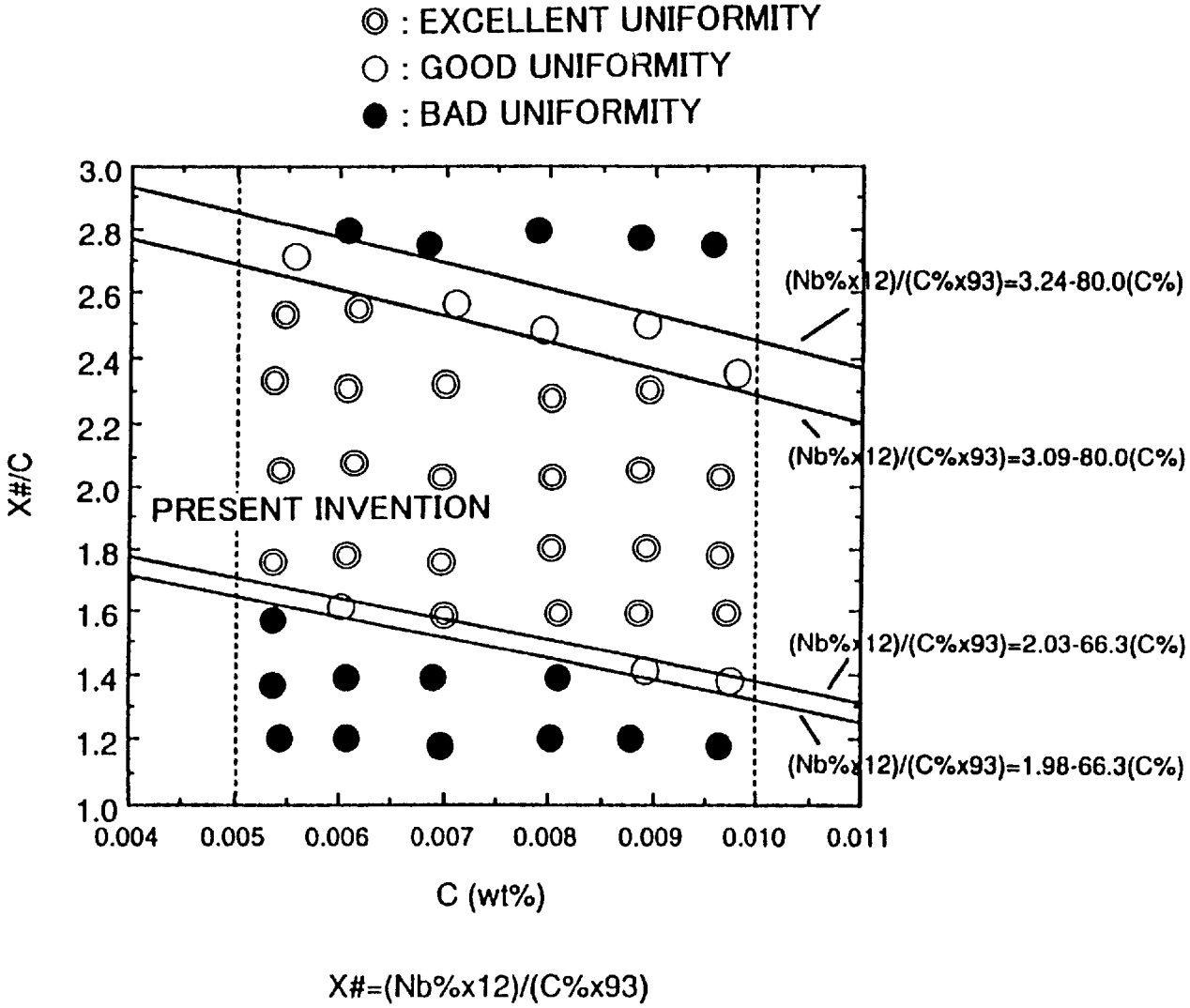
FIG. 21 shows the influence of [(Nb×12)/(C×93)] and C on the uniformity of material in a coil.

FIG. 21 shows the influence of [(Nb×12)/(C×93)] and C on the uniformity of material in a coil.

When the value of [(Nb×12)/(C×93)] satisfies the formula (14), excellent uniformity of material in a coil is obtained.

$$1.98\times66.3\times C\leqq(Nb\leqq12)/(C\times93)\leqq3.24-80.0\times C \quad (14)$$

As for the deep drawability, the above-prepared steel sheet was used for evaluating the characteristic by determining the limit drawing ratio during the cylinder forming described in the Best Mode 1, and the hat forming height after the hat forming test.

Figure 22:
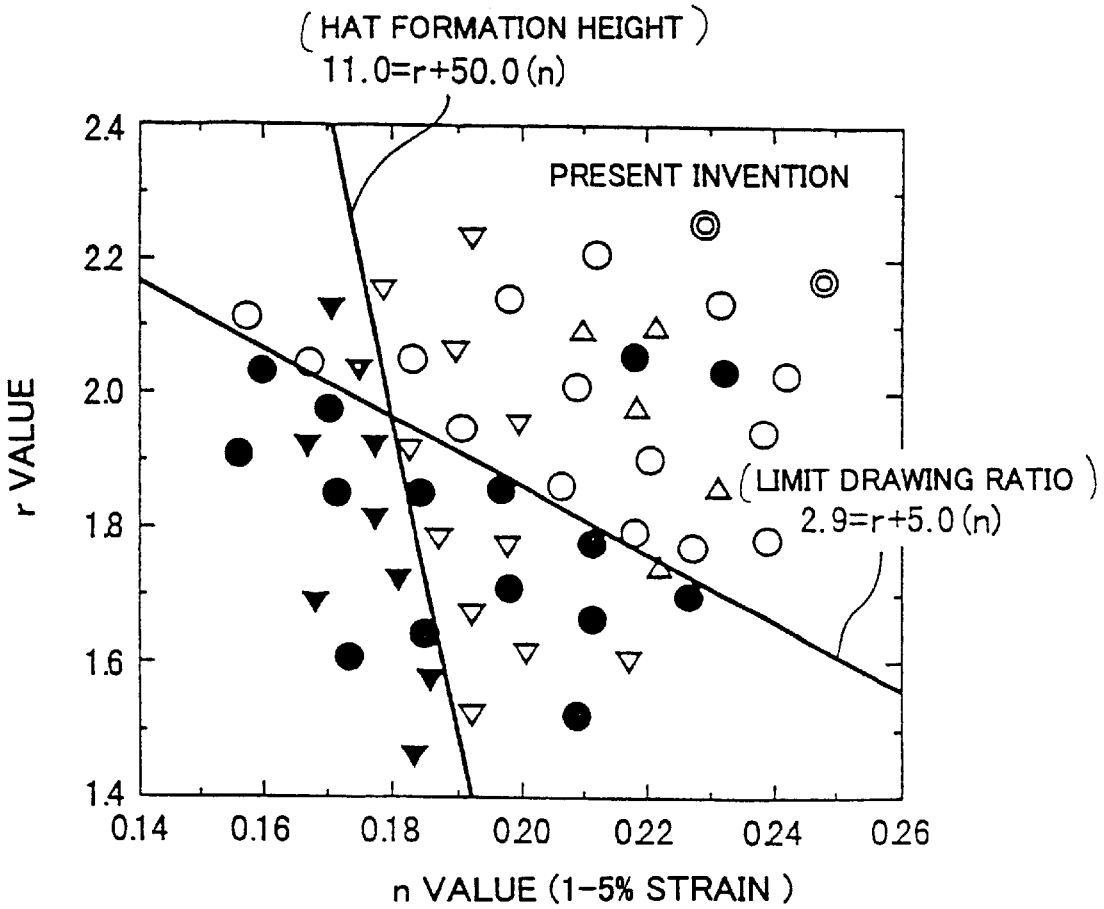
FIG. 22 shows the influence of r values and n values on the deep drawability and the punch stretchability.

FIG. 22 shows the influence of r values and n values on the deep drawability and the punch stretchability.

Similar with the Best Mode 1, excellent deep drawability and punch stretchability are obtained if only the formulae (3) and (4) are satisfied.

$$11.0\leqq r+50.0\times n \quad (3)$$

$$2.9\leqq r+5.00\times n \quad (4)$$

The Steel sheet 7 according to the present invention may further contain titanium to form fine grains and to improve resistance to surface strain. If the titanium content exceeds 0.05%, the surface appearance significantly degrades on hot dip galvanization. Therefore, the titanium content is specified to not more than 0.05%, preferably from 0.005 to 0.02%. In that case, formula (15) is necessary to be applied instead of formula (14).

$$1.98-66.3\times C\leqq(Nb\times12)/(C\times93)+(Ti^*\times12)/(C\times48)\leqq3.24-80.0\times C \quad (15)$$

Furthermore, to improve the resistance to embrittlement during secondary operation, the addition of boron is effective. If the boron content exceeds 0.002%, the deep drawability and the punch stretchability degrade. Accordingly, the boron content is specified to not more than 0.002%, preferably from 0.0001 to 0.001%.

The Steel sheet 7 according to the present invention has characteristics of, adding to the excellent uniformity of material in a coil, excellent combined formability, resistance to embrittlement during secondary operation, formability at welded portions, anti-burring performance during shearing, good surface appearance, which characteristics are applicable grades to the automobile exterior panels.

The Steel sheet 7 according to the present invention can be manufactured by the steps of: preparing a continuous casting slab of a steel having the composition adjusted as described above, including the addition of titanium and boron; finish rolling the slab to 60% or less of total reduction ratios of the pass just before the final pass and the final pass to prepare coiled hot rolled steel sheet; and cold rolling the hot rolled steel sheet followed by annealing. For hot rolling the continuous cast slab may be done directly or after reheated.

To obtain excellent uniformity of material in a coil, deep drawability, and punch stretchability without fail, it is preferred to conduct the finish rolling at temperatures of 870° C. or more, the coiling after rolled at temperatures of 550° C. or more, the cold rolling at 50 to 85% of reduction ratios, and the annealing at temperatures of from 780 to 880° C. in a continuous annealing line. From the viewpoint of stability of descaling by pickling, the coiling is preferably done at 700° C. or less of temperatures, more preferably 680° C. or less.

The Steel sheet 7 according to the present invention may further be treated, at need, by zinc base plating treatment such as electroplating and hot dip plating, and by organic coating treatment after the plating.

EXAMPLE 1

Molten steels of Steel Nos. 1 through 10 shown in Table 23 were prepared. The melts were then continuously cast to form slabs having 220 mm of thickness. After heating the slabs to 1200° C., hot rolled steel sheets having 2.8 mm of thickness were prepared from the slabs under the condition of 30 to 50% of total reduction ratios of the pass just before the final pass and the final pass, 880 to 960° C. of finish temperatures. The hot rolled steel sheets were coiled at 580 to 680° C. of coiling temperatures. The coiled hot rolled sheets were then cold rolled to a thickness of 0.80 mm. The cold rolled sheets were treated by continuous annealing (CAL) at temperatures of from 840 to 870° C., or by continuous annealing at 850 to 870° C. of temperatures followed by hot dip galvanization (CGL), which were then temper-rolled to 0.7% of reduction ratio.

In the case of continuous annealing followed by hot dip galvanization, the hot dip galvanization after the annealing was given at 460° C., and, immediately after the hot dip galvanization, an alloying treatment of plating layer was given at 500° C. in an in-line alloying furnace. The coating weight was 45 g/m$^2$ per side.

Thus obtained steel sheets were tested to determine tensile characteristics (along the rolling direction; with JIS Class 5 specimens; and n values being computed in a 1 to 5% strain domain), r values, limit drawing ratio (LDR), and hat forming height (H). For the galvanized steel sheets, the zinc plating adhesiveness was also determined.

Regarding the zinc plating adhesiveness, adhesive tapes were attached onto the surface of a plating steel sheet, and the steel sheet was subjected to 90 degrees of bending and straightening, then the amount of plating attached to the adhesive tapes was determined. The determination was given on five grades: 1 for no peeling observed; 2 for slight peeling observed; 3 for small amount of peeling observed; 4 for medium area of peeling observed; and 5 for large area of peeling observed. The grades 1 and 2 were set to acceptable range.

The test results are shown in Tables 24 through 26.

These tables show that the Example steel sheets give excellent deep drawability, punch stretchability, and uniformity of material in a coil, also give excellent zinc plating adhesiveness.

To the contrary, the Comparative steel sheets give poor deep drawability and punch stretchability, and, when they dissatisfy the above-given formula (14), the uniformity of material in the longitudinal direction of coil is significantly poor. In addition, when phosphorus and titanium exist to a large amount, the plating adhesiveness is also inferior.

EXAMPLE 2

Slab of Steel No. 1 shown in Table 23 was heated to 1200° C., and hot rolled to 2.8 mm of thickness under the condition of 30 to 70% of total reduction ratios of the pass just before the final pass and the final pass, 880 to 910° C. of finish temperatures. The hot rolled steel sheets were coiled at 580 to 640° C. of coiling temperatures. The coiled hot rolled sheets were then cold rolled to a thickness of 0.8 mm. The cold rolled sheets were treated by continuous annealing at temperatures of from 840 to 870° C., or by continuous annealing at 850 to 870° C. of temperatures followed by hot dip galvanization, which were then temper-rolled to 0.7% of reduction ratio.

The condition of hot dip galvanization was the same with that of Example 1.

Thus obtained steel sheets were tested to determine tensile characteristics along the rolling direction (n values being computed in a 1 to 5% strain domain), r value, limit drawing ratio, and hat forming height.

The test results are shown in Table 27.

The steels which were prepared at 60% or less of total reduction ratios of the pass just before the final pass and the final pass, and which reduction ratios were within the specified range of the present invention, showed excellent uniformity of material in the coil longitudinal direction.

EXAMPLE 3

Slab of Steel No. 1 shown in Table 23 was heated to 1200° C., and hot rolled to 1.3 to 6.0 mm of thicknesses under the condition of 40% of total reduction ratios of the pass just before the final pass and the final pass, 840 to 980° C. of finish temperatures. The hot rolled steel sheets were coiled at 500 to 700° C. of coiling temperatures. The coiled hot rolled sheets were then cold rolled to a thickness of 0.80 mm at 46 to 87% of reduction ratios. The cold rolled sheets were treated by continuous annealing or by continuous annealing followed by hot dip galvanization, which were then temper-rolled to 0.7% of reduction ratio.

The condition of hot dip galvanization was the same with that of Example 1.

Thus obtained steel sheets were tested to determine tensile characteristics along the rolling direction (n values being computed in a 1 to 5% strain domain), r values, limit drawing ratio, and hat forming height.

The test results are shown in Tables 28 and 29.

The steels which were prepared within the specified range of the present invention in terms of finish temperature, coiling temperature, reduction ratio during cold rolling, and annealing, showed excellent uniformity of material in the coil longitudinal direction.

TABLE 23

| Steel No. | C | Si | Mn | P | S | sol.Al | N | Nb | Ti | B | X/C# | Remarks |
|---|---|---|---|---|---|---|---|---|---|---|---|---|
| 1 | 0.0059 | 0.01 | 0.34 | 0.019 | 0.011 | 0.050 | 0.0021 | 0.082 | tr | tr | 1.8 | Example Steel |
| 2 | 0.0060 | 0.01 | 0.63 | 0.040 | 0.007 | 0.062 | 0.0012 | 0.075 | tr | tr | 1.6 | Example Steel |
| 3 | 0.0078 | 0.01 | 0.95 | 0.045 | 0.009 | 0.058 | 0.0018 | 0.162 | tr | tr | 2.7 | Example Steel |
| 4 | 0.0065 | 0.02 | 0.25 | 0.021 | 0.008 | 0.050 | 0.0017 | 0.091 | 0.011 | tr | 1.8* | Example Steel |
| 5 | 0.0081 | 0.01 | 0.42 | 0.020 | 0.007 | 0.050 | 0.0017 | 0.092 | 0.024 | 0.0006 | 1.7* | Example Steel |
| 6 | 0.0063 | 0.10 | 0.16 | 0.030 | 0.011 | 0.057 | 0.0019 | 0.088 | tr | tr | 1.8 | Comparative Steel |
| 7 | 0.0059 | 0.02 | 0.20 | 0.067 | 0.010 | 0.050 | 0.0021 | 0.087 | tr | tr | 1.9 | Comparative Steel |
| 8 | 0.0060 | 0.01 | 0.22 | 0.030 | 0.009 | 0.056 | 0.0019 | 0.056 | tr | tr | 1.2 | Comparative Steel |
| 9 | 0.0058 | 0.01 | 0.21 | 0.028 | 0.010 | 0.057 | 0.0020 | 0.148 | tr | tr | 3.3* | Comparative Steel |
| 10 | 0.0090 | 0.01 | 0.62 | 0.050 | 0.015 | 0.035 | 0.0036 | 0.126 | tr | tr | 1.8 | Comparative Steel |

X/C#: (Nb % × 12)/(C % × 93)

*(Nb % × 12)/(C % × 93) + (Ti* % × 12)/(C % × 48), Ti* % = Ti − (48/14)N % − (48/32)S %

TABLE 24

| No. | Steel No. | Total reduction ratio of the pass just before the final pass and the final pass (%) | Finish temperature (° C.) | Coiling temperature (° C.) | Annealing condition | Characteristics of steel sheet: YP (MPa) | TS (MPa) | El (%) | n value | r value | Y** | Z*** | Formability of steel sheet: H (mm) | LDR | Zinc plating adhesiveness | Remarks |
|---|---|---|---|---|---|---|---|---|---|---|---|---|---|---|---|---|
| 1 | 1 | 40 | 890 | 580 | CAL | 204 | 353 | 44 | 0.201 | 2.00 | 12.1 | 3.0 | 34.8 | 2.16 | — | Example |
| 2 | 1 | 40 | 890 | 580 | CGL | 207 | 356 | 44 | 0.194 | 2.01 | 11.7 | 3.0 | 34.2 | 2.16 | 1 | Example |
| 3 | 1 | 40 | 900 | 640 | CAL | 202 | 354 | 45 | 0.202 | 2.03 | 12.1 | 3.0 | 34.8 | 2.16 | — | Example |
| 4 | 1 | 40 | 900 | 640 | CGL | 196 | 355 | 45 | 0.200 | 2.02 | 12.0 | 3.0 | 34.6 | 2.16 | 1 | Example |

TABLE 24-continued

| No. | Steel No. | Total reduction ratio of the pass just before the final pass and the final pass (%) | Finish temperature (° C.) | Coiling temperature (° C.) | Annealing condition | Characteristics of steel sheet YP (MPa) | TS (MPa) | El (%) | n value | r value | Y** | Z*** | Formability of steel sheet H (mm) | LDR | Zinc plating adhesiveness | Remarks |
|---|---|---|---|---|---|---|---|---|---|---|---|---|---|---|---|---|
| 5 | 1 | 40 | 910 | 680 | CAL | 193 | 352 | 46 | 0.203 | 2.09 | 12.2 | 3.1 | 34.9 | 2.17 | — | Example |
| 6 | 1 | 40 | 910 | 680 | CGL | 195 | 356 | 45 | 0.202 | 2.06 | 12.2 | 3.1 | 34.9 | 2.17 | 2 | Example |
| 7 | 2 | 30 | 910 | 580 | CGL | 214 | 384 | 42 | 0.191 | 1.97 | 11.5 | 2.9 | 33.8 | 2.15 | 1 | Example |
| 8 | 2 | 30 | 930 | 640 | CGL | 212 | 382 | 43 | 0.196 | 1.95 | 11.8 | 2.9 | 34.3 | 2.15 | 1 | Example |
| 9 | 3 | 50 | 890 | 640 | CGL | 225 | 395 | 41 | 0.195 | 2.09 | 11.8 | 3.1 | 34.3 | 2.17 | 2 | Example |
| 10 | 3 | 50 | 900 | 680 | CGL | 227 | 394 | 42 | 0.199 | 2.13 | 12.1 | 3.1 | 34.8 | 2.17 | 2 | Example |
| 11 | 4 | 30 | 890 | 580 | CGL | 205 | 355 | 43 | 0.198 | 1.98 | 11.9 | 3.0 | 34.4 | 2.16 | 1 | Example |
| 12 | 4 | 30 | 900 | 640 | CGL | 203 | 354 | 43 | 0.201 | 2.01 | 12.1 | 3.0 | 34.8 | 2.16 | 1 | Example |
| 13 | 4 | 30 | 910 | 680 | CGL | 202 | 352 | 44 | 0.202 | 2.04 | 12.1 | 3.1 | 34.8 | 2.17 | 1 | Example |
| 14 | 5 | 40 | 900 | 640 | CGL | 212 | 372 | 39 | 0.189 | 1.96 | 11.4 | 2.9 | 33.6 | 2.15 | 2 | Example |
| 15 | 5 | 40 | 910 | 680 | CGL | 210 | 370 | 40 | 0.194 | 1.93 | 11.6 | 2.9 | 34.0 | 2.15 | 2 | Example |

Y** = r + 50.0 × n,

Z*** = r + 5.0 × n

TABLE 25

| No. | Steel No. | Total reduction ratio of the pass just before the final pass and the final pass (%) | Finish temperature (° C.) | Coiling temperature (° C.) | Annealing condition | Characteristics of steel sheet YP (MPa) | TS (MPa) | El (%) | n value | r value | Y** | Z*** | Formability of steel sheet H (mm) | LDR | Zinc plating adhesiveness | Remarks |
|---|---|---|---|---|---|---|---|---|---|---|---|---|---|---|---|---|
| 16 | 6 | 30 | 900 | 640 | CGL | 215 | 365 | 42 | 0.182 | 1.88 | 11.0 | 2.8 | 33.0 | 2.07 | 4 | Comparative Example |
| 17 | 6 | 30 | 910 | 680 | CGL | 212 | 362 | 43 | 0.184 | 1.86 | 11.1 | 2.8 | 33.2 | 2.07 | 5 | Comparative Example |
| 18 | 7 | 30 | 900 | 640 | CGL | 222 | 368 | 41 | 0.180 | 1.93 | 10.9 | 2.8 | 29.4 | 2.07 | 3 | Comparative Example |
| 19 | 7 | 30 | 910 | 680 | CGL | 224 | 367 | 41 | 0.178 | 1.93 | 10.8 | 2.8 | 28.0 | 2.07 | 4 | Comparative Example |
| 20 | 8 | 40 | 900 | 580 | CAL | 321 | 394 | 23 | 0.126 | 1.12 | 7.4 | 1.8 | 19.4 | 1.96 | — | Comparative Example |
| 21 | 6 | 40 | 890 | 580 | CGL | 323 | 398 | 22 | 0.128 | 1.18 | 7.6 | 1.8 | 19.6 | 1.96 | 1 | Comparative Example |
| 22 | 6 | 40 | 900 | 640 | CAL | 283 | 382 | 30 | 0.146 | 1.34 | 8.6 | 2.1 | 20.6 | 1.99 | — | Comparative Example |
| 23 | 7 | 40 | 900 | 640 | CGL | 287 | 385 | 31 | 0.142 | 1.30 | 8.4 | 2.0 | 20.4 | 1.98 | 1 | Comparative Example |
| 24 | 7 | 30 | 890 | 580 | CAL | 243 | 376 | 37 | 0.153 | 1.72 | 9.4 | 2.5 | 21.8 | 2.03 | — | Comparative Example |
| 25 | 8 | 30 | 890 | 580 | CGL | 245 | 680 | 36 | 0.154 | 1.77 | 9.5 | 2.5 | 22.1 | 2.05 | 2 | Comparative Example |
| 26 | 6 | 30 | 900 | 640 | CAL | 231 | 361 | 37 | 0.176 | 1.81 | 10.6 | 2.7 | 27.3 | 2.05 | — | Comparative Example |
| 27 | 6 | 30 | 900 | 640 | CGL | 233 | 364 | 38 | 0.172 | 1.80 | 10.4 | 2.7 | 26.2 | 2.15 | 2 | Comparative Example |
| 28 | 7 | 40 | 900 | 640 | CAL | 222 | 370 | 32 | 0.163 | 2.12 | 10.3 | 2.9 | 25.2 | 2.07 | 2 | Comparative Example |

Y** = r + 50.0 × n,
Z*** = r + 5.0 × n

TABLE 26

| No. | Steel No. | Total reduction ratio of the pass just before the final pass and the final pass (%) | Finish temperature (° C.) | Coiling temperature (° C.) | Annealing condition | Coil position | Characteristics of steel sheet: YP (MPa) | TS (MPa) | E1 (%) | n value | r value | Y** | Z*** | Formability of steel sheet: H (mm) | LDR | Remarks |
|---|---|---|---|---|---|---|---|---|---|---|---|---|---|---|---|---|
| 29 | 1 | 40 | 890 | 580 | CAL | T | 204 | 353 | 44 | 0.201 | 2.01 | 12.1 | 3.0 | 34.8 | 2.16 | Example |
| | | | | | | M | 202 | 352 | 45 | 0.204 | 2.01 | 12.2 | 3.0 | 34.9 | 2.16 | |
| | | | | | | B | 203 | 355 | 44 | 0.202 | 2.02 | 12.1 | 3.0 | 34.8 | 2.16 | |
| 30 | 1 | 30 | 900 | 640 | CGL | T | 202 | 355 | 44 | 0.200 | 2.02 | 12.0 | 3.0 | 34.6 | 2.16 | Example |
| | | | | | | M | 204 | 353 | 45 | 0.198 | 2.02 | 11.9 | 3.0 | 34.4 | 2.16 | |
| | | | | | | B | 201 | 356 | 44 | 0.202 | 2.01 | 12.1 | 3.0 | 34.8 | 2.16 | |
| 31 | 6 | 40 | 900 | 640 | CGL | T | 287 | 375 | 31 | 0.142 | 1.36 | 8.5 | 2.1 | 20.5 | 1.99 | Comparative |
| | | | | | | M | 211 | 364 | 36 | 0.186 | 1.80 | 11.1 | 2.7 | 33.2 | 2.05 | Example |
| | | | | | | B | 243 | 374 | 31 | 0.150 | 1.40 | 8.9 | 2.2 | 20.9 | 2.00 | |

Y** = r + 50.0 × n,
Z*** = r + 5.0 × n

TABLE 27

| No. | Steel No. | Total reduction ratio of the pass just before the final pass and the final pass (%) | Finish temperature (° C.) | Coiling temperature (° C.) | Annealing condition | Coil position | Characteristics of steel sheet: YP (MPa) | TS (MPa) | E1 (%) | n value | r value | Y** | Z*** | Formability of steel sheet: H (mm) | LDR | Remarks |
|---|---|---|---|---|---|---|---|---|---|---|---|---|---|---|---|---|
| 32 | 1 | 40 | 890 | 580 | CAL | T | 204 | 353 | 44 | 0.201 | 2.01 | 12.1 | 3.0 | 34.8 | 2.16 | Example |
| | | | | | | M | 202 | 352 | 45 | 0.204 | 2.01 | 12.2 | 3.0 | 34.9 | 2.16 | |
| | | | | | | B | 203 | 355 | 44 | 0.202 | 2.02 | 12.1 | 3.0 | 34.8 | 2.16 | |
| 33 | 1 | 30 | 900 | 640 | CGL | T | 202 | 355 | 44 | 0.200 | 2.02 | 12.0 | 3.0 | 34.6 | 2.16 | Example |
| | | | | | | M | 204 | 353 | 45 | 0.198 | 2.02 | 11.9 | 3.0 | 34.4 | 2.16 | |
| | | | | | | B | 201 | 356 | 44 | 0.202 | 2.01 | 12.1 | 3.0 | 34.8 | 2.16 | |
| 34 | 1 | 65 | 890 | 580 | CAL | T | 297 | 402 | 26 | 0.147 | 1.22 | 8.6 | 2.0 | 20.6 | 1.98 | Comparative |
| | | | | | | M | 259 | 384 | 32 | 0.173 | 1.68 | 10.3 | 2.5 | 25.5 | 2.03 | Example |
| | | | | | | B | 275 | 391 | 30 | 0.152 | 1.42 | 9.0 | 2.2 | 21.0 | 2.00 | |
| 35 | 1 | 65 | 900 | 640 | CGL | T | 285 | 388 | 27 | 0.156 | 1.31 | 9.1 | 2.1 | 21.2 | 1.99 | Comparative |
| | | | | | | M | 246 | 371 | 35 | 0.190 | 1.76 | 11.3 | 2.7 | 33.5 | 2.05 | Example |
| | | | | | | B | 263 | 376 | 30 | 0.173 | 1.52 | 10.2 | 2.4 | 24.8 | 2.02 | |

Y** = r + 50.0 × n,
Z*** = r + 5.0 × n

TABLE 28

| No. | Finish temperature (° C.) | Coiling temperature (° C.) | Cold rolling ratio (%) | Annealing condition | Annealing temperature (° C.) | Coil position | Characteristics of steel sheet: YP (MPa) | TS (MPa) | E1 (%) | n value | r value | Y** | Z*** | Formability of steel sheet: H (mm) | LDR | Remarks |
|---|---|---|---|---|---|---|---|---|---|---|---|---|---|---|---|---|
| 36 | 890 | 580 | 71 | CAL | 850 | T | 204 | 353 | 44 | 0.201 | 2.01 | 12.1 | 3.0 | 34.8 | 2.16 | Example |
| | | | | | | M | 202 | 352 | 45 | 0.204 | 2.01 | 12.2 | 3.0 | 34.9 | 2.16 | |
| | | | | | | B | 203 | 355 | 44 | 0.202 | 2.02 | 12.1 | 3.0 | 34.8 | 2.16 | |
| 37 | 930 | 640 | 75 | CGL | 640 | T | 194 | 352 | 46 | 0.212 | 2.10 | 12.7 | 3.2 | 35.6 | 2.18 | Example |
| | | | | | | M | 196 | 348 | 47 | 0.214 | 2.12 | 12.8 | 3.2 | 35.7 | 2.18 | |
| | | | | | | B | 193 | 351 | 46 | 0.211 | 2.13 | 12.7 | 3.2 | 35.6 | 2.18 | |
| 38 | 840 | 640 | 71 | CGL | 850 | T | 277 | 385 | 30 | 0.154 | 1.43 | 9.1 | 2.2 | 21.2 | 2.00 | Comparative |
| | | | | | | M | 213 | 358 | 41 | 0.181 | 1.78 | 10.8 | 2.7 | 28.0 | 2.05 | Example |
| | | | | | | B | 252 | 372 | 33 | 0.171 | 1.61 | 10.2 | 2.5 | 24.8 | 2.03 | |
| 39 | 900 | 500 | 71 | CAL | 830 | T | 234 | 371 | 34 | 0.147 | 1.62 | 9.0 | 2.4 | 21.0 | 2.02 | Comparative |
| | | | | | | M | 222 | 365 | 37 | 0.153 | 1.66 | 9.3 | 2.4 | 21.6 | 2.02 | Example |
| | | | | | | B | 231 | 369 | 35 | 0.150 | 1.63 | 9.1 | 2.4 | 21.2 | 2.02 | |

TABLE 28-continued

| No. | Finish temperature (° C.) | Coiling temperature (° C.) | Cold rolling ratio (%) | Annealing condition | Annealing temperature (° C.) | Coil position | Characteristics of steel sheet YP (MPa) | TS (MPa) | E1 (%) | n value | r value | Y** | Z*** | Formability of steel sheet H (mm) | LDR | Remarks |
|---|---|---|---|---|---|---|---|---|---|---|---|---|---|---|---|---|
| 40 | 890 | 640 | 46 | CGL | 810 | T | 218 | 351 | 41 | 0.179 | 1.55 | 10.5 | 2.4 | 27.0 | 2.02 | Comparative |
| | | | | | | M | 208 | 347 | 43 | 0.186 | 1.59 | 10.9 | 2.5 | 29.4 | 2.03 | Example |
| | | | | | | B | 215 | 349 | 42 | 0.183 | 1.57 | 10.7 | 2.5 | 27.5 | 2.03 | |

Y** = r + 50.0 × n,
Z*** = r + 5.0 × n

TABLE 29

| No. | Finish temperature (° C.) | Coiling temperature (° C.) | Cold rolling ratio (%) | Annealing condition | Annealing temperature (° C.) | Coil position | Characteristics of steel sheet YP (MPa) | TS (MPa) | E1 (%) | n value | r value | Y** | Z*** | Formability of steel sheet H (mm) | LDR | Remarks |
|---|---|---|---|---|---|---|---|---|---|---|---|---|---|---|---|---|
| 41 | 910 | 680 | 87 | CGL | 860 | T | 247 | 372 | 40 | 0.158 | 2.14 | 10.0 | 2.9 | 23.2 | 2.15 | Comparative |
| | | | | | | M | 233 | 368 | 42 | 0.166 | 2.17 | 10.5 | 3.0 | 27.0 | 2.16 | Example |
| | | | | | | B | 242 | 371 | 41 | 0.151 | 2.15 | 9.7 | 2.9 | 22.7 | 2.15 | |
| 42 | 880 | 580 | 71 | CAL | 750 | T | 236 | 365 | 40 | 0.167 | 1.61 | 10.0 | 2.4 | 23.2 | 2.02 | Comparative |
| | | | | | | M | 224 | 361 | 42 | 0.172 | 1.64 | 10.2 | 2.5 | 24.8 | 2.03 | Example |
| | | | | | | B | 229 | 362 | 42 | 0.170 | 1.63 | 10.1 | 2.5 | 24.0 | 2.03 | |
| 43 | 920 | 640 | 73 | CGL | 900 | T | 248 | 381 | 32 | 0.143 | 1.56 | 8.7 | 2.3 | 20.7 | 2.01 | Comparative |
| | | | | | | M | 239 | 373 | 34 | 0.150 | 1.62 | 9.1 | 2.4 | 21.2 | 2.02 | Example |
| | | | | | | B | 244 | 377 | 33 | 0.148 | 1.59 | 9.0 | 2.3 | 21.0 | 2.01 | |
| 44 | 870 | 550 | 68 | CGL | 780 | T | 228 | 373 | 33 | 0.146 | 1.54 | 8.8 | 2.3 | 20.8 | 2.01 | Comparative |
| | | | | | | M | 217 | 369 | 34 | 0.151 | 1.58 | 9.1 | 2.3 | 21.2 | 2.01 | Example |
| | | | | | | B | 223 | 370 | 33 | 0.149 | 1.57 | 9.0 | 2.3 | 21.0 | 2.01 | |

Y** = r + 50.0 × n,
Z*** = r + 5.0 × n

What is claimed is:

1. A high strength steel sheet consisting essentially of 0.0040 to 0.01% C, 0.05% or less Si, 0.1 to 1.0% Mn, 0.01 to 0.05% P, 0.02% or less S, 0.01 to 0.1% sol.Al, 0.004% or less N, 0.15% or less Nb, and optionally 0.05% or less Ti and optionally 0.002% or less B, by weight, and a balance of substantially Fe and inevitable impurities, and satisfying the following formula (6):

$$(12/93)\times Nb^*/C \geqq 1.2 \quad (6),$$

wherein $Nb^*=Nb-(93/14)\times N$, and C, N, and Nb denote the content in % by weight of C, N, and Nb, respectively, and having an n value of 0.21 or more which is calculated from two points of nominal strain, at 1% and 10%, observed in a uniaxial tensile test.

2. The high strength steel sheet of claim 1, further containing 0.05% or less Ti, by weight.

3. The high strength steel sheet of claim 1, further containing 0.002% or less B, by weight.

4. A method for manufacturing a high strength cold rolled steel sheet, comprising the steps of:

(a) preparing a continuous casting slab of a steel which consists essentially of 0.0040 to 0.01% C, 0.05% or less Si, 0.10 to 1.0% Mn, 0.01 to 0.05% P, 0.02% or less S, 0.01 to 0.1% sol.Al, 0.004% or less N, 0.15% or less Nb, by weight, and a balance of substantially Fe and inevitable impurities, and which satisfies the following formula (6):

$$(12/93)\times Nb^*/C \geqq 1.2 \quad (6),$$

wherein $Nb^*=Nb-(93/14)\times N$, and C, N, and Nb denote the content in % by weight of C, N, and Nb, respectively;

(b) preparing a hot rolled steel sheet by finish rolling the slab from step (a) at a temperature of an Ar3 transformation temperature or more;

(c) coiling the hot rolled steel sheet from step (b) at a temperature of from 500 to 700° C.;

(d) cold rolling the coiled hot rolled steel sheet from step (c) and (e) annealing the steel sheet from step (d).

5. The high strength steel sheet of claim 2, further containing 0.002% or less B, by weight.

* * * * *

UNITED STATES PATENT AND TRADEMARK OFFICE

CERTIFICATE OF CORRECTION

PATENT NO. : 6,689,229 B2
DATED : February 10, 2004
INVENTOR(S) : Takeshi Fujita et al.

It is certified that error appears in the above-identified patent and that said Letters Patent is hereby corrected as shown below:

Title page,
Item [75], Inventors, "Yoshihiro Hosoya, Fukuyama (JP); Toru Inazumi, Fukuyama (JP); Yuji Yamasaki, Fukuyama (JP); Yasunobu Nagataki, Fukuyama (JP); Kohei Hasegawa; Fukuyama (JP); Hiroshi Matsuda, Fukuyama (JP); Moriaki Ono, Fukuyama (JP)" should be deleted.
Item [30], Forein Application Priority Data,
-- Feb. 15, 1999 (JP) .....11-036288 -- should be inserted.

Column 53,
Line 47, "≧" should be replaced with -- ≥ --.

Column 54,
Line 44, "≧" should be replaced with -- ≥ --.

Signed and Sealed this

Twenty-eighth Day of December, 2004

JON W. DUDAS
*Director of the United States Patent and Trademark Office*